US007263970B2

(12) United States Patent
Ishida et al.

(10) Patent No.: US 7,263,970 B2
(45) Date of Patent: Sep. 4, 2007

(54) INTAKE FLOW CONTROL APPARATUS FOR AN INTERNAL COMBUSTION ENGINE

(75) Inventors: Shuichi Ishida, Saitama (JP); Katsunori Takahashi, Saitama (JP); Katsuhiro Kunikiyo, Saitama (JP); Ryohsaku Nishiyama, Saitama (JP); Hiroya Ueda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 51 days.

(21) Appl. No.: 11/333,680

(22) Filed: Jan. 17, 2006

(65) Prior Publication Data

US 2006/0162691 A1 Jul. 27, 2006

(30) Foreign Application Priority Data

Jan. 21, 2005 (JP) ..... 2005-014710
Jan. 21, 2005 (JP) ..... 2005-014711
Jan. 21, 2005 (JP) ..... 2005-014712

(51) Int. Cl.
*F02M 35/10* (2006.01)

(52) U.S. Cl. ..... 123/339.21; 123/470

(58) Field of Classification Search ..... 123/339.21, 123/470, 184.21, 184.52, 337
See application file for complete search history.

(56) References Cited

U.S. PATENT DOCUMENTS 6,915,774 B2 * 7/2005 Sakai ..... 123/184.52
2005/0263137 A1 * 12/2005 Nagano et al. ..... 123/470

FOREIGN PATENT DOCUMENTS

| | | |
|---|---|---|
| DE | 830266 | 2/1952 |
| DE | 2058992 | 6/1972 |
| DE | 3007905 | 9/1981 |
| DE | 3626681 | 1/1988 |
| DE | 3828686 | 3/1989 |
| EP | 1267067 | 12/2002 |
| FR | 2714114 | 6/1995 |
| GB | 2109860 | 6/1983 |
| JP | 9-88616 A * | 3/1997 |
| JP | 11-324832 | 11/1999 |

* cited by examiner

*Primary Examiner*—Hieu T. Vo
(74) *Attorney, Agent, or Firm*—Carrier, Blackman, & Associates, P.C.; William D. Blackman; Joseph P. Carrier

(57) ABSTRACT

An intake flow control apparatus for an internal combustion engine eases operation of an air flow regulator and permits use of a short intake passage, thus providing a high output. The intake flow control apparatus includes an air routing member having an intake passage formed therein, and an air flow regulator opposed to an upstream-side opening of the intake passage. The air flow regulator moves in an intake axis direction while being guided by a light-weight guide structure to control the amount of intake air supplied. The air flow regulator may include plural valve elements different in operation timing, in which a valve actuator successively actuates the plural valve elements in accordance with a throttle operation to control the amount of intake air. The apparatus also includes a vacuum moderating structure for reducing the effective strength of a vacuum applied to the air flow regulator.

18 Claims, 31 Drawing Sheets

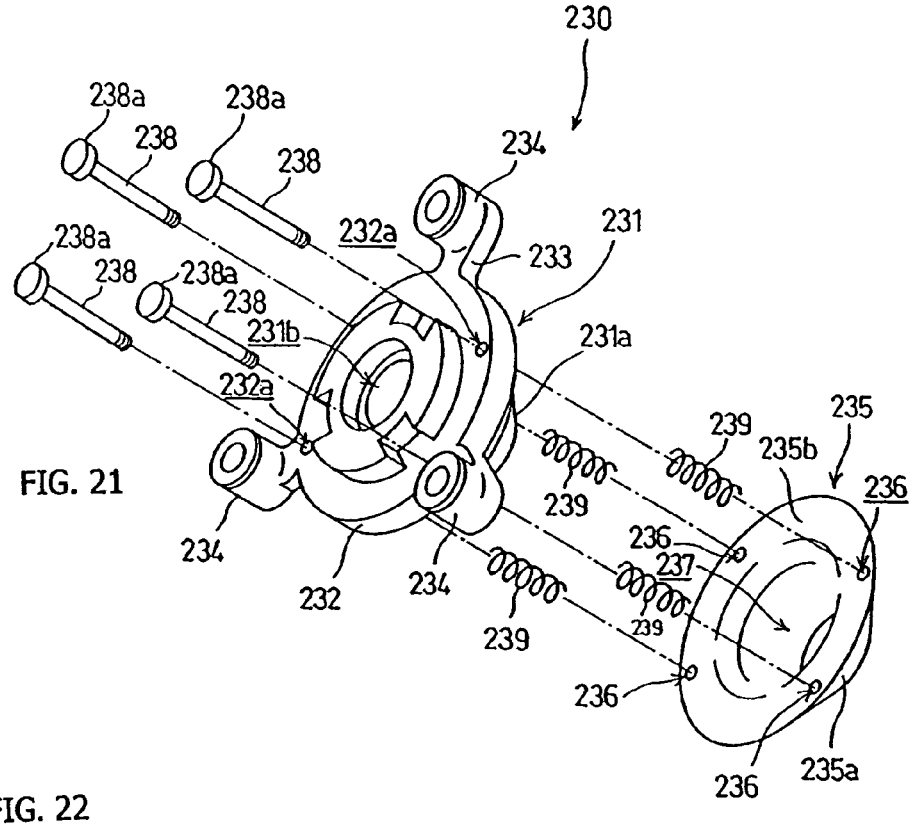
FIG. 21
FIG. 22
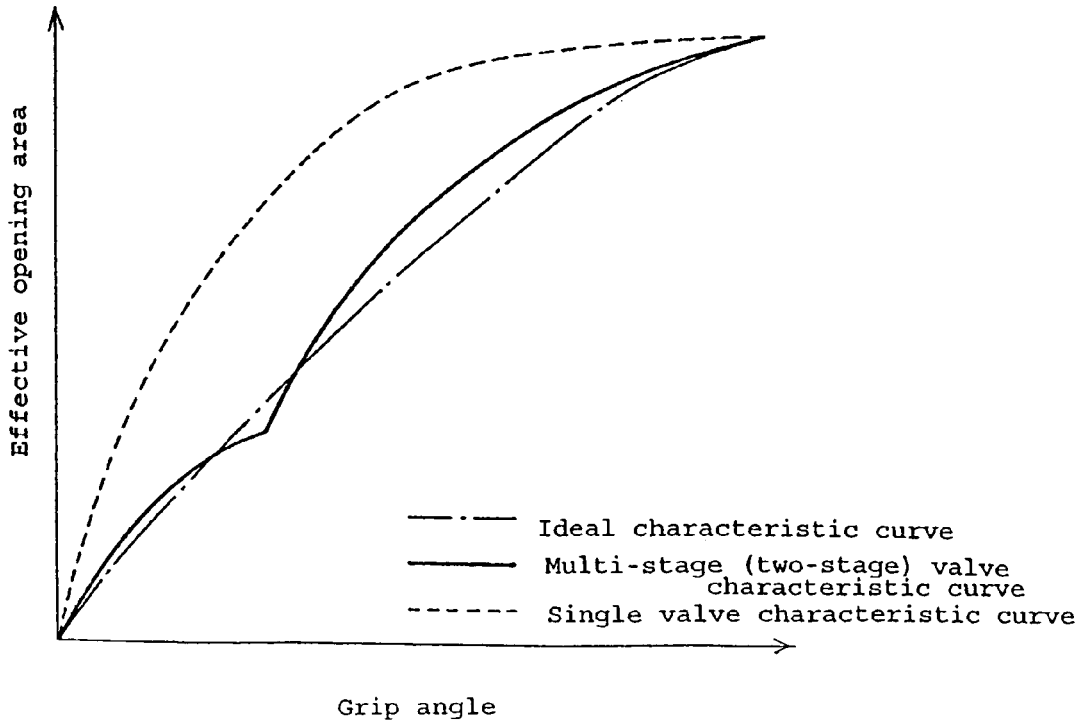

INTAKE FLOW CONTROL APPARATUS FOR AN INTERNAL COMBUSTION ENGINE

CROSS-REFERENCE TO RELATED APPLICATIONS

The present invention claims priority under 35 USC 119 based on Japanese patent applications No. 2005-014710, No. 2005-014711, and No. 2005-014712, all filed on Jan. 21, 2005. The subject matter of each of these priority documents, including written description, drawings, and claims, is incorporated by reference herein.

BACKGROUND OF THE INVENTION

1. Field of the Invention

The present invention relates to an intake air flow regulator apparatus for use on an internal combustion engine. More particularly, the present invention relates to an air flow regulator apparatus in which a guide structure guides axial movement of an air flow regulator plug in response to movement of a throttle actuator, to control air flow through an intake passage and to a combustion chamber.

2. Description of the Background Art

Within an intake passage for introducing intake air into a combustion chamber of an internal combustion engine, a throttle valve, such as a butterfly-type rotary opening/closing valve is normally provided, for controlling the amount of intake air flowing therethrough. If a throttle valve is disposed within the intake passage, a limit is encountered in shortening the intake passage. Often in the conventional engine technology, this type of butterfly valve has been provided as part of a generally cylindrical throttle body.

Particularly, in the case of an internal combustion engine operating at a high rotary speed, it is necessary to shorten the length of an intake passage in order to obtain a high output. However, it is difficult to meet this requirement where the throttle valve is disposed within the intake passage.

Moreover, if a rotary opening/closing valve or the like is present within an intake passage, the air flow resistance increases, because the valve mechanism disturbs the smooth flow of intake air.

To avoid this inconvenience, an intake passage has been proposed which opens in a funnel shape into a surge tank, and an air guide member for conducting air into the air funnel is disposed at a position opposed to the opening of the air funnel, so as to be movable in an intake axis direction. The air guide member is actuated by a motor. Such an intake passage is disclosed, for example, in Japanese Laid-open Patent No. Hei 11-324832.

In Japanese Laid-open Patent No. Hei 11-324832, since the air guide member is not disposed within the intake passage, but instead, is disposed in opposition to the air funnel opening of the intake passage, it is possible to shorten the intake passage further than was previously possible, with little or no risk of disturbance of the intake air flow.

When the air guide member is close to the air funnel opening when the engine is operating in a low-revolution operation state, i.e., an operation state involving control of a very small amount of intake air, a negative pressure or vacuum within the intake passage is heavily imposed on the air guide member, and has a tendency to pull the air guide member towards the opening. As a result, a large amount of power is required for moving the air guide member, and thus it is not easy to control the amount of intake air.

Also when the air guide member is moved by a motor, as in Japanese Patent Laid-open No. Hei 11-324832, it is necessary to use a greater operating force than a high negative pressure imposed on the air guide member which is positioned in proximity to the air funnel opening. Accordingly, a motor of a relatively large power output is needed to move the air guide member, the required size and weight of the motor is larger, and the cost thereof increases.

The present invention has been accomplished in view of the above-mentioned points and it is an object of the invention to provide an intake flow control apparatus for use in an internal combustion engine having a shortened intake passage, thereby obtaining a high output, and permitting the light actuation of an air flow regulator in an engine operation state involving control of a very small amount of intake air, thereby facilitating control of the amount of intake air.

As discussed above, when controlling the amount of intake air throughout the whole of an operational range of an internal combustion engine, there is an operation region when the engine is operating in a low-revolution operation state, i.e., an operation state involving control of a very small amount of intake air. In such an operation region, an air guide member is positioned in close proximity to an intake passage opening. Therefore, it is preferable that a uniform clearance between the air guide member and the intake passage opening in such a close positional relation to each other be constant independently of disturbance.

When an air guide member is provided in a tank wall of a surge tank attached to an intake pipe as in Japanese Patent Laid-open No. Hei 11-324832, it is necessary, for keeping the aforesaid clearance constant, to ensure the accuracy of each component of the surge tank and the mounting accuracy of the tank.

Pulsation of a negative pressure acts on the air guide member. Therefore, in order for the air guide member and the intake passage opening to be constantly aligned with each other on the same intake axis, the surge tank itself is required to be highly rigid so as not to be influenced by pulsation of the negative pressure. However, when high rigidity is required for the surge tank, an excessive weight inevitably results.

The present invention has been accomplished in view of the above-mentioned point. It is an object of the invention to provide an intake flow control apparatus for an internal combustion engine which can shorten an intake passage to obtain a high output and which, with use of a simple and light-weight guide structure, can easily ensure a high movement position accuracy of an intake air control valve with respect to an intake passage opening, regardless of pressure disturbances.

The air guide member as an air flow regulator described in Japanese Patent Laid-open No. Hei 11-324832 is a single valve element. With manual operation, it is difficult to arbitrarily change the amount of intake air using a single valve element in accordance with the amount of a throttle operation.

Therefore, it is necessary to control air flow regulator operation with use of a motor or the like. However, when setting a basic valve angle characteristic of a valve element by controlling valve operation with use of a motor, complicated control is required.

The present invention has been accomplished in view of the above-mentioned point and in a particular embodiment hereof, the present invention provides an intake flow control apparatus for an internal combustion engine having a shortened intake passage, thereby obtaining a high output, and in which, even by manual operation or by a simple operation control using a motor or the like, a required intake air quantity characteristic relative to the amount of a throttle operation can be set easily.

SUMMARY

In order to achieve the above-mentioned object, in a first aspect of the invention, there is provided an intake flow control apparatus for an internal combustion engine. The intake flow control apparatus includes an air routing member having an intake passage formed therein for introducing intake air into a combustion chamber of the internal combustion engine. The intake flow control apparatus according to the first aspect also includes an air flow regulator opposed to an upstream-side opening of the intake passage and adapted to move in an intake axis direction, while guided by a guide structure, to control the amount of intake air fed into the intake passage. The intake flow control apparatus also includes a control mechanism for selectively moving the air flow regulator according to an amount of operation of a throttle, and a vacuum moderating structure for moderating a vacuum applied to the air flow regulator.

According to the intake flow control apparatus described above, since the intake flow control apparatus has an air flow regulator adapted to move in the intake axis direction in opposition to an upstream-side opening of the intake passage, not only it is possible to shorten the intake passage, and thereby obtain a high output, but also it is possible to diminish the air flow resistance. In addition, since the intake flow control apparatus has a vacuum moderating structure, even when the air flow regulator approaches and comes into abutment against the upstream-side opening of the intake passage, it is possible to reduce the amount of force required for subsequent outward movement of the air flow regulator, and to effect a smooth control of the amount of intake air by reducing the vacuum with use of the vacuum moderating structure.

Even in the case where the air flow regulator is moved by means of a motor, the load imposed on the motor is reduced, and therefore a high output motor is not needed, whereby not only an increase of motor size and weight is prevented, but also power usage and manufacturing costs are reduced.

In a second aspect of the invention there is provided, in combination with the first aspect of invention, an intake flow control apparatus for an internal combustion engine wherein the vacuum moderating structure includes an air bypass passage formed in the air flow regulator or in a body of the internal combustion engine. The air bypass passage, where used, provides limited, ongoing fluid communication between the interior and the exterior of the intake passage when the air flow regulator comes into abutment against the opening of the intake passage to close the opening thereof.

According to the second aspect of the invention, since the interior and the exterior of the intake passage are put in communication with each other through the air bypass passage when the air flow regulator abuts against the intake passage opening to close the opening, the vacuum is reduced and the air flow regulator is easily moved outwardly.

Since the air flow regulator abuts against the intake passage opening, it is easy to minimize the disturbance which occurs upon exertion of intake pulsation or the like on the air flow regulator. The formation of a passage corresponding to only a desired negative pressure to be reduced is easy because all that is required is merely setting the shape and opening area of the air bypass passage.

In a third aspect of the invention there is provided, in combination with the first aspect of the invention, an intake flow control apparatus for an internal combustion engine wherein the vacuum moderating structure includes a restriction member for restricting an axial movement of the air flow regulator in the vicinity of the opening of the intake passage.

According to the third aspect of the invention, since the axial movement of the air flow regulator is restricted by the restriction member in the vicinity of the intake passage opening, a gap is provided between the air flow regulator and the intake passage opening whereby communication between the interior and the exterior of the intake passage is ensured, the vacuum is reduced and the amount of force required for movement of the air flow regulator is reduced.

In a fourth aspect of the invention there is provided, in combination with the first aspect of the invention, an intake flow control apparatus for an internal combustion engine wherein the air flow regulator includes a mechanism having a plurality of valve elements. The plural valve elements open stepwise in accordance with the amount of a throttle operation. The vacuum moderating structure is constituted by a valve opening mechanism in which one of the valve elements opens prior to the remaining valve elements, and in which the one valve element is the smallest in closing area of the plural valve elements.

According to the fourth aspect of the invention, the air flow regulator constitutes a mechanism having a plurality of valve elements which open stepwise in accordance with the amount of a throttle operation, and the vacuum moderating structure is constituted by a valve opening mechanism having one of the valve elements which opens first and which is the smallest in closing area. Thus, the valve element which opens first has the smallest closing area, and thus it is easy to open the valve even when the vacuum is high. Further, once the valve is open, the vacuum is reduced, whereby the amount of force required for movement of the next valve is reduced, thus permitting smooth control of the amount of intake air.

If the plural valve elements have mutually different, required valve opening characteristics and are adapted to operate at different operation timings, a required intake air quantity characteristic for the amount of a throttle operation can be set easily even by manual operation or by a simple drive control using a motor for example.

In a fifth aspect of the invention there is provided, in combination with the invention of any of the first through fourth aspects of the invention, an intake flow control apparatus for an internal combustion engine wherein a fuel injector is attached to and adapted to move integrally with the air flow regulator.

According to the fifth aspect of the invention, since a fuel injector is attached to and adapted to move integrally with the air flow regulator, the distance from a fuel injection orifice of the fuel injector to an intake port can be made longer. Thus, the fuel atomizing characteristic can be improved in a high revolution state of the internal combustion engine and in a state in which the air flow regulator is spaced a longest distance from the intake passage opening and is fully open.

In a low revolution region of the internal combustion engine, the distance from the fuel injection orifice of the fuel injector to the intake port becomes shorter, and it is possible to improve the fuel supply responsiveness in a state in which the air flow regulator is abutted against the intake passage opening and is fully closed.

In a sixth aspect of the invention there is provided, in combination with the fourth aspect of the invention, an intake flow control apparatus for an internal combustion engine wherein a fuel injector is attached to a body of the internal combustion engine, and wherein a casing of the fuel injector constitutes the guide structure.

According to the sixth aspect of the invention, since the casing of the fuel injector fixed to the body side of the internal combustion engine constitutes the guide structure for guiding the movement of the air flow regulator, it is not necessary to use any special guide structure and hence it is possible to reduce the number of parts.

Although the guide structure is required to have a high strength to withstand the influence of a negative pressure, since the casing of the fuel injector, which is high in rigidity, is used as the guide structure, it is possible to attain the reduction of weight in comparison with the use of another guide structure.

In a seventh aspect of the invention there is provided, in combination with the invention of any of the first through fourth aspects of the invention, an intake flow control apparatus for an internal combustion engine wherein a fuel injector is provided on an outer periphery of the intake passage in a body of the internal combustion engine.

According to the seventh aspect of the invention, since a fuel injector is provided on an outer periphery of the intake passage in the body of the internal combustion engine, it is possible to simplify the structure of the air flow regulator itself, whereby the air flow resistance is further diminished and it is possible to obtain a high output.

In an eighth aspect of the invention there is provided, in combination with the seventh aspect of the invention, an intake flow control apparatus for an internal combustion engine wherein an annular passage is formed in an outer periphery of the intake passage, injection holes are formed in plural positions throughout the whole circumference of the annular passage so as to extend through the intake passage, and a fuel injection orifice of the fuel injector is open to the annular passage.

According to the eighth aspect of the invention, an annular passage is formed in an outer periphery of the intake passage, injection holes are formed in plural positions throughout the whole circumference of the annular passage so as to extend through the intake passage, and a fuel injection orifice of the fuel injector is open to the annular passage. Therefore, fuel discharged from the fuel injector passes through the annular passage and is injected into the intake passage from the plural injection holes.

Thus, by a simple structure using a single fuel injector and without using plural fuel injectors, fuel can be injected into the intake passage from the plural injection holes, whereby the fuel atomizing characteristic can be greatly improved.

In a ninth aspect of the invention there is provided, in combination with the first aspect of the invention, an intake flow control apparatus for an internal combustion engine wherein an intake pressure sensor for detecting an internal pressure of the intake passage is provided in the air flow regulator.

According to the ninth aspect of the invention, since an intake pressure sensor is provided in the air flow regulator, any special air passage for the detection of intake pressure need not be formed in the outer periphery of the intake passage, that is, there is nothing that disturbs the flow of the air-fuel mixture in the vicinity of the combustion chamber, nor does the intake pressure sensor obstruct shortening of the intake passage. Consequently, it is possible to obtain a high output and the internal combustion engine is compactly made.

In a tenth aspect of the invention there is provided an intake flow control apparatus for an internal combustion engine that includes an intake passage for introducing intake air into a combustion chamber of the internal combustion engine, and an air flow regulator opposed to an upstream-side opening of the intake passage and adapted to move in an intake axis direction while being guided by a guide structure to control the amount of intake air fed into the combustion chamber. The intake flow control apparatus also includes valve actuating device for actuating the air flow regulator in accordance with the amount of a throttle operation. The guide structure is fixed to a cylinder head in a body of the internal combustion engine.

According to the tenth aspect of the invention, since the air flow regulator is moved with respect to the upstream-side opening (intake passage opening) of the intake passage to control the amount of intake air, the intake passage can be shortened to obtain a high output.

Moreover, since the guide structure for guiding the movement of the air flow regulator is fixed to the cylinder head in the body of the internal combustion engine, even if the guide structure is a simple and light-weight guide structure, the movement position accuracy of the intake air control valve relative to the intake passage opening can be easily ensured high against disturbance such as pulsation of the vacuum.

In an eleventh aspect of the invention there is provided, in combination with the tenth aspect of the invention, an intake flow control apparatus for an internal combustion engine which includes a return spring in the guide structure which urges the air flow regulator in a direction to close the upstream-side opening of the intake passage.

According to the eleventh aspect of the invention, since there is used a return spring which urges the air flow regulator in a direction to close the intake passage opening, a reference position of the air flow regulator in the absence of a throttle operation can be kept constant.

When the air flow regulator comes into abutment against the intake passage opening, since the air flow regulator is urged by the return spring, it is possible to diminish vibration of the air flow regulator even if pulsation of the vacuum acts on the air flow regulator.

Further, since the return spring is provided in the guide structure, no special member for supporting the return spring is needed, whereby the number of parts is reduced and it is possible to attain the reduction of weight in the apparatus.

In a twelfth aspect of the invention, there is provided, in combination with the tenth aspect of the invention, an intake flow control apparatus for an internal combustion engine in which the guide structure includes a holder provided projecting on the cylinder head and an injection cylinder of a casing of a fuel injector. The injection cylinder is projected in the intake axis direction so as to face the upstream-side opening of the intake passage, and the projection cylinder extends through the air flow regulator and guides the air flow regulator movably in the intake axis direction.

According to the twelfth aspect of the invention, the guide structure includes a holder provided projecting on the cylinder head and an injection cylinder of a casing of a fuel injector which held by the holder, and the injection cylinder extends through the air flow regulator and guides the same valve movably in the intake axis direction. Thus, the air flow regulator is guided by the injection cylinder of the highly rigid casing of the fuel injector which is fixed firmly by a stay portion, whereby the movement position accuracy of the air flow regulator relative to t he intake passage opening is ensured high. In addition, since the guide structure also holds the fuel injector, it is possible to reduce the number of parts and weight and attain the simplification of the overall structure.

In a thirteenth aspect of the invention there is provided an intake flow control apparatus for an internal combustion engine which includes an intake passage for introducing intake air into a combustion chamber of the internal combustion engine and an air flow regulator opposed to an upstream-side opening of the intake passage and adapted to move in an intake axis direction to control the amount of intake air fed into the combustion chamber. The intake passage also includes a valve actuating device for actuating the air flow regulator in accordance with the amount of a throttle operation. The air flow regulator includes a plurality of valve elements different in operation timing, and the valve actuating device actuates the plural valve elements successively in accordance with the amount of a throttle operation to control the amount of intake air required in an operation region of the internal combustion engine.

According to the thirteenth aspect of the invention, since the air flow regulator moves in opposition to an upstream-side of the intake passage opening of the intake passage to control the amount of intake air, it is possible to shorten the intake passage and obtain a high output.

Further, the air flow regulator includes a plurality of valve elements different in operation timing. Therefore, by making the plural valve elements have required valve opening characteristics different from each other, a required intake air quantity characteristic relative to the amount of a throttle operation can be easily set even by manual operation or by a simple operation control using a motor or the like.

In a fourteenth aspect of the invention there is provided, in combination with the thirteenth aspect of the invention, an air flow regulator that includes a first control valve element adapted to open in an initial opening stage and a second control valve element adapted to open after the initial opening stage, and the area of an intake passage opening upon opening of the first control valve element is smaller than that upon opening of the second control valve element.

According to the fourteenth aspect of the invention, since the area of an intake passage opening upon opening of the first control valve element which opens in the initial opening stage is smaller than that upon opening of the second control valve element which opens after the initial opening stage, the amount of intake air can be controlled precisely by the first control valve element smaller in the area of the intake passage opening in a low revolution state of the internal combustion engine, i.e., in a low valve angle region, for example at the time of starting of the vehicle. Consequently, the output of the internal combustion engine relative to the amount of a throttle operation at the time of starting of the engine can be controlled precisely and it is possible to meet a request for acceleration according to conditions.

In a fifteenth aspect of the invention there is provided, in combination with the fourteenth aspect of the invention, an intake flow control apparatus for an internal combustion engine which further includes a coordinated motion mechanism. The operation of the valve actuating device acts on the first control valve element to move the first control valve element in its opening direction, and when the movement of the first control valve element exceeds a predetermined distance, it acts on the second control valve element and causes the second control valve element to move in its opening direction.

According to the fifteenth aspect of the invention a coordinated motion mechanism is used. When the movement of the first control valve element exceeds a predetermined distance, it acts on the second control valve element and causes the second control valve element to move in its opening direction. Therefore, by setting the predetermined movement distance of the first control valve element, which determines a coordinated motion time to a required distance, a required intake air quantity characteristic relative to the amount of a throttle operation can be set easily by a simple construction.

In a sixteenth aspect of the invention there is provided, in combination with the fourteenth or fifteenth aspects of the invention, an intake flow control apparatus for an internal combustion engine in which the first control valve element is disposed so that it can open and close an air passage formed in the second control valve element.

According the sixteenth aspect of the invention, since the first control valve element is disposed so that it can open and close an opening of an air passage formed in the second control valve element, the movement of the first control valve element with respect to the air passage in an abutted state of the second control valve element against the intake passage opening controls the amount of intake air, and the second control valve element moves together with the first control valve element with respect to the intake passage opening to control the amount of intake air. Thus, the valve opening characteristic can be changed successively.

In a seventeenth aspect of the invention there is provided, in combination with the thirteenth through sixteenth aspects of the invention, a fuel injector that is fixed to a body side of the internal combustion engine, in which a casing of the fuel injector guides and moves the air flow regulator in the intake axis direction.

According to the seventeenth aspect of the invention, since the casing of the fuel injector, fixed to the body of the internal combustion engine, guides and moves the air flow regulator in the intake axis direction, it is not necessary to use any special guide member and hence the number of parts can be reduced.

Moreover, the guide member is required to have a high strength due to the influence of a negative pressure, but by using as the guide member the casing of the fuel injector which is high in rigidity, it is possible to attain the reduction of weight in comparison with the use of another guide member.

In an eighteenth aspect of the invention there is provided, in combination with any of the thirteenth through sixteenth aspects of the invention, an intake flow control apparatus for an internal combustion engine wherein a fuel injector is provided on an outer periphery of the intake passage in a body of the internal combustion engine.

According to the eighteenth aspect of the invention, since the fuel injector is provided on the outer periphery of the intake passage in the body of the internal combustion engine, it is not necessary to provide the fuel injector in the air flow regulator, whereby not only the structure of the air flow regulator itself can be simplified, but also the intake resistance is diminished and it is possible to obtain a high output.

Modes for carrying out the present invention are explained below by reference to an embodiment of the present invention shown in the attached drawings. The above-mentioned objects, other objects, characteristics and advantages of the present invention will become apparent form the detailed description of the embodiment of the invention presented below in conjunction with the attached drawings.

BRIEF DESCRIPTION OF THE DRAWINGS

FIG. 21 is an exploded perspective view of the air flow regulator of the tenth embodiment.

FIG. 22 is a graph showing comparative throttle angle characteristics of two different air flow regulators versus an ideal characteristic curve.

DETAILED DESCRIPTION

A number of selected illustrative embodiments of the invention will now be described in some detail, with reference to the drawings. It should be understood that only structures considered necessary for clarifying the present invention are described herein. Other conventional structures, and those of ancillary and auxiliary components of the system, will be known and understood by those skilled in the pertinent art.

A first embodiment of the present invention will be described below with reference to FIGS. 1 to 4. An internal combustion engine 1 related to this embodiment is a four-stroke cycle DOHC (Double Over Head Camshaft) type internal combustion engine, suitable to be mounted on a motorcycle.

Figure 1:
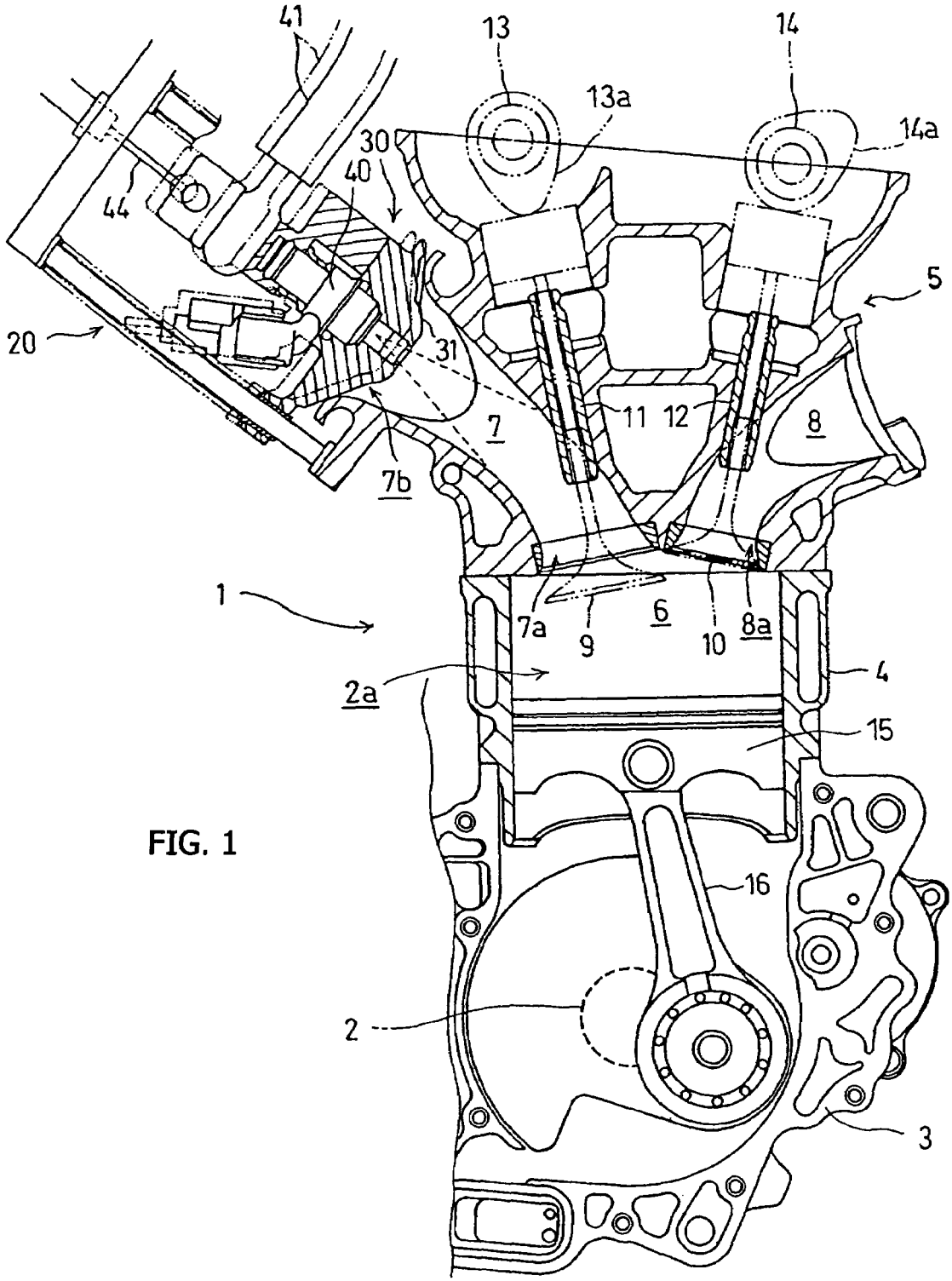
FIG. 1 is a sectional view of an internal combustion engine according to a first embodiment of the present invention.

FIG. 1 is a partial sectional view of the internal combustion engine 1, taken along a vertically extending plane. In the figure, a cylinder block 4 and a cylinder head 5 are superimposed one on the other in this order, and are combined with a crank case 3 in which a crankshaft 2 is rotatably mounted. A piston 15 is adapted to reciprocally slide within a cylinder bore 2*a* of the cylinder block 4. The piston 15 is connected through a connecting rod 16 to a crank pin 2*a* of the crankshaft 2, whereby the reciprocating motion of the piston 15 is converted to rotation of the crankshaft 2.

A combustion chamber 6 is formed in the cylinder head 5 above the piston 15, The cylinder head 5 is integrally superimposed on the cylinder block 4, as noted above. An intake port 7*a* and an exhaust port 8*a* are open to the upper surface of the combustion chamber 6. An intake passage 7 is formed in the cylinder head 5 so as to extend outwards from the intake port 7*a*, while an exhaust passage 8 is formed in the cylinder head so as to extend outwards from the exhaust port 8*a*.

A valve stem of an intake valve 9 for opening and closing the intake port 7*a*, and a valve stem of an exhaust valve 10 for opening and closing the exhaust port 8 are slidably supported by valve guides 11 and 12, respectively. During engine operation, the upper ends of the valve stems, which are urged upwards by springs, are selectively pushed downwardly by cam lobes 13*a* and 14*a* of an intake camshaft 13 and an exhaust camshaft 14, respectively, to actuate the valves 9 and 10, thereby opening and closing the valves to effect intake and exhaust of air at predetermined timings.

Figure 2:
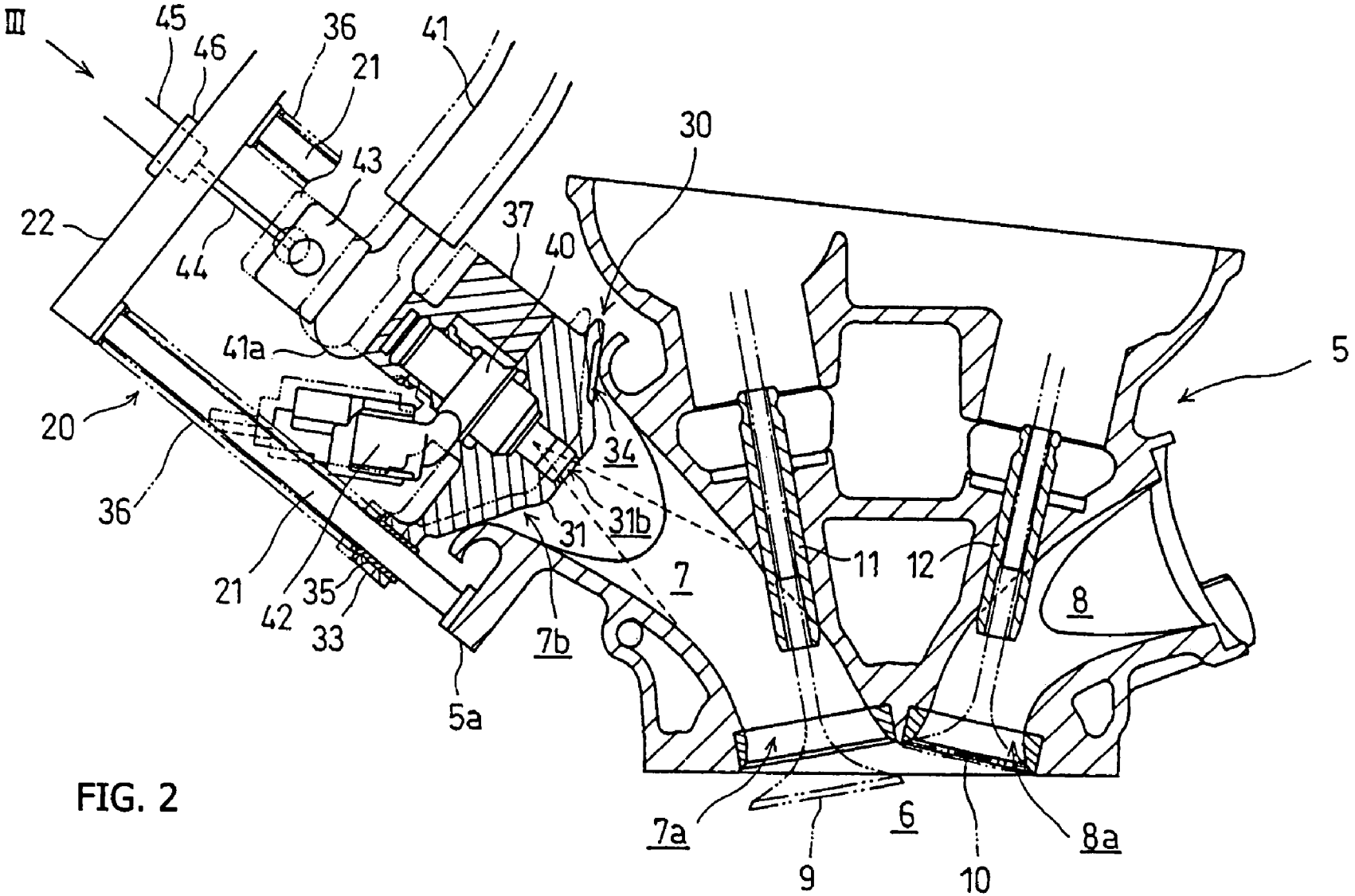
FIG. 2 is a sectional detail view of a principal portion of an intake flow control apparatus and a cylinder head.
Figure 3:
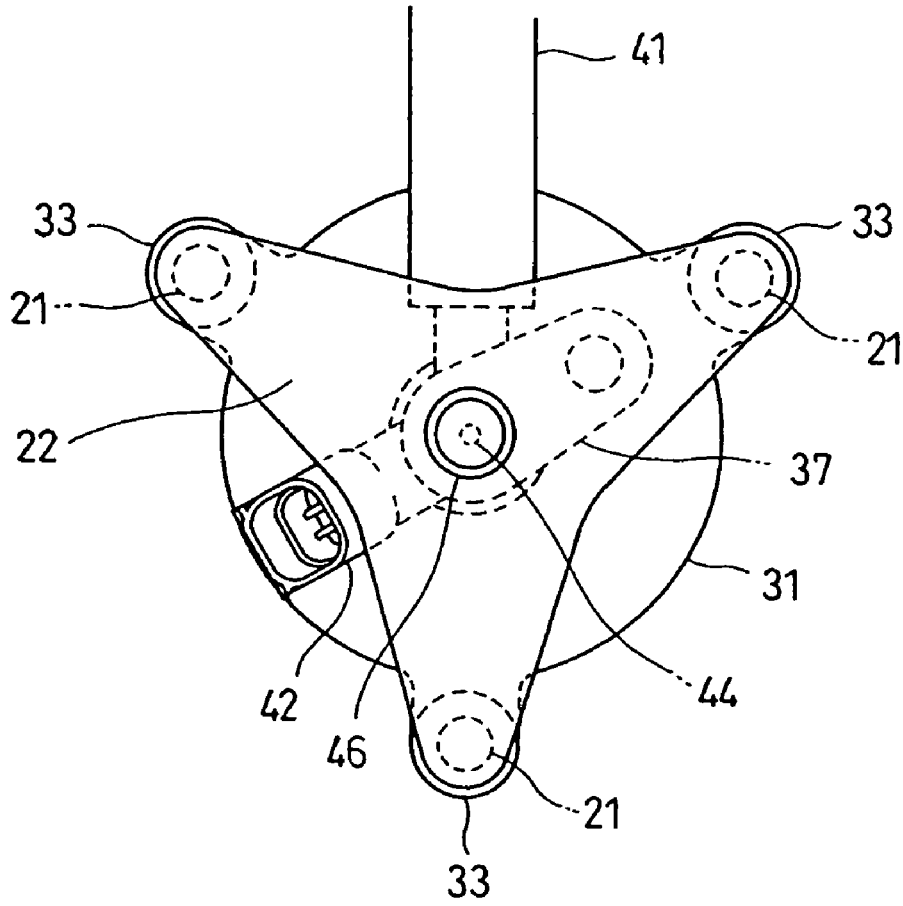
FIG. 3 is a detail view of an air flow regulator apparatus, as seen in the direction of arrow III in FIG. 2.

With reference to FIG. 2, an upstream end of the intake passage 7 in the cylinder head 5 expands and projects to form a funnel-like shape. The upstream end of the intake passage 7 is open to the exterior, with a guide structure 20 being operatively attached to the cylinder head 5 proximate an opening 7*b* of the intake passage.

Mounting bosses 5*a* are integrally formed on an outer surface of the cylinder head 5 at three positions around the intake passage opening 7*b*. The guide structure 20 includes three guide rods 21, and respective base ends of these guide rods 21 are threadably engaged with, and attached to the cylinder head 5 at each of the respective mounting bosses 5*a*, in a manner so that the guide rods are parallel to one another. Upper ends of the three parallel guide rods 21 are fixed, respectively, to end portions of three arms of an upper plate 22 of the guide structure 20. As seen best in FIG. 3, the upper plate 22 is made in a modified triangular shape having concave sides, with the arms extending radially in three directions from the center thereof, spaced about 120 degrees apart. The upper plate 22 is mounted bridgewise in opposition to the intake passage opening 7*b* to constitute the guide structure 20 (see FIGS. 2 and 3).

Figure 4:
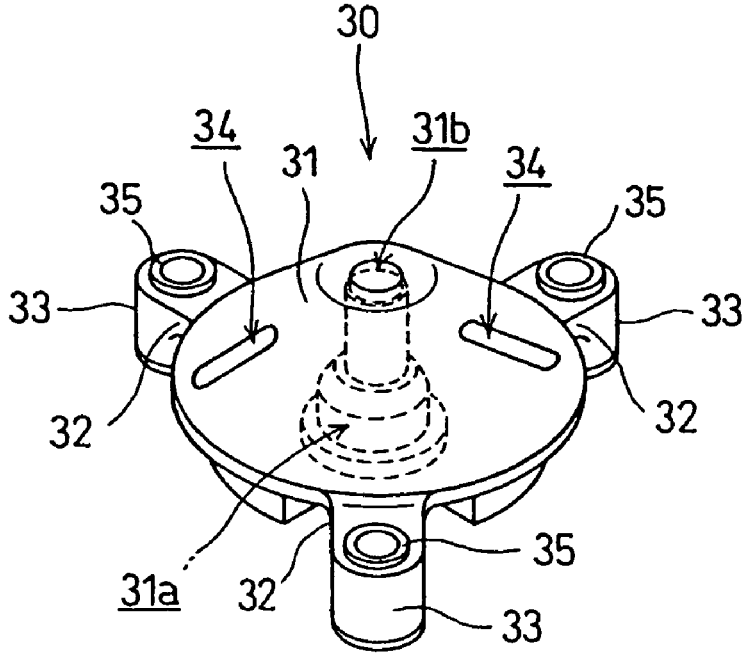
FIG. 4 is a perspective view of a sealing component of the air flow regulator of FIG. 3.

An intake air flow regulator 30 is provided to control air flow through the intake passage 7, and this air flow regulator is slidably supported at three points by the three guide rods 21 of the guide structure 20. Taken together, the intake air flow regulator 30 and associated guide structure 20 take the place of a throttle body (not shown) of a conventional intake system. In the intake air flow regulator 30, as shown in FIG. 4, three arms 32 project radially from a back side of a valve element 31 which forms a cone with a flattened tip. Each of the arms 32 includes a cylindrical portion 33 having a hollow bore formed therethrough with an axis parallel to the axis of the conical valve element 31.

An insertion hole 31*a* is formed along the axis of the valve element 31, for insertion therein of a fuel injector 40. The tip of the cone of the valve element 31 is removed to provide a plane, and an injection orifice 31*b* is formed centrally of the plane. Two grooves 34 are formed along the conical surface of the valve element 31.

Slide sleeves 35 are fitted within the hollow bores in the arms 32 along the inner peripheries of the three cylindrical portions 33, respectively, of the intake air flow regulator 30 constructed as above. The three guide rods 21 of the guide structure 20 are inserted respectively through the slide sleeves 35 to slidably support the intake air flow regulator 30.

Since the valve element 31 of the intake air flow regulator 30 is thus slidably supported by the guide rods 21, the valve element 31 is positively supported in its movement direction and can move smoothly. The upper plate 22 of the guide structure 20 is in the shape of a deformed regular triangle having concave sides, whereby it is possible to compatibly balance the reduction of weight and required rigidity.

It will therefore be understood that the intake air flow regulator 30 is movably supported in the intake axis direction while being guided by the three guide rods 21 of the guide structure 20, in a state in which the conical surface of the valve element 31 is opposed to the intake passage opening 7*b*, and the axis of the valve element 31 is aligned with the intake axis of the intake passage 7.

Since the guide structure 20 for guiding movement of the intake air flow regulator 30 is affixed to the cylinder head 5 in the body of the internal combustion engine 1, it is possible to easily ensure the accuracy of a moving position of the intake air flow regulator 30 relative to the intake passage opening 7*b* against disturbance such as pulsation of the vacuum, even in the case where the guide structure 20 is a simple and light-weight structure.

Return springs 36 are wound round the three guide rods 21, and are interposed between the cylindrical portions 33, projecting from the valve element 31, and the upper plate 22. The return springs 36 urge the valve element 31 in a direction of contact with the intake passage opening 7*b*, i.e., in a direction to close the intake passage 7.

In the case where the valve element 31 of the intake air flow regulator 30 comes into abutment against the intake passage opening 7*b*, since the valve element 31 is urged by the return springs 36, it is possible to diminish vibration of the intake air flow regulator 30, even if the pulsation of the vacuum acts on the valve element 31.

Further, since the return springs 36 are provided in the guide structure 20, special additional structure for supporting the return springs 36 is not needed, and it is therefore possible to reduce the number of parts and the overall weight of the assembly.

Although the upstream side of the intake passage 7 leading to the intake passage opening 7*b* is shown formed integrally with the cylinder head 5 in the drawings, it may alternatively be formed as a separate air funnel. In this case, even if the guide structure is mounted to any other portion than the opening end portion of the air funnel, required mounting accuracy can be maintained because a sufficient rigidity is ensured.

When the valve element 31 of the intake air flow regulator 30 comes into abutment against the intake passage opening 7*b*, the conical surface of the valve element 31 comes into linear contact with the curved inner peripheral surface of the intake passage opening 7*b*, to substantially fully close the intake passage 7. However, since the grooves 34 formed in the conical surface of the valve element 31 serve as air bypass passages, providing fluid communication between the interior and the exterior of the intake passage 7, it is possible to reduce the negative pressure in the intake passage 7.

A working tip portion of the fuel injector 40 is inserted into the insertion hole 31*a* in the back of the valve element 31 of the intake air flow regulator 30, so that a fuel injection nozzle faces the injection orifice 31*b* of the valve element 31. A rear end portion of the fuel injector 40 is held by a holder 37 which is provided projectingly on the back side of the valve element 31 (FIGS. 2-3), so that the fuel injector 40 is movable together with the valve element 31.

A connecting tip portion 41*a* of a fuel supply pipe 41 is connected to a rear end portion of the fuel injector 40, and an electric wire connector socket 42 projects from a central portion of the fuel injector 40.

An end portion of a wire guide 45, which may be a Bowden cable, is fixed to a central portion of the upper plate 22 by use of a metallic fixing piece 46. A throttle wire 44, which is guided by the wire guide 45, extends through the upper plate 22, and a front end thereof is engaged with a retaining member 43, which is for fixing the connecting portion 41*a* of the fuel supply pipe 41 to the rear end portion of the fuel injector 40. The opposite end of the throttle wire 44 is connected to an accelerator grip (not shown) which is operated by the driver.

Since the intake flow control apparatus in the internal combustion engine 1 according to this embodiment is constructed as above and has the intake air flow regulator 30 which is adapted to move in the intake axis direction in opposition to the upstream-side opening of the intake passage 7, the intake passage is shortened and therefore it is possible to obtain a high output and reduce the air flow resistance.

When the internal combustion engine 1 is in a low revolution state, for example when the vehicle starts or during idling, the intake air flow regulator 30 is urged by the return springs 36 toward the intake opening 7*b*, and its valve element 31 is put in abutment against the intake passage opening 7*b* to substantially close the intake passage 7 (the state indicated by a solid line in FIG. 2). A separate idle air control valve (not shown) may optionally be used, if desired, to separately feed enough air to the engine to prevent stalling thereof, when the air flow regulator 30 is placed in close abutment against the intake opening 7*b*.

Since a high negative pressure (high vacuum) is created in the interior of the intake passage 7 with the valve element 31, the valve element 31 is pulled tightly against the intake passage opening 7*b*. If the intake passage opening 7*b* is closed completely, it becomes difficult to move the valve element 31 in its opening direction. In this intake flow control apparatus, however, since the grooves 34, formed in the conical surface of the valve element 31, serve as air bypass passages, providing communication between the interior and the exterior of the intake passage 7, it is possible to reduce the negative pressure (vacuum) in the intake passage 7, and to correspondingly reduce the amount of force required for movement of the valve element 31.

Therefore, when the throttle wire 44 is pulled by a manual operation of the accelerator, the intake air flow regulator 30 moves smoothly in the intake axis direction even with a small force, whereby the intake passage 7 can be opened. Thereafter, the amount of movement can be adjusted easily to control the degree of opening of the valve in accordance with the amount of a throttle operation. Thus, the amount of intake air can be controlled in an easy and accurate manner.

In a low revolution state (idling condition), since the valve element 31 of the intake air flow regulator 30 is urged by the return springs 36 and is put in abutment against the intake passage opening 7*b*, it is easy to minimize any disturbance which occurs upon exertion of intake pulsation or the like on the valve element 31. The formation of a passage corresponding to only a desired negative pressure to be reduced is easy, because all that is required is merely setting the shape and number of the grooves 34 which serve as air bypass passages.

The fuel injector 40 is fixed to, and moves together with the valve element 31 of the intake air flow regulator 30. In a high rotary speed condition of the internal combustion engine, therefore, the distance from the fuel injection orifice (the injection orifice 31*b* of the valve element 31) of the fuel injector 40 to the intake port 7*a* becomes longer when the valve element 31 is spaced at a maximum distance away from the intake passage opening 7*b* and is fully open, whereby it is possible to improve the fuel atomizing characteristic.

On the other hand, in a low revolution (idling) state of the internal combustion engine, the distance from the fuel injection orifice of the fuel injector 40 to the intake port 7*a* becomes shorter when the valve element 31 of the intake air flow regulator 30 is fully closed in abutment against the intake passage opening 7*b*, whereby it is possible to improve the fuel supply responsiveness.

Figure 5:
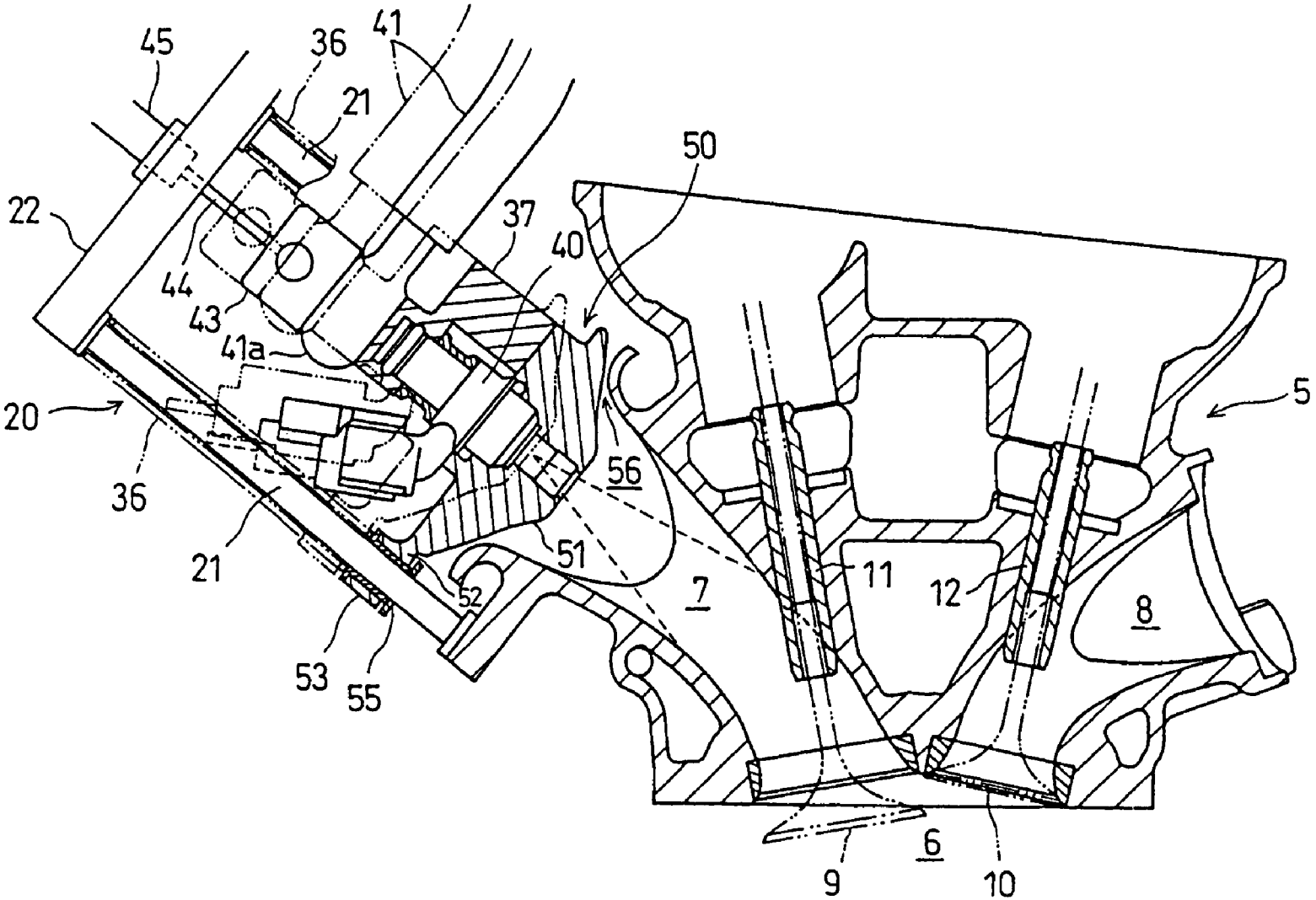
FIG. 5 is a sectional detail view of principal portions of an intake flow control apparatus and a cylinder head according to a second embodiment of the present invention.

Next, a second embodiment of the present invention, which is illustrated in FIG. 5, will be described below.

The second embodiment is a modification of the above-described first embodiment. In the first embodiment, when the valve element 31 of the intake air flow regulator 30 comes into abutment against the intake passage opening 7*b*, the grooves 34 formed in the conical surface of the valve element 31 serve as air bypass passages to reduce the negative pressure in the intake passage 7. On the other hand, in the second embodiment, an air bypass passage is constituted by restricting movement of the valve element of the air flow regulator.

The intake flow control apparatus of this second embodiment is constituted by the same members as in the first embodiment except that grooves are not formed in a conical surface of a valve element 51 of an air flow regulator 50. The same members as in the first embodiment are identified by the same reference numerals as in the first embodiment.

Stoppers 55 are fixed to predetermined positions of the three guide rods 21, which are for guiding the valve element 51 of the air flow regulator 50. The stoppers 55 inhibit movement of the valve element 51 in the vicinity of the intake passage opening 7*b*.

FIG. 5 shows a state in which slide sleeves 35 fitted in cylindrical portions 53 at distal ends of arms 52 extending radially from the valve element 51 are in abutment against the stoppers 55 to inhibit movement of the valve element 51. In this state, a gap 56 is formed between the valve element 51 and the intake passage opening 7*b*, which serves as an air bypass passage providing communication between the interior and the exterior of the intake passage 7, whereby the vacuum is reduced, and subsequent outward movement of the valve element 51 is thereby made easy.

The formation of a passage that permits only a desired negative pressure to be reduced is easy in this embodiment, because all that is required is merely setting positions of the stoppers 55 to be fixed on the guide rods 21.

Next, a third embodiment of the present invention will be described below with reference to FIG. 6.

Substantially the same members as in the first embodiment are used except the drive mechanism for moving the air flow regulator and the valve element of the air flow regulator. The same members as in the first embodiment are identified by the same reference numerals as in the first embodiment.

In a valve element 61 of an air flow regulator 60 used in this embodiment, grooves are not formed in a conical surface of the valve element, but instead, a communication hole 62 is formed through the valve element 61, to provide communication between the conical surface side and the back side thereof. The communication hole 62 extends through the valve element 61 in a direction substantially parallel to the axis thereof. The communication hole 62 is used as an air bypass passage, which provides communication between the interior and the exterior of the intake passage 7.

Further in this embodiment, a pressure conduit 63 of an intake pressure sensor extends through the valve element 61 from the back side to the conical surface side thereof, for detecting an intake pressure in the intake passage 7. A terminal opening of the pressure conduit 63 faces into the interior of the intake passage 7.

Thus, since the pressure conduit 63 of the intake pressure sensor is provided in the valve body 61, any special air passage for detecting the intake pressure need not be formed on the outer periphery of the intake passage 7. That is, in the vicinity of the combustion chamber 6 there is nothing that disturbs the flow of the air-fuel mixture, nor does the intake pressure sensor obstruct shortening of the intake passage, so that not only it is possible to obtain a high output, but also the internal combustion engine can be made compact.

Figure 6:
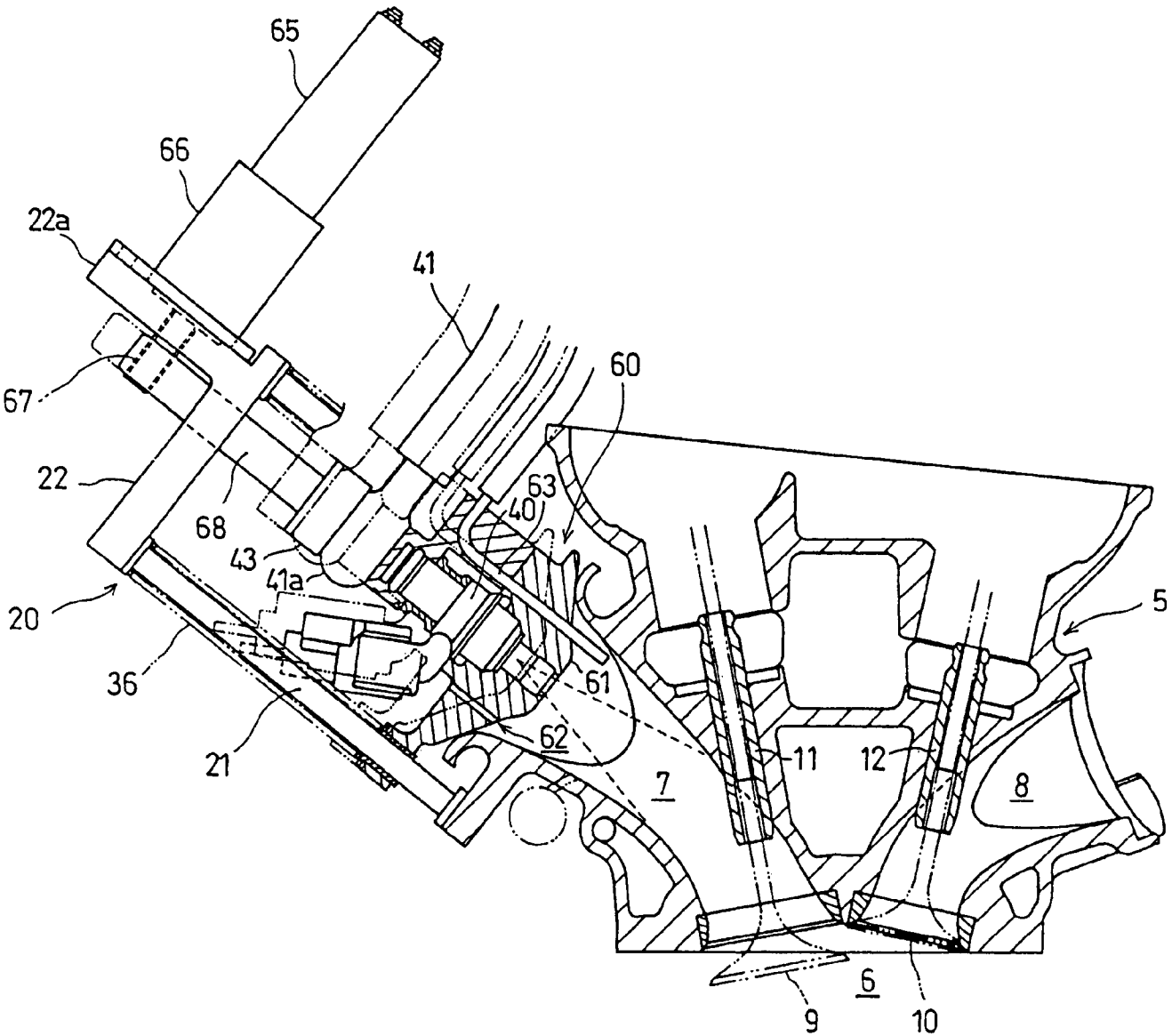
FIG. 6 is a sectional detail view of principal portions of an intake flow control apparatus and a cylinder head according to a third embodiment of the present invention.

In the embodiment of FIG. 6, a motor and a rack-pinion mechanism are used as a drive mechanism for guiding and moving the air flow regulator 60, and the fuel injector 40 which is held integrally with the valve 60, through the guide structure 20.

More specifically, in the embodiment of FIG. 6, a motor 65 is fixed through a gear box 66 to a bracket 22*a* of the upper plate 22 in the guide structure 20. A rack 68, meshing with a pinion 67 fitted on a driving output shaft of the motor 65, extends slidably through the upper plate 22, and an end portion thereof is connected to the retaining member 43, which is for fixing the connecting portion 41*a* of the fuel supply pipe 41 to the rear end of the fuel injector 40.

Thus, the rotation of the pinion 67, which is driven by the operation of the motor 65, the output of which has been decelerated through the gear box 66, causes the rack 68, engaged with the pinion 67, to move together with the air flow regulator 60, which is guided by the guide structure 20. It is thereby possible to control a relative position of the valve element 61 with respect to the intake passage opening 7*b*, using the above-described cooperating components.

In a low revolution (idling) state of the internal combustion engine, the valve element 61 of the air flow regulator 60 is abutted against the intake passage opening 7*b* to fully close the intake passage 7. The vacuum (vacuum level) is reduced by the communication hole 62 to ease the movement of the valve element 61, so that the operation of the motor 65 based on a throttle operation causes the pinion 67 to rotate. Consequently, movement of the rack 68 together with the air flow regulator 60 open the intake passage 7, thus reducing the load imposed on the motor 65.

Thus, the use of a high output motor is not needed, and it is possible to prevent an increase in size and weight of the motor. In addition, it is possible to decrease the loss of electric power and reduce the cost of the assembly.

Figure 7:
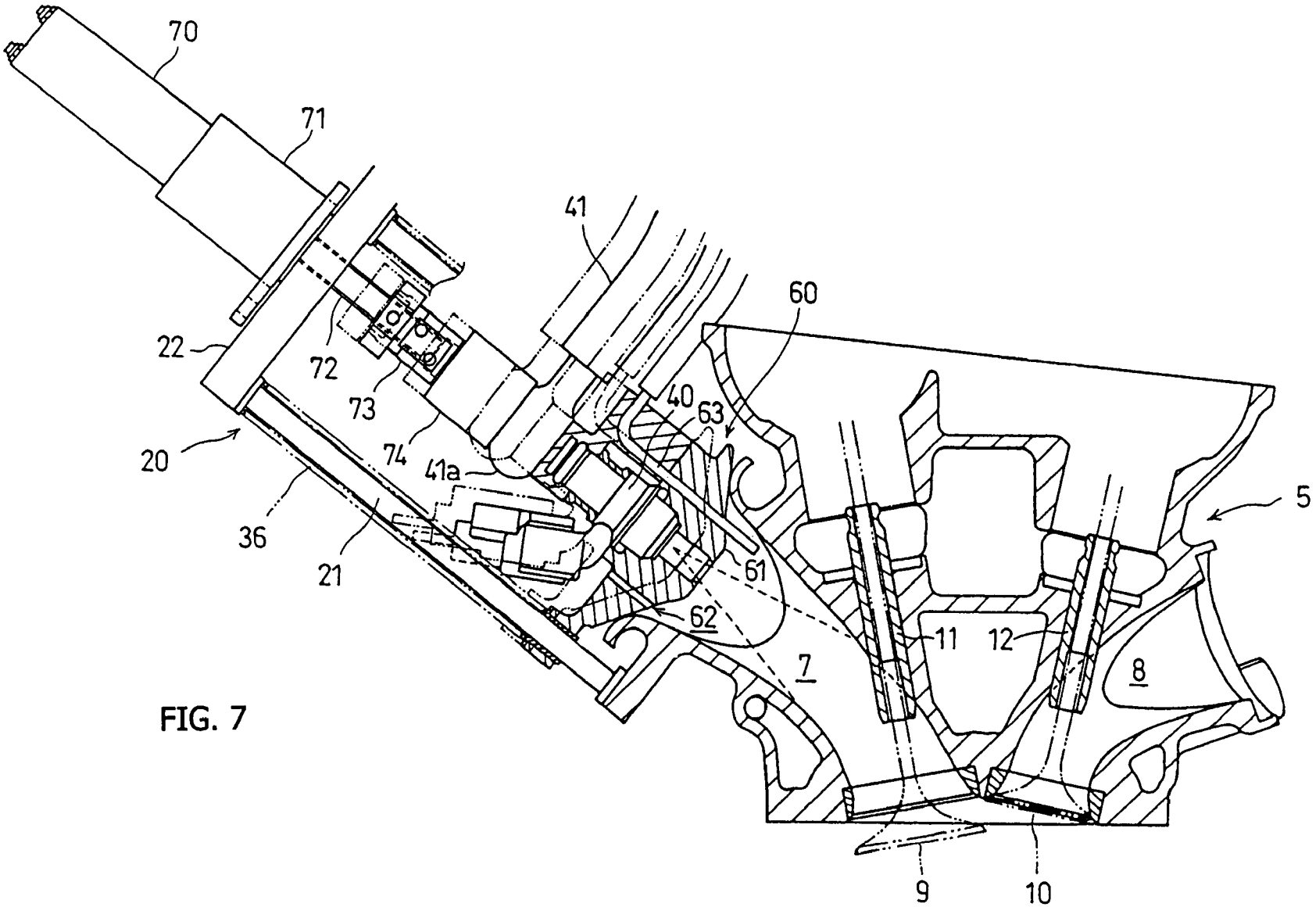
FIG. 7 is a sectional detail view of principal portions of an intake flow control apparatus and a cylinder head according to a fourth embodiment of the present invention.

Now, with reference to FIG. 7, a fourth embodiment of the present invention will be described below in which a ball screw mechanism is used as the drive transfer mechanism, instead of the rack-pinion mechanism used in the above third embodiment.

Since the other members used in the fourth embodiment are the same as in the third embodiment, the same members as in the third embodiment are identified by the same reference numerals as in the third embodiment.

A motor 70 is fixed through a gear box 71 to the upper plate 22 of the guide structure 20, and a screw shaft 72 extended from an output shaft of the motor 70 is projected in alignment with the axis of the air flow regulator 60. Further, a retaining member for fixing the connecting portion 41 a of the fuel supply pipe 41 to the rear end portion of the fuel injector 40 also serves as a screw receiving portion 74, and the screw shaft 72 is threadably engaged through balls with a nut 73 fixed to the screw receiving portion 74.

Consequently, the rotation of the screw shaft 72 which is driven by the motor 70, the output of which has been decelerated through the gear box 71, causes the nut 73, threadably engaged with the screw shaft, to move together with the air flow regulator 60, which is guided by the guide structure 20, whereby it is possible to control a relative position of the valve element 61 relative to the intake passage opening 7*b*.

Also in the fourth embodiment, the vacuum is reduced by the communication hole 62, and the movement of the air flow regulator 60 is accomplished with a light force, so that the load imposed on the motor 70 is diminished and a high output motor is not needed. Thus, not only it is possible to prevent an increase in size and weight of the motor, but also it is possible to decrease the loss of electric power and reduce the cost of the assembly.

In the above embodiments, the upstream side of the intake passage opening 7*b* of the intake passage 7 is an external space and the guide structure 20 and the intake air flow regulator 30 which is guided and supported by the guide structure 20 are located in the external space.

Figure 8:
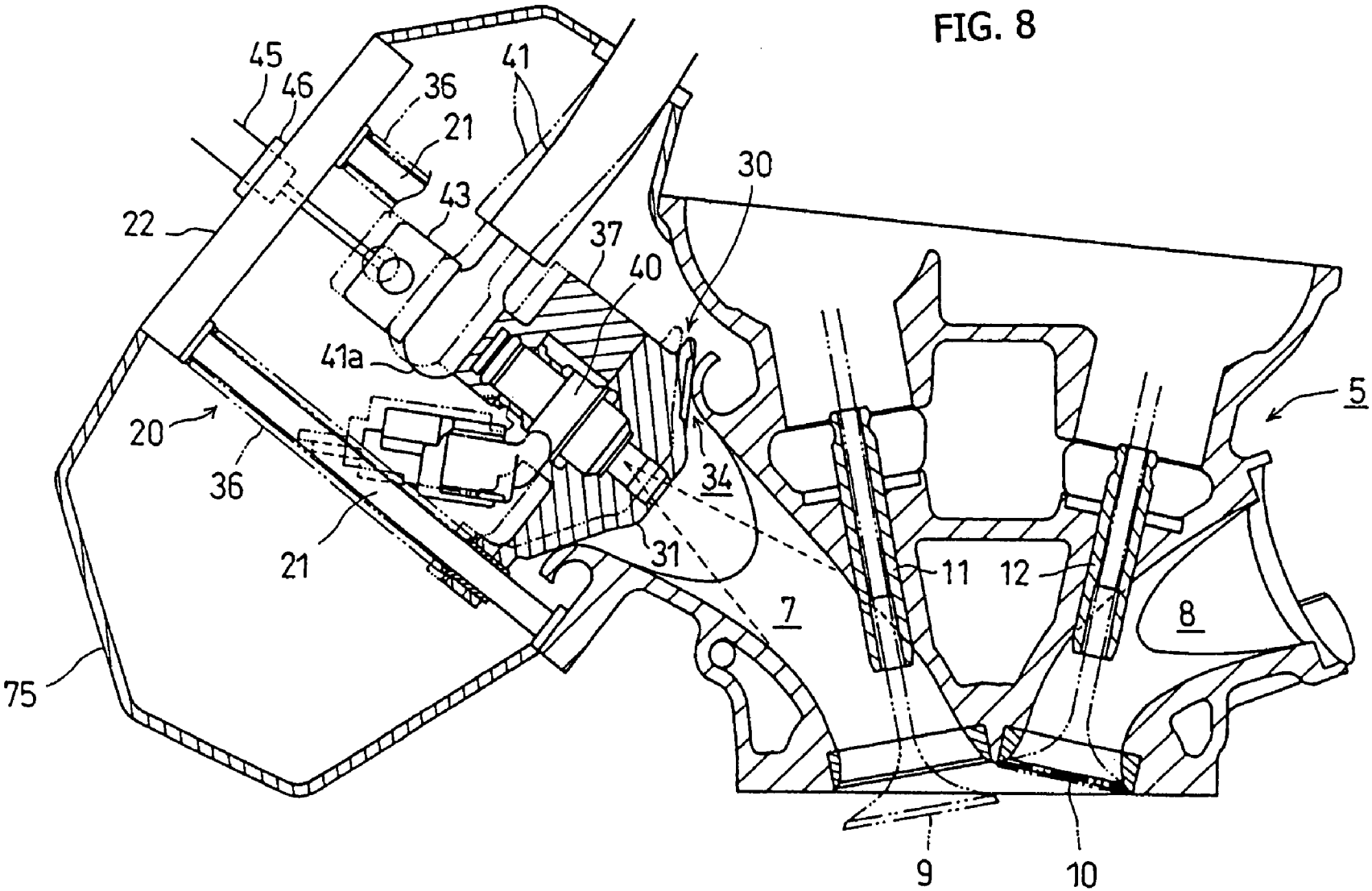
FIG. 8 is a sectional detail view of principal portions of an intake flow control apparatus and a cylinder head according to a fifth embodiment of the present invention.

A fifth embodiment of the present invention, in which they are incorporated in an air cleaner 75, is illustrated in FIG. 8.

In the fifth embodiment all the members other than the air cleaner 75 are the same as in the first embodiment and are identified by the same reference numerals as in the first embodiment.

A casing of the air cleaner 75 utilizes as part thereof the upper plate 22 of the guide structure 20 and covers the intake passage opening 7*b* throughout the whole circumference of the opening. The guide structure 20 and the intake air flow regulator 30 are included on a clean side of the air cleaner.

With the air cleaner 75 in place as described, the entry of dust or the like into the intake passage 7 can be positively prevented.

Figure 9:
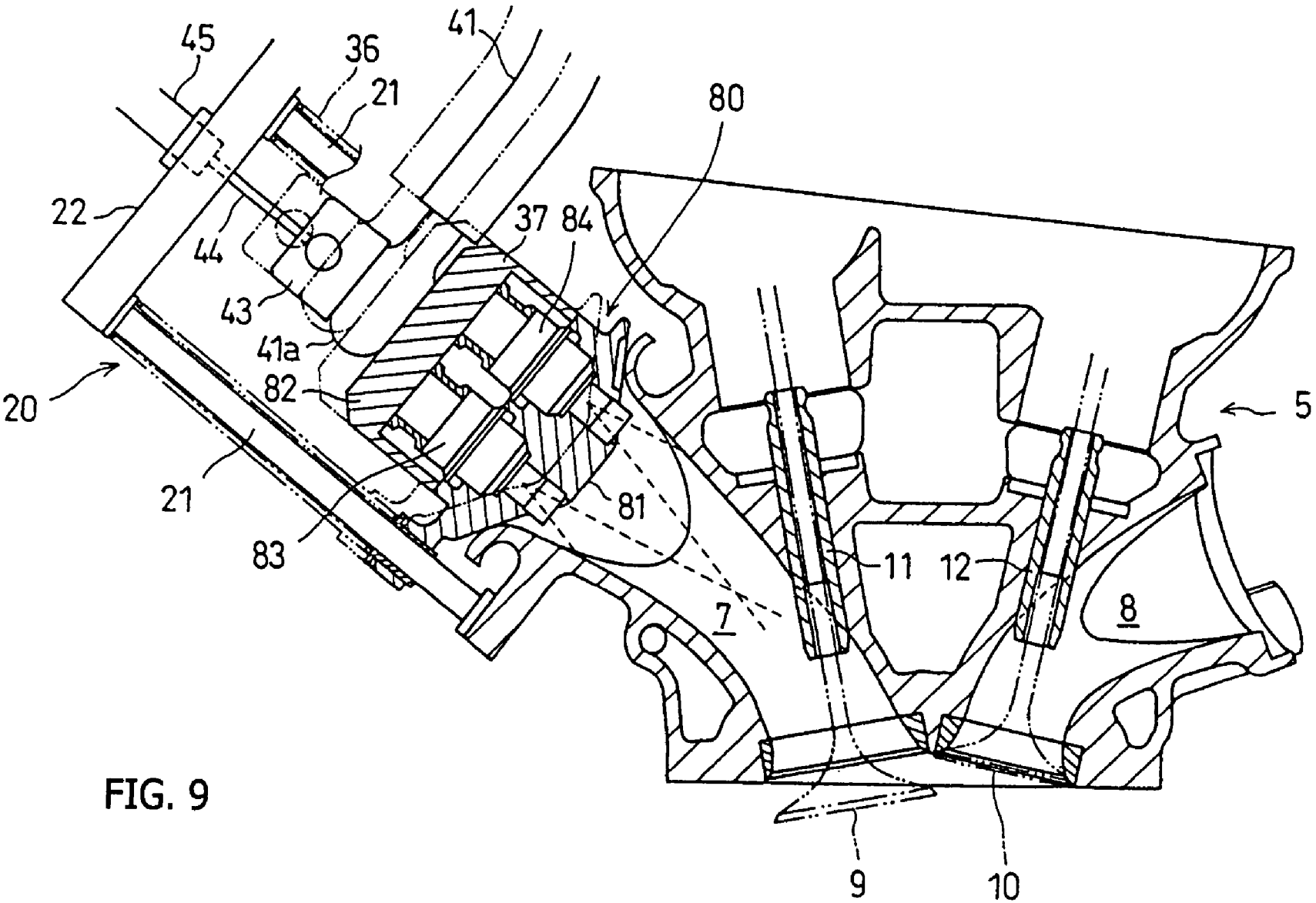
FIG. 9 is a sectional detail view of principal portions of an intake flow control apparatus and a cylinder head according to a sixth embodiment of the present invention.

Next, a sixth embodiment having plural fuel injectors will be described below with reference to FIG. 9.

In this sixth embodiment, a valve element 81 of an air flow regulator 80, together with a holder 82, supports two fuel injectors 83 and 84 integrally. The other structural points in this sixth embodiment are the same as in the first embodiment. The same members as in the first embodiment are identified by the same reference numerals as in the first embodiment.

The fuel supply pipe 41 for the supply of fuel to the two fuel injectors 83 and 84 is a single pipe. Fuel is supplied within the holder 82 in a branched manner to the two fuel injectors 83 and 84. The two fuel injectors are parallel to each other, and their injection orifices face the interior of the intake passage 7.

With the two fuel injectors 83 and 84 thus provided in the air flow regulator 80, fuel can be injected efficiently into the combustion chamber 6, whereby the output of the internal combustion engine can be made high.

Figure 10:
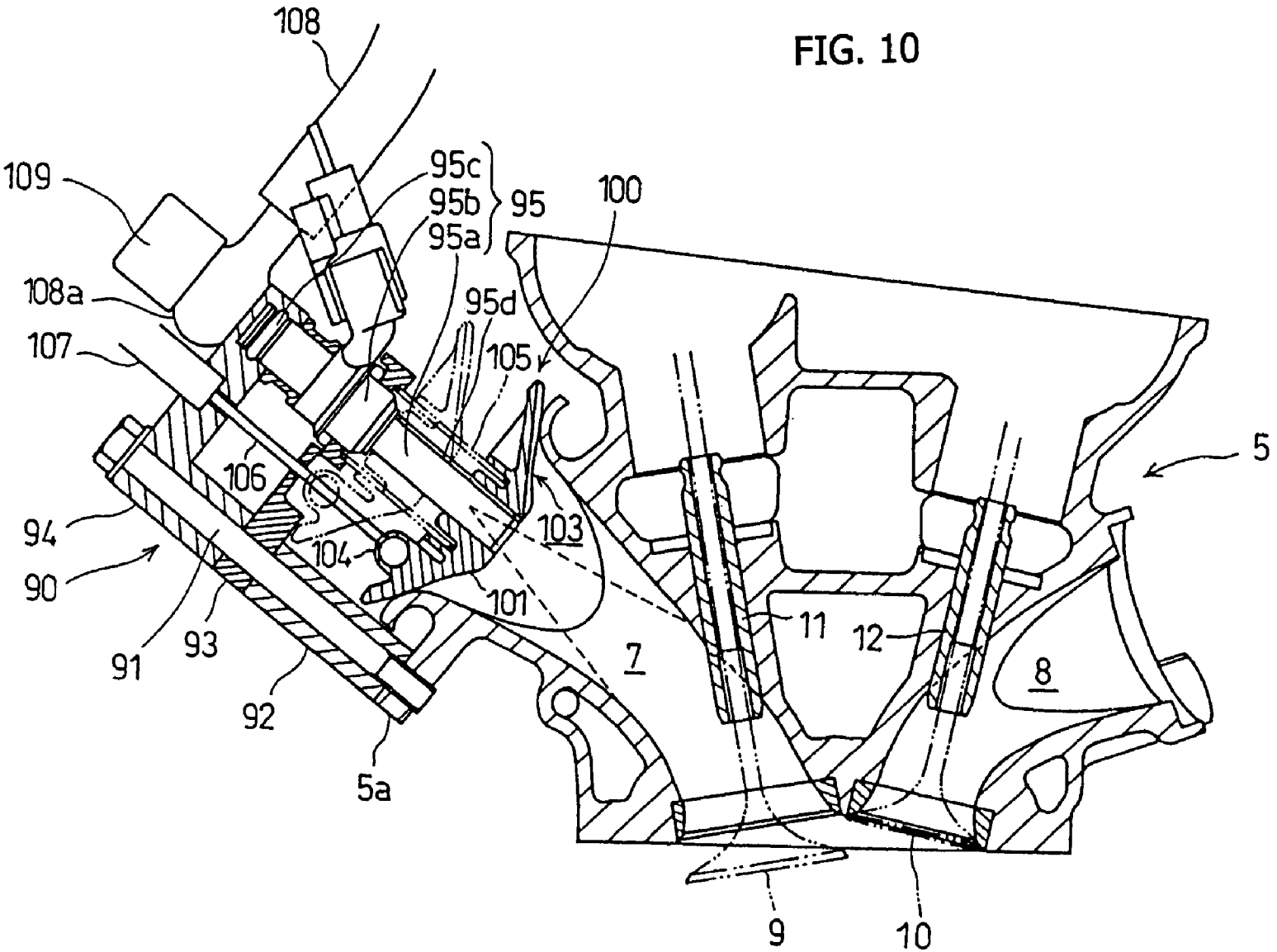
FIG. 10 is a sectional detail view of principal portions of an intake flow control apparatus and a cylinder head according to a seventh embodiment of the present invention.

Next, a seventh embodiment of the present invention will be described below with reference to FIGS. 10 and 11.

The seventh embodiment is different especially in the construction of a guide structure used therein from the previous embodiments. The structure of a cylinder head 5 used therein is the same as in the previous embodiments. In the seventh embodiment, the same members as in the previous embodiments are identified by the same reference numerals as in the previous embodiments.

In a guide structure 90 used in the seventh embodiment, three bolts 91 are threadably engaged with the mounting bosses 5*a* which are formed at three positions on the outer periphery of the cylinder head 5 around the intake passage opening 7*b*, and holders 93 and 94 are supported bridgewise through a spacer 92 by the three bolts 91. Further, a fuel injector 95 is held by the holders 93 and 94 and the guide structure 90 is constituted by the bolts 91, spacer 92, holders 93, 94, and a casing of the fuel injector 95.

The holders 93 and 94 are in the shape of a deformed triangle with arms extending radially in three directions from the center in top view, and end portions of the three arms are fixed respectively to the three bolts 91.

The holder 93 holds a central portion 95*b* of the casing of the fuel injector 95, while the holder 94 holds a rear end portion 95*c* of the casing of the fuel injector 95, and a front portion of the casing with respect to the casing central portion 95*b* projects in a cylindrical shape to form an injection cylinder 95*a*.

A connecting portion 108*a* of a fuel supply pipe 108 is connected to the back side of the holder 94 which holds the rear end portion 95*c* of the casing and is fixed with a retaining member 109. The axis of the injection cylinder 95*a* is coaxial with the intake axis of the intake passage 7. A valve element 101 of an intake air flow regulator 100 is inserted through the injection cylinder 95*a* and is supported movably while being guided by the injection cylinder 95*a*.

Figure 11:
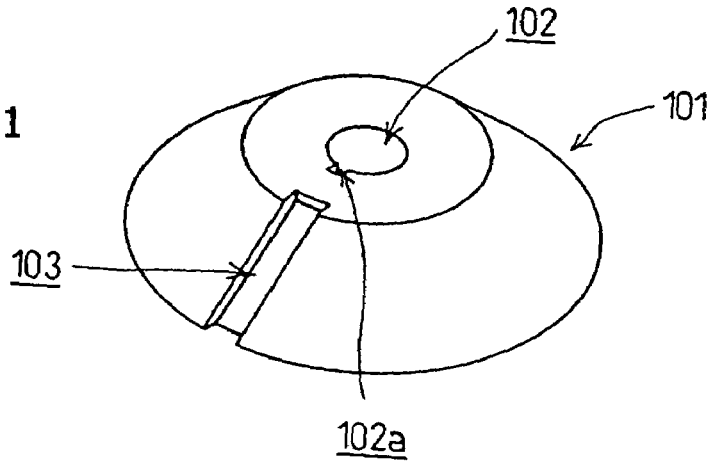
FIG. 11 is a perspective view of a valve seal element of an air flow regulator.

As shown in FIG. 11, the valve element 101 is in the shape of a truncated cone having a flat top, with a circular hole 102 being formed centrally of the top plane extending to the back side of the cone. The circular hole 102 is formed with a key way 102*a* in the axial direction.

The injection cylinder 95*a* of the fuel injector 95 is inserted through the circular hole 102 of the valve element 101 and a ridge portion 95*d* formed axially on the outer periphery portion of the injection cylinder 95*a* is fitted in the key way 102*a* of the circular hole 102, whereby the rotation of the valve element 101 centered on the injection cylinder 95*a* is prevented. Thus, the valve element 101 is movably supported axially by the injection cylinder 95*a* without guided rotation.

The injection cylinder 95*a* of the fuel injector 95 faces the intake passage opening 7*b* along the intake axis of the intake passage 7. A lower end of the injection cylinder 95*a* extends somewhat into the intake passage 7. Therefore, as shown in FIG. 10, the valve element 101 can come into abutment against the intake passage opening 7*b* in a state in which it is inserted through and supported by the injection cylinder 95*a*.

A groove 103 is formed along a generator in a conical surface of the valve element 101, the surface of which comes into abutment against the intake passage opening 7*b*. When the valve element 101 is put in abutment against the intake passage opening 7*b* to close the intake passage 7, the groove 103 serves as an air bypass passage providing communication between the interior and the exterior of the intake passage 7, whereby the negative pressure within the intake passage 7 can be reduced.

A return spring 105 wound round the injection cylinder 95*a* is interposed between the back side of the valve element 101 and the holder 93. The return spring s105 urges the valve element 101 in a direction to close the intake passage opening 7*b*. On the back side of the valve element 101 is formed a retaining portion 104 to which is anchored a front end of a throttle wire 106, adapted to operate with the accelerator grip.

A wire guide 107 of the throttle wire 106 is fixed at a lower end thereof to the holder 94. The throttle wire 106, which extends from the lower end of the wire guide 107, is inserted through the holders 94 and 93 in this order and is anchored to the retaining portion 104 of the valve element 101.

Therefore, when the throttle wire 106 is pulled by the rider's operation of the accelerator grip, the valve element 101 of the air flow regulator 100 is guided by the injection cylinder 95*a* and moves in the valve opening direction against the return spring 105.

Thus, since the valve element 101 of the air flow regulator 100 moves while being guided by the injection cylinder 95*a* which is a highly rigid casing of the fuel injector 95 in the guide structure 90 mounted directly to the cylinder head 5, a movement position accuracy of the valve element 101 is kept high.

Accordingly, the amount of intake air can be controlled with a high accuracy by the air flow regulator 100 in accordance with a throttle operation. Moreover, since the guide structure 90 also supports the fuel injector 95, it is possible to attain the reduction in the number of parts and weight and simplification of the structure.

Since the valve element 101 of the air flow regulator 100 is urged by the return spring 105 into abutment against the intake passage opening 7*b*, it is easy to minimize disturbance caused by exertion of intake pulsation or the like on the valve element 101.

When the valve element 101 comes into abutment against the intake passage opening 7*b*, the groove 103 formed in the conical surface of the valve element 101 provides communication between the interior and the exterior of the intake passage 7, permitting the reduction of the negative pressure in the intake passage 7. Consequently, the movement of the valve element 101 can be made easily, and when the throttle wire 106 is pulled by manual operation of the accelerator grip, the valve element 101 moves smoothly in the intake axis direction while being guided by the injection cylinder 95*a*, even with a small force, whereby the intake passage 7 can be opened. By subsequent adjustment of the amount of the movement which can easily be done, the degree of valve opening can be controlled in accordance with the amount of a throttle operation and thus the amount of intake air can be controlled easily and highly accurately.

Although in the above embodiment, the conical valve element 101 is used in the air flow regulator 100, and the groove 103 is formed as an air bypass passage in the conical surface, the valve element may have any of various other shapes.

Figure 12:
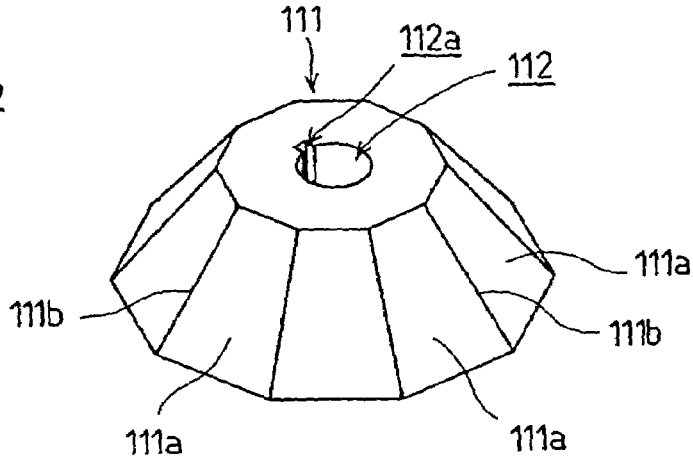
FIG. 12 is a perspective view showing a modified example of a valve seal element of an air flow regulator.

A valve element 111 shown in FIG. 12 is in the shape of a truncated pyramid having a top plane. A circular hole 112 for insertion therethrough of a guide member is formed centrally toward the back side of the valve element 111. A key way 112*a* for the prevention of rotation is formed axially in the circular hole 112.

The pyramidal surfaces of the valve element 111 include a combination of plural planes 111*a*. When the pyramidal surfaces come into abutment against the intake passage opening 7*b*, ridge lines 111*b*, each present between adjacent planes 111*a*, come into contact with the inner peripheral surface of the intake passage opening 7*b* and a gap is formed between the planes 111*a* of the pyramidal surfaces and the inner peripheral surface of the intake passage opening 7*b*. The gap serves as an air bypass passage providing communication between the interior and the exterior of the intake passage 7, whereby the vacuum can be reduced.

Figure 13A:
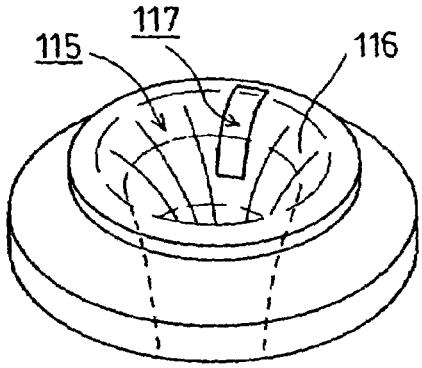
FIG. 13(A) is a perspective view showing another example of an intake passage opening in which a groove is formed on the inner peripheral surface of the intake passage.

When the valve element is in abutment against the intake passage opening to close the same opening, there may be used such vacuum moderating structure as shown in FIG. 13(A) in which a groove 117 is formed in a funnel-like warped inner peripheral surface 116 of an intake passage opening 115, while a valve element 118 may have a groove-free conical surface.

Figure 13B:
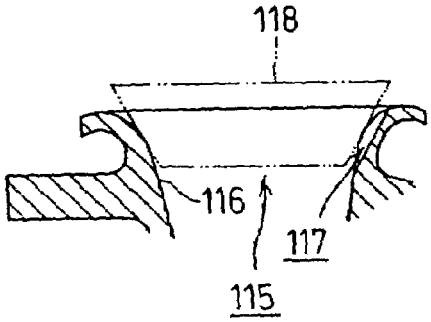
FIG. 13(B) is a side sectional view of the intake passage of FIG. 31(1) showing a valve seal element in phantom within the intake passage, with the groove permitting pressure relief within the intake passage.

As shown in FIG. 13(B), when the valve element 118 comes into abutment against the inner peripheral surface 116 of the intake passage opening 115, the groove 117 formed in the inner peripheral surface 116 serve as an air bypass passage providing communication between the interior and the exterior of the intake passage, whereby the vacuum can be reduced.

Next, an eighth embodiment of the present invention will be described below with reference to FIGS. 14 to 16, in which a fuel injector is provided on the outer periphery of an intake passage. A cylinder head 120 used in an internal combustion engine according to this eighth embodiment has substantially the same shape as the cylinder head 5 used in the previous embodiments including an exhaust passage 124 exclusive of an intake passage 121. That is, the intake passage 121 of the eighth embodiment has a different structure compared to previous embodiments. As to the intake valve 9 and exhaust valve 10, the same reference numerals as in the previous embodiments are used.

An intake passage opening end 122 is located on an upstream side of the intake passage 121 in the cylinder head 120. The opening end 122 has a funnel-like warped inner peripheral surface, and a circumferential surface as an outer periphery surface. An annular passage member 123 is fitted on that outer periphery surface.

Figure 15:
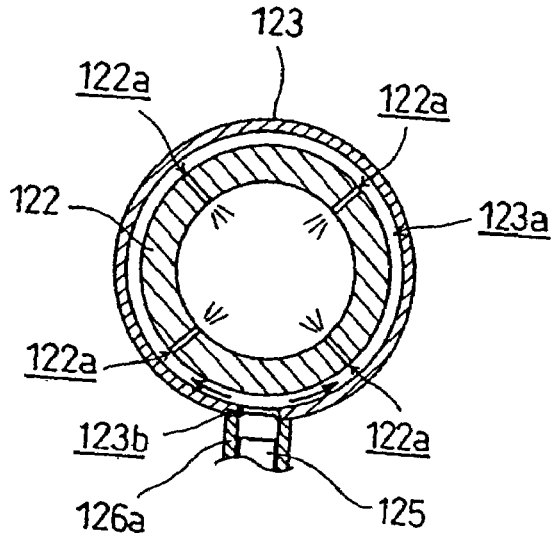
FIG. 15 is a sectional detail view of the apparatus of FIG. 14, taken along the line XV-XV therein.
Figure 14:
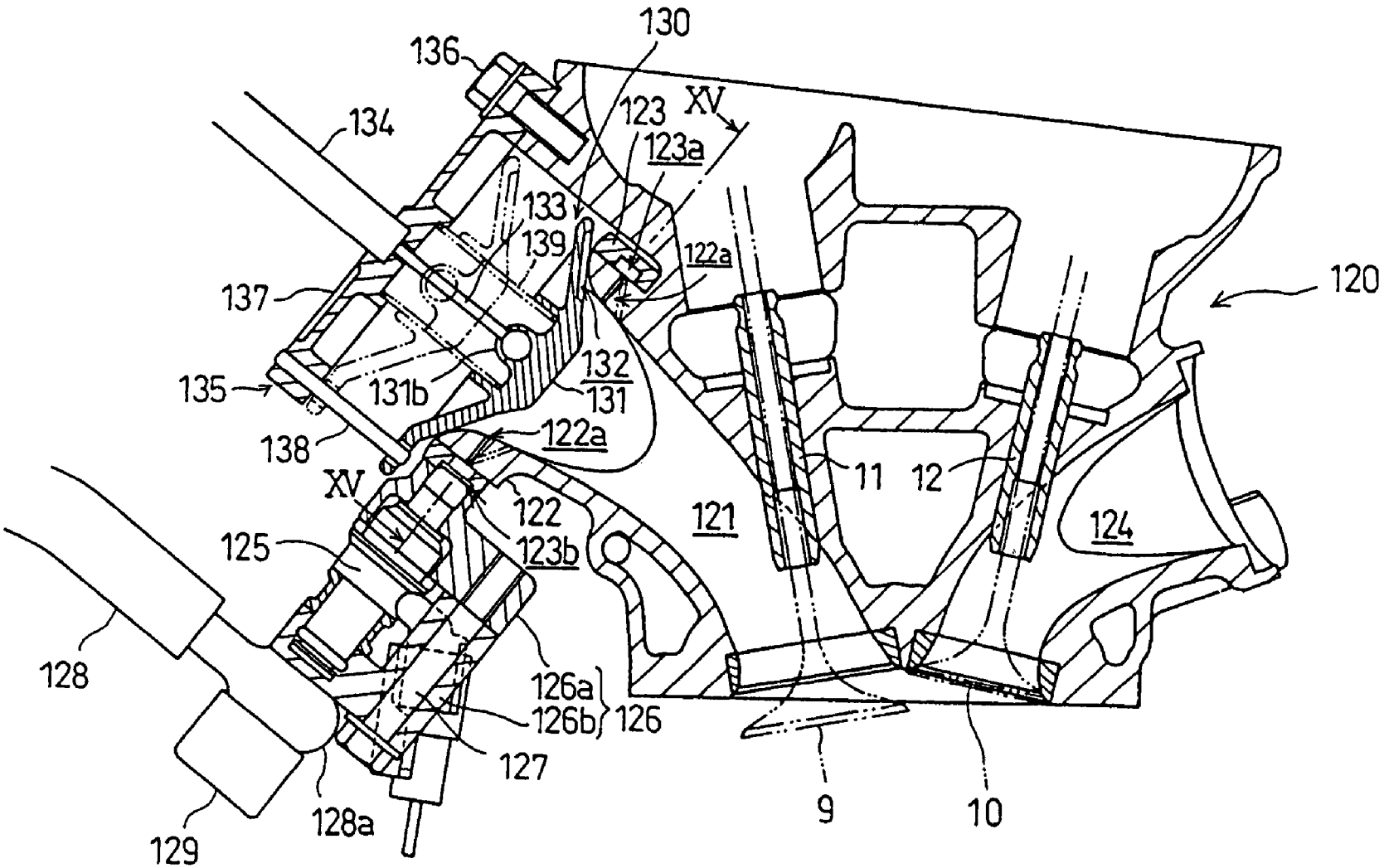
FIG. 14 is a sectional detail view of principal portions of an intake flow control apparatus and a cylinder head according to an eighth embodiment of the present invention.

Referring to FIGS. 14 and 15, the annular passage member 123 has an annular passage 123*a* which is a slot formed throughout the whole of the inner peripheral surface of the annular passage member 123. A communication port 123*b* communicating with the annular passage 123*a* is formed in part of the outer periphery surface of the annular passage member 123.

In the intake passage opening end 122 with the annular passage member 123 fitted thereon there are formed four injection holes 122*a* at equal spacing throughout the whole circumference. The injection holes 122*a* provide communication between the annular passages 123*a* of the annular passage member 123 and the interior of the intake passage 121. A holder 126 for holding a fuel injector 125 is fixed to the communication port 123*b* of the annular passage member 123.

In the holder 126, a front holder 126*a* for supporting a front end side of the fuel injector 125 and a rear holder 126*b* for holding a rear end side of the fuel injector are connected together with bolt 127 to hold the fuel injector 125. The front end of the fuel injector 125 is fitted in an insertion hole formed in the front holder 126*a* and a discharge port formed in the front end matches the communication port 123*b* of the annular passage member 123. A connecting portion 128*a* of a fuel supply pipe 128 for the supply of fuel to the fuel injector 125 is fixed to the rear holder 126*b* with a retaining member 129.

Consequently, the fuel discharged to the communication port 123*b* by the fuel injector 125 passes through the annular passage 123*a* and is injected into the intake passage 123 from the four injection holes 122*a*, and then is fed by intake into the combustion chamber.

By such a simple structure using a single fuel injector 125 without using plural fuel injectors, fuel can be injected from the plural injection holes 122*a* into the intake passage 121, whereby the fuel atomizing characteristic of the apparatus is greatly improved.

Although the four injection holes 122*a* are formed radially, that is, toward and perpendicularly to the intake axis, they may be formed in such a manner as shown in FIG. 14 in which, as indicated by a dash-double dot line, the injection holes are formed toward the downstream side at an acute angle relative to the intake axis, causing the fuel to be injected toward the combustion chamber. The number of the injection holes is not limited to four, but may be two, three, or five or more.

In an air flow regulator 130 used in the intake flow control apparatus of this embodiment, a valve element 131 moves while being guided by a guide structure 135 built on the intake passage opening end 122 to open or close an intake passage opening 121*a*. In the guide structure 135, an upper plate 137, which is fixed with bolt 136 around the intake passage opening end 122 of the cylinder head 120, is disposed in opposition to the intake passage opening 121*a*. Four guide rods 138 are projected from a peripheral edge portion of the upper plate 137 perpendicularly to the intake opening plane.

Figure 16:
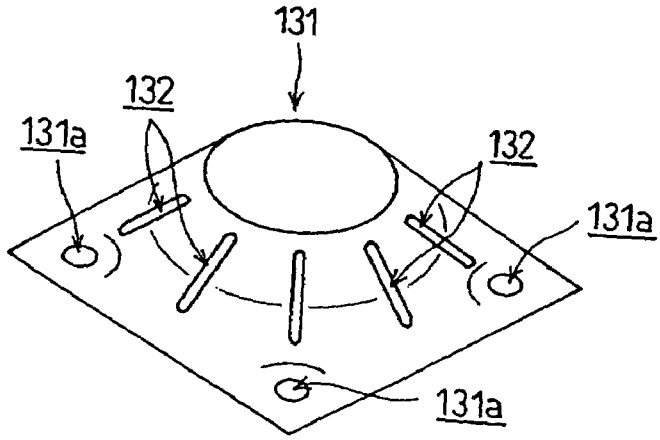
FIG. 16 is a perspective view of a valve sealing element of an air flow regulator.

As shown in FIGS. 14 and 16, the valve element 131 of the air flow regulator 130 is in the shape of a quadrangular truncated cone having a top plane, and four skirt portions extend toward the outer periphery to form a square back side, with circular holes 131 a being formed in the four corners of the square. Plural grooves 132 are formed radially in the conical surface. A retaining portion 131*b* for a throttle wire 133 is projectingly provided centrally of the back side.

The four guide rods 138 of the guide structure 135 are inserted through the circular holes 131*a*, whereby the valve element 131 is supported movably in the intake axis direction. A return spring 139 is interposed between the valve element 131 and the upper plate 137. A front end of a wire guide 134 for the throttle wire 133 is fixed to the upper plate 137 and the throttle wire 133 extending from the front end of the wire guide 134 passes through the upper plate 137 and is retained by the retaining portion 131*b* of the valve element 131.

When the valve element 131 comes into abutment against the intake passage opening 121*a*, the grooves 132 formed in the conical surface of the valve element 131 provide communication between the interior and the exterior of the intake passage 121, thereby reducing the negative pressure in the intake passage 121, so that the movement of the valve element 131 can be made easily. Consequently, when the throttle wire 133 is pulled by manual operation of the accelerator grip, the valve element 131 moves smoothly in the intake axis direction while being guided by the guide rods 138 even with a small force, whereby the intake passage 121 can be opened. Subsequently, by adjusting the amount of the movement, which can be done easily, it is possible to control the degree of valve opening in accordance with the amount of a throttle operation. In this way the amount of intake air can be controlled in an easy and highly accurate manner.

Since the fuel injector 125 is provided on the outer periphery of the intake passage 121 in the cylinder head 120, the structure of the air flow regulator 130 itself can be simplified and the air flow resistance is further diminished, whereby a high output can be obtained.

Figure 17:
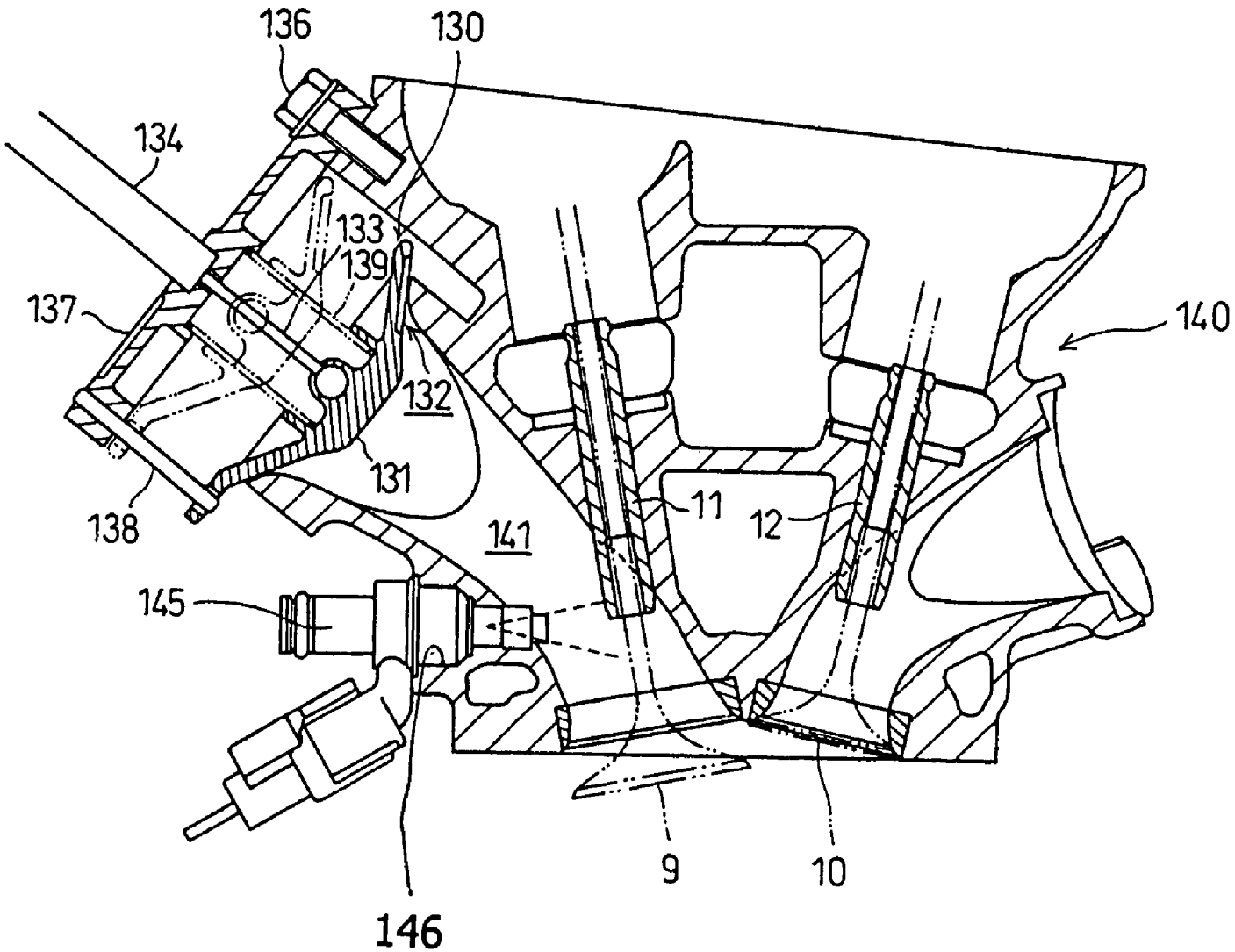
FIG. 17 is a sectional detail view of principal portions of an intake flow control apparatus and a cylinder head according to a ninth embodiment of the present invention.

Next, a ninth embodiment of the present invention will be described below with reference to FIG. 17 in which a fuel injector is provided on the outer periphery of an intake passage. A fuel injector 145 used in this ninth embodiment is disposed in an intake passage 141 in a cylinder head 140 at a position close to a combustion chamber-side opening of the intake passage 141. Other structural points are the same as in the previous eighth embodiment. The same members as in the eighth embodiment are identified by the same reference numerals as in the eighth embodiment.

An insertion hole 146 is formed in the outer periphery of the intake passage 141 at a position close to the combustion chamber-side opening and the fuel injector 145 is inserted and fixed into the insertion hole 146. The fuel injector 145 is fixed so as to inject fuel into the intake passage 141 toward the downstream side at an acute angle relative to the intake axis.

Since the fuel injector 145 is thus provided on the outer periphery of the intake passage 141 in the cylinder head 140, the structure of the air flow regulator 130 itself can be simplified as in the eighth embodiment.

Next, a tenth embodiment of the present invention will be described below with reference to FIGS. 18 to 22.

A body of an internal combustion engine and a guide structure used in this embodiment are the same as in the first embodiment. The same members as in the first embodiment are identified by the same reference numerals as in the first embodiment.

Figure 18:
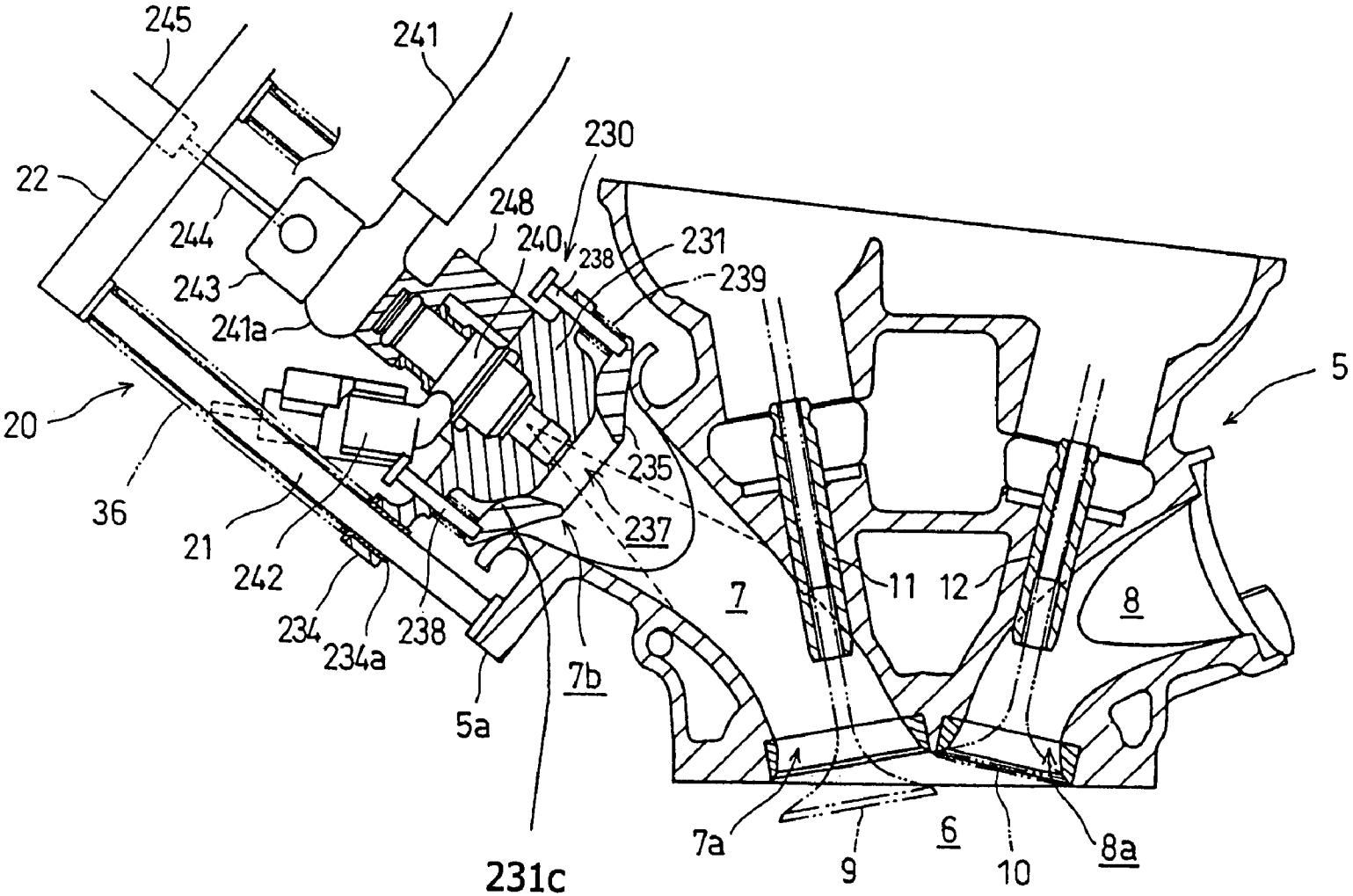
FIG. 18 is a sectional detail view of principal portions of an intake flow control apparatus and a cylinder head according to a tenth embodiment of the present invention, showing a state in which both a first control valve element and a second control valve element of an air flow regulator are closed.

Referring to FIG. 18, the upstream end of the intake passage 7 in the cylinder head 5 expands and projects while being warped in a funnel shape and is open to the exterior. A guide structure 20 is built over the intake passage opening 7*b*.

The guide structure 20 is built as in the first embodiment. That is, mounting bosses 5*a* are formed at three positions on the outer periphery of the cylinder head 5 around the intake passage opening 7*b* and guide rods 21 are threadably engaged with the mounting bosses 5*a* respectively and are erected thereon. Upper ends of the three guide rods 21 thus erected are fixed to end portions of three arms of an upper plate 22 having a deformed triangle shape with three arms extending radially from the center, the upper plate 22 being mounted bridgewise relative to the intake passage opening 7*b*.

An air flow regulator 230 is supported slidably at three points by the three guide rods 21 of the guide structure 20. As shown in FIGS. 18 and 21, the air flow regulator 230 has two valve elements, i.e., a first control valve element 231 and a second control valve element 235.

The first control valve element 231 has a cylindrical valve body. An outer periphery edge of a front end of the valve body is tapered to form a conical surface 231 a and a insertion hole 231*b* for insertion therein of a fuel injector 240 is formed along the valve axis, with an injection orifice 231*c* being formed in the front end face. A flange 232 is projected from the outer periphery of the cylindrical valve body and guide holes 232*a* are formed axially at four locations on the flange 232. Three arms 233 are projected radially from the flange 232 and cylindrical portions 234 each having an axis parallel to the axis of the cylindrical valve body are formed at distal ends of the arms 233 respectively.

On the other hand, the second control valve element 235 is an annular member centrally formed with an air passage 237 having a conical surface 235*a* as an outer periphery surface and a funnel-like warped surface 235*b* as an inner peripheral surface. Tapped holes 236 are formed in four positions of an outer periphery edge portion of the warped inner peripheral surface 235*b*.

The conical surface 231*a* of the first control valve element 231 is positioned in opposition to the warped inner peripheral surface 235*b* of the second control valve element 235 and four guide rods 238 are passed through the four guide holes 232*a* formed in the flange 232 of the first control valve element 231, then are inserted through coiled springs 239 and are brought into threaded engagement with the four tapped holes 236 formed in the second control valve element 235. The guide rods 238 are each provided at an end thereof with a head 238*a* of a larger diameter.

Thus, the first control valve element 231 is guided by the four guide rods 238 erected on the second control valve element 235, and moves axially in alignment with the second control valve element 235. The first and second control valve elements 231, 235 are urged away from each other by the coiled springs 239.

When the first control valve element 231 approaches the second control valve element 235 against the coiled springs 239, the conical surface 231*a* of the first control valve element 231 comes into abutment against the warped inner peripheral surface 235*b* of the second control valve element 235, while when both move away from each other by being urged with the coiled springs 239, the first control valve element 231 continues to move away from the second control valve element until it movement is inhibited by contact with the heads 238*a* of the guide rods 238.

The air flow regulator 230 constituted by such a combination of the first and second control valve elements 231, 235 is mounted into the guide structure 20 and is supported thereby. That is, slide sleeves 234*a* are respectively fitted in the cylindrical portions 234 at distal ends of the arms 233 extending in three directions of the first control valve element 231 and the three guide rods 21 of the guide structure 20 are respectively inserted through the slide sleeves 234*a*, whereby the first control valve element 231 is supported slidably, and the second control valve element 235 is slidably supported on the first control valve element 231 through the four guide rods 238.

The air flow regulator 230 is supported movably in the intake axis direction while being guided by the three guide rods 21 of the guide structure 20 in a state in which the conical surface 235*a* of the second control valve element 235 is opposed to the intake passage opening 7*b* and the axes of the first and second control valve elements 231, 235 are aligned with the intake axis of the intake passage 7.

Since the guide structure 20 for guiding movement of the air flow regulator 230 is fixed to the cylinder head 5 in the body of the internal combustion engine 1, even if the guide structure 20 is simple and light-weight, a movement position accuracy of the intake air flow regulator 30 relative to the intake passage opening 7*b* can be ensured easily against disturbance such as pulsation of the vacuum.

Further, return springs 36, wound round the three guide rods 21 respectively, are interposed between the cylindrical portions 234 projected from the first control valve element 231 and the upper plate 22. The return springs 36 urge the first control valve element 231 toward the intake passage opening 7*b*, i.e., in a direction to close the intake passage 7. The return springs 36 have a biasing force larger than that of the coiled springs 239 interposed between the first and second control valve elements 231, 235.

Therefore, without any external force, the first control valve 231 moves in the valve closing direction under the biasing force of the return springs 36, causing the second control valve element 235 to move in the valve closing direction through the coiled springs 239. As a result, the second control valve element 235 is brought into abutment against the inner peripheral surface of the intake passage opening 7*b*. Further, the first control valve element 231 moves while compressing the coiled springs 239, and its conical surface 231 a comes into abutment against the warped inner peripheral surface 235*b* of the second control valve element 235 to close the opening of the central air passage 237.

This state is as shown in FIG. 18. The first control valve element 231 closes the opening of the second control valve element 235. The second control valve element 235, together with the first control valve element 231, closes the intake passage opening 7*b*. The closing area of the first control valve element 231 (the opening area of the air passage 237 in the second control valve element 235) is smaller than the closing area of the second control valve element 235 (the opening area of the intake passage opening 7*b*).

When the second control valve element 235 of the intake air flow regulator 30 comes into abutment against the intake passage opening 7*b* and the first control valve element 231 comes into abutment against the second control valve element 235, since the valves are urged by the return springs 36, it is possible to diminish vibration of the air flow regulator 230 even if pulsation of the vacuum acts on both first and second control valve elements 231, 235.

Further, since the return springs 36 are provided in the guide structure 20, no special member for supporting the return springs 36 is needed, thus making it possible to reduce the number of parts and overall weight of the apparatus.

A front half portion of the fuel injector 240 is inserted into the insertion hole 231*b* on the back side of the first control valve element 231 so a fuel injection nozzle faces the injection orifice 231*c* of the valve element 231. A rear end portion of the fuel injector 240 is held by a holder 248 provided projectingly on the back side of the first control valve element 231, whereby the fuel injector 240 is movable together with the first control valve element 231.

A connecting portion 241*a* of a fuel supply pipe 241 is connected to the rear end portion of the fuel injector 240, and an electric wire connector 242 is projected from the central part of the fuel injector 240. An end portion of a wire guide 245 is fixed to the central part of the upper plate 22, and a throttle wire 244 guided by the wire guide 245 extends through the upper plate 22. The front end of the throttle wire 244 is retained by a retaining member 243, which is for fixing the connecting portion 241*a* of the fuel supply pipe 241 to the rear end portion of the fuel injector 240. The opposite end of the throttle wire 244 is connected to the accelerator grip (not shown), which is operated by the rider.

Since The intake flow control apparatus according to this embodiment is constructed as above and the air flow regulator 230, adapted to move in the intake axis direction, is provided in opposition to the upstream-side opening of the intake passage 7, the intake passage is shortened and therefore it is possible to obtain a high output and diminish the air flow resistance.

Figure 19:
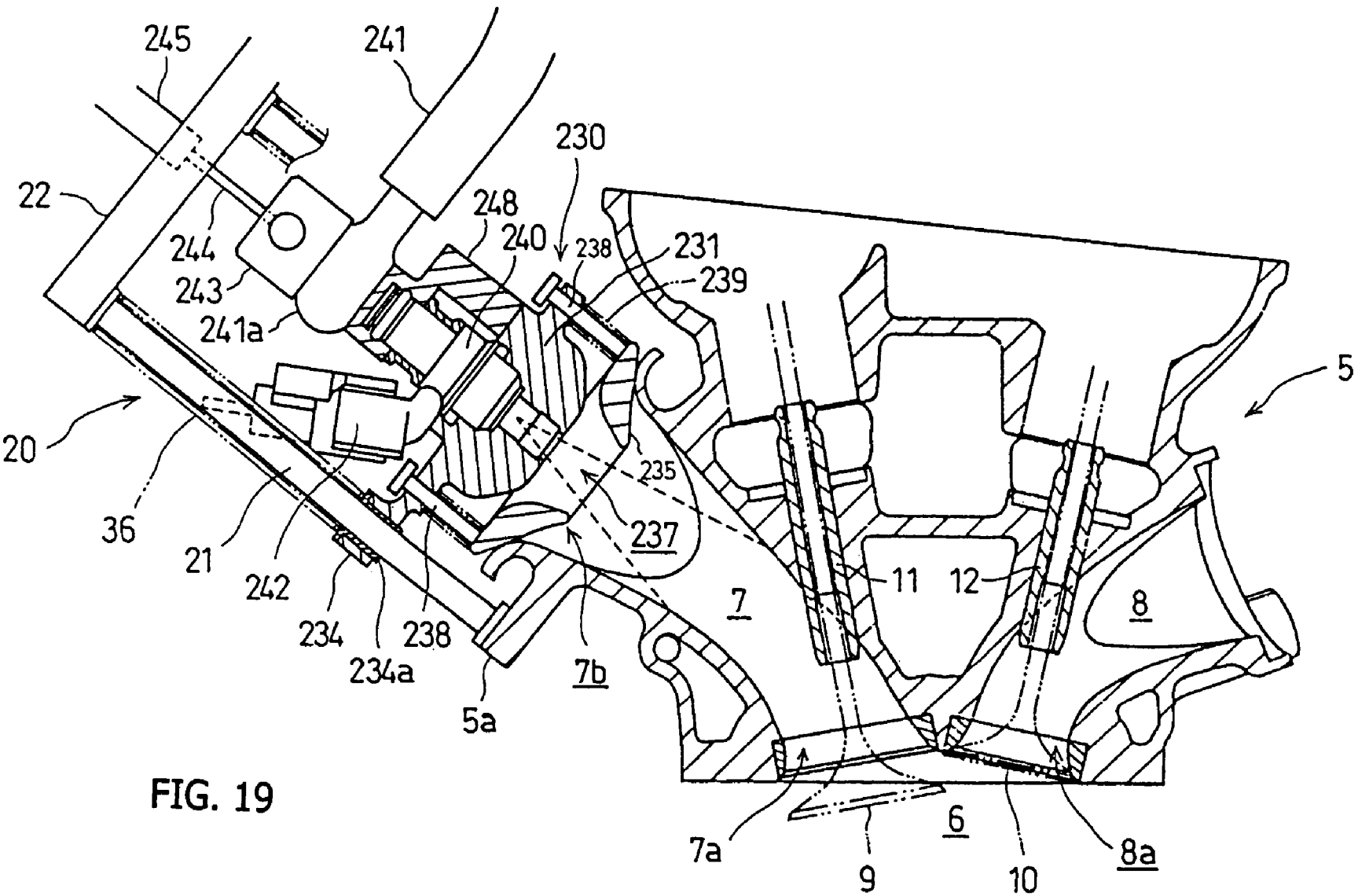
FIG. 19 is a sectional detail view of the principal portions of the intake flow control apparatus and the cylinder head of the tenth embodiment, showing a state in which the first control valve element is open and the second control valve element is closed.

When the throttle wire 244 is pulled in the fully closed state of the intake passage 7 shown in FIG. 18, the first control valve element 231 moves while allowing the second valve element 235 to remain with the biasing force of the coiled springs 239 to open the air passage 237 of the second control valve element 235 as shown in FIG. 19.

The first control valve element 231 which thus opens first is relatively small in its closing area and it moves while compressing the coiled springs 239, causing the conical surface 231*a* to come into abutment against and linear contact with the warped inner peripheral surface 235*b* of the second control valve element 235 to close the opening of the central air passage 237. Therefore, the valve opening operation is easy even if the vacuum is high, and upon valve opening the vacuum is reduced, resulting in that the amount of force required for movement of the first control valve element 231 becomes less and the amount of force required for movement of the second control valve element 235 located at the next stage can also be easily reduced, thus permitting smooth execution of the intake flow control.

The closing area of the first control valve element 231, which opens in the initial opening stage, is smaller than that of the second control valve element 235. Therefore, in a low revolution state of the internal combustion engine and in a low valve angle state, for example when the vehicle is starting, the amount of intake air can be controlled precisely by the first control valve element 231 whose intake passage opening area is small. Thus, the output of the internal combustion engine relative to the amount of throttle operation at the time of start-up can be controlled precisely and it is thereby possible to fully meet the request for acceleration according to conditions.

Figure 20:
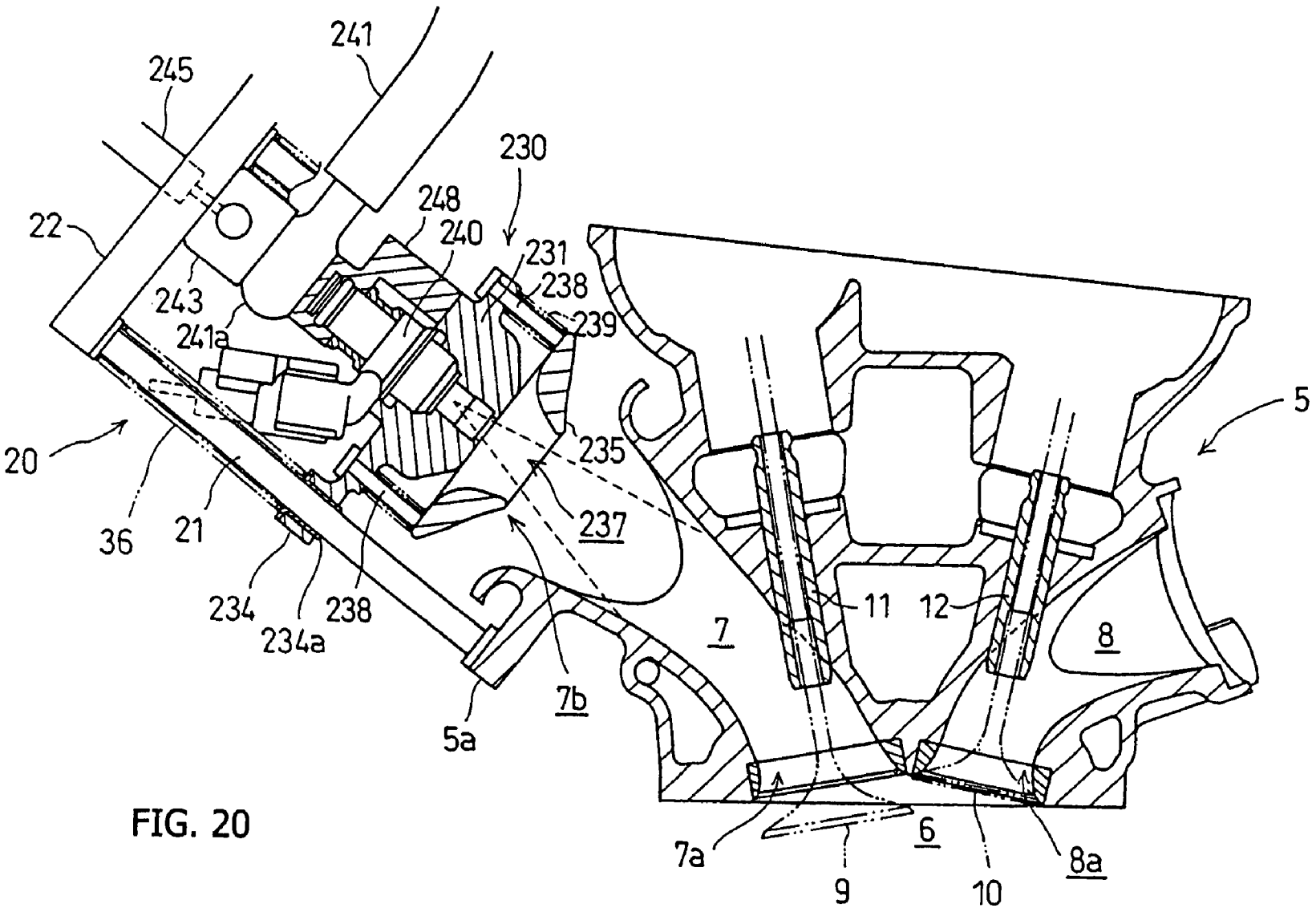
FIG. 20 is a sectional detail view of the principal portions of the intake flow control apparatus and the cylinder head in the tenth embodiment, showing a state in which both the first and the second control valve element are open.
Figure 23:
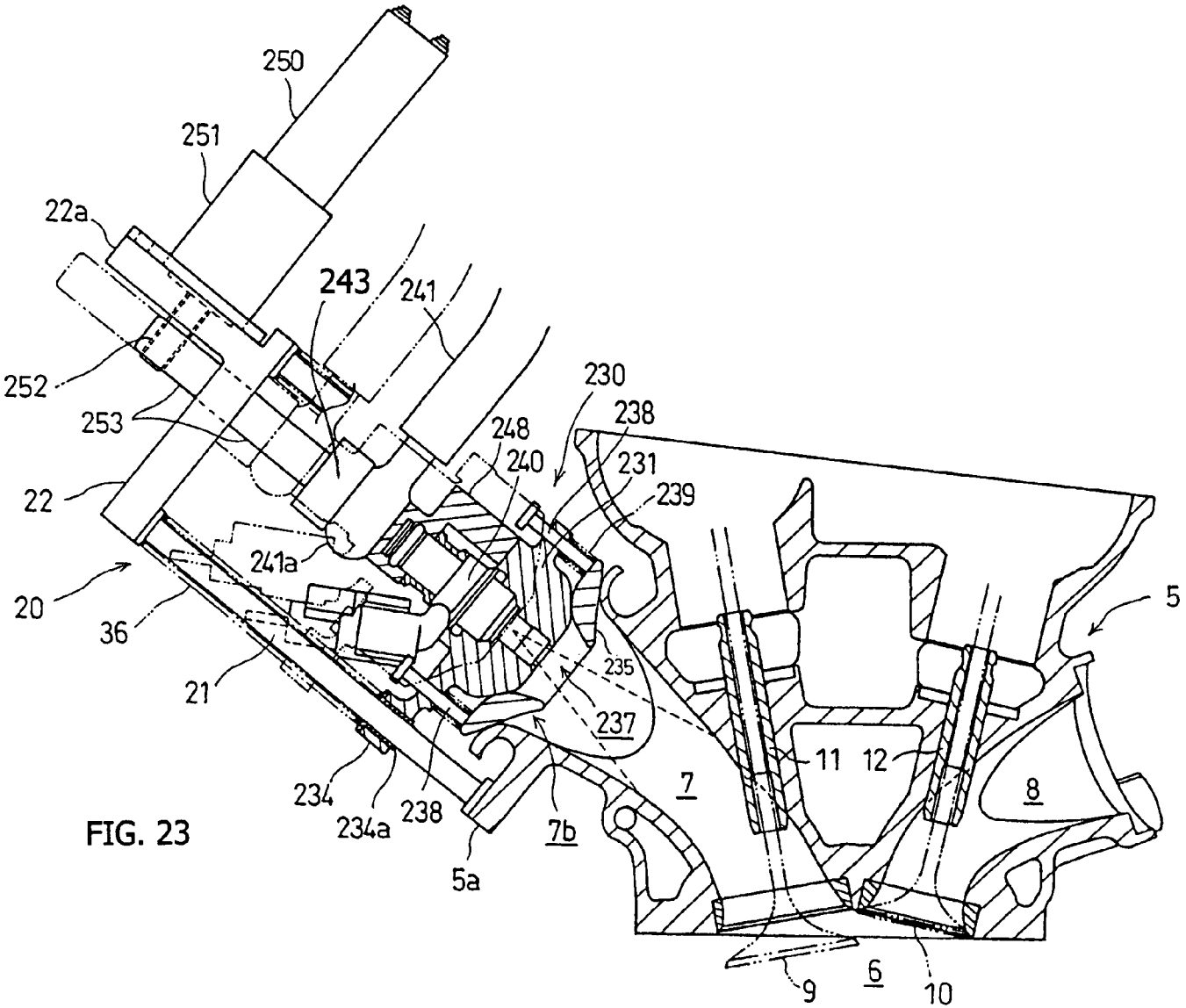
FIG. 23 is a sectional detail view of principal portions of an intake flow control apparatus and a cylinder head according to an eleventh embodiment of the present invention.

Until the first control valve element 231 comes into contact with the heads 238*a* of the guide rods 238 after the throttle wire 244 is pulled, only the first control valve element 231 moves. Then, when the throttle wire 244 is further pulled beyond the position associated with the low revolution state of the internal combustion engine, and the first control valve element 231 comes into contact with the heads 238*a* of the guide rods 238, the second control valve element 235 moves together with the first control valve element through the guide rods 238 to open the intake passage opening 7*b* as shown in FIG. 20. Thus, a coordinated motion mechanism is constituted.

The movement of the second control valve element 235 has a valve opening characteristic different from that exhibited when only the first control valve element 231 moves. With the coordinated motion mechanism, the valve opening characteristic is changed successively in accordance with the amount of a throttle operation, whereby a required intake air quantity characteristic can be set easily.

FIG. 22 is a graph showing valve opening characteristics, i.e., throttle angle characteristics. A change in effective opening area (axis of ordinate) relative to the grip angle (axis of abscissa) is shown in the same figure. A dot-dash line which is nearly straight is an ideal characteristic curve. An effective opening area increases substantially in proportion to the grip angle.

In the case of a single valve, that is, when the air flow regulator includes a single valve, an increase rate of the effective opening area in a small grip angle region is too large in comparison with the ideal characteristic curve, as indicated by a broken line (a single valve characteristic curve) in FIG. 22, and therefore it is difficult to perform a precise output control in the small grip angle region.

On the other hand, in the case of a multi-stage valve including two valve elements, for example the first control valve element 231 and the second control valve element 235, like the air flow regulator used in this tenth embodiment, as indicated by a solid line (a multi-stage valve characteristic curve) in FIG. 22, the characteristic in the small grip angle region wherein the first control valve element 231 as the first-stage valve element opens and the characteristic wherein the second control valve element 235 as the second-stage valve element opens are different from each other, and an increase rate of the effective opening area in the small grip angle region can be made small by the first control valve element 231. Therefore, it is possible to effect approximation to the ideal characteristic curve throughout the whole of the grip angle.

Though not shown in the graph, by setting still smaller the increase rate of the effective opening area relative to the grip angle at the time of opening of the first-stage valve element, the output at the time of start-up of a high-output internal combustion engine or the like can be controlled more precisely.

The fuel injector 240 used in this embodiment is fixed to, and moves together with, the first control valve element 231 of the air flow regulator 230. Therefore, in a high revolution state of the internal combustion engine, and in a fully open condition of the first control valve element 231 spaced the longest distance from the intake passage opening 7*b*, the distance from the fuel injection orifice of the fuel injector 240 (the injection orifice 231*c* of the first control valve element 231) to the intake port 7*a* becomes long, and hence it is possible to improve the fuel atomizing characteristic.

In a low revolution state of the internal combustion engine and in a condition in which the first control valve element 231 of the air flow regulator 230 is abutted against the intake passage opening 7*b* and is fully closed, the distance from the fuel injection orifice of the fuel injector 240 to the intake port 7*b* becomes short and hence it is possible to improve the responsiveness of fuel supply.

Next, a description will be given below about an eleventh embodiment of the present invention which corresponds to the previous tenth embodiment except that only the drive mechanism for moving the air flow regulator is changed.

Except the drive mechanism, this eleventh embodiment is of the same structure as the tenth embodiment. The same members as in the tenth embodiment are identified by the same reference numerals as in the tenth embodiment.

In the eleventh embodiment, a motor and a rack-pinion mechanism are used as a drive mechanism for guiding and moving the first and second control valve elements 231, 235 of the air flow regulator 230 through the guide mechanism 20. More specifically, a motor 250 is fixed through a gear box 251 to the bracket 22*a* of the upper plate 22 in the guide structure 20. A rack 253, meshing with a pinion 252 fitted on a driving output shaft of the motor, extends slidably through the upper plate 22. An end portion of the rack 253 is connected to a retaining member 243, which is fixes the connecting portion 241*a* of the fuel supply pipe 241 to the rear end portion of the fuel injector 40.

According to this construction, the rotation of the pinion 252, which has been decelerated by the motor 250 through the gear box 251, causes the rack 253, meshing with the pinion 252, to move together with the first control valve element 231 guided by the guide structure 20 to open the air passage 237 of the second control valve element 235, and then successively open the intake passage opening 7*b*.

The first control valve element 231, which opens first, is relatively small in its closing area and it moves while compressing the coiled springs 239, allowing the conical surface 231*a* to come into abutment against and linear contact with the warped inner peripheral surface 235*b* of the second control valve element 235 to close the opening of the central air passage 237. Therefore, even if the vacuum is high, the valve opening operation is easy and the load imposed on the motor 250 is reduced.

Consequently, the use of a large output motor is not needed and it is possible to prevent an increase of motor size and weight. In addition, it is possible to decrease the loss of electric power and reduce cost.

The movement of the second control valve element 235 has a valve opening characteristic different from that exhibited when only the first control valve element 231 moves, and with the coordinated motion mechanism, the valve opening characteristic is changed successively in accordance with the amount of a throttle operation without the need of any complicated control by the motor 250, whereby a required intake air quantity characteristic can be set easily.

Since the first control valve element 231, which opens first, is relatively small in its closing area and it moves while compressing the coiled springs 239, causing the conical surfaces 231*a* to come into abutment against and linear contact with the warped inner peripheral surface 235*b* of the second control valve element 235 to close the opening of the central air passage 237, the valve opening operation is easy even if the vacuum is high. Upon valve opening, the vacuum is reduced, so that the movement of the first control valve element 231 becomes easier and the movement of the second control valve element 235 located in the next stage can also be made easily, thus permitting smooth control of the amount of intake air.

Figure 24:
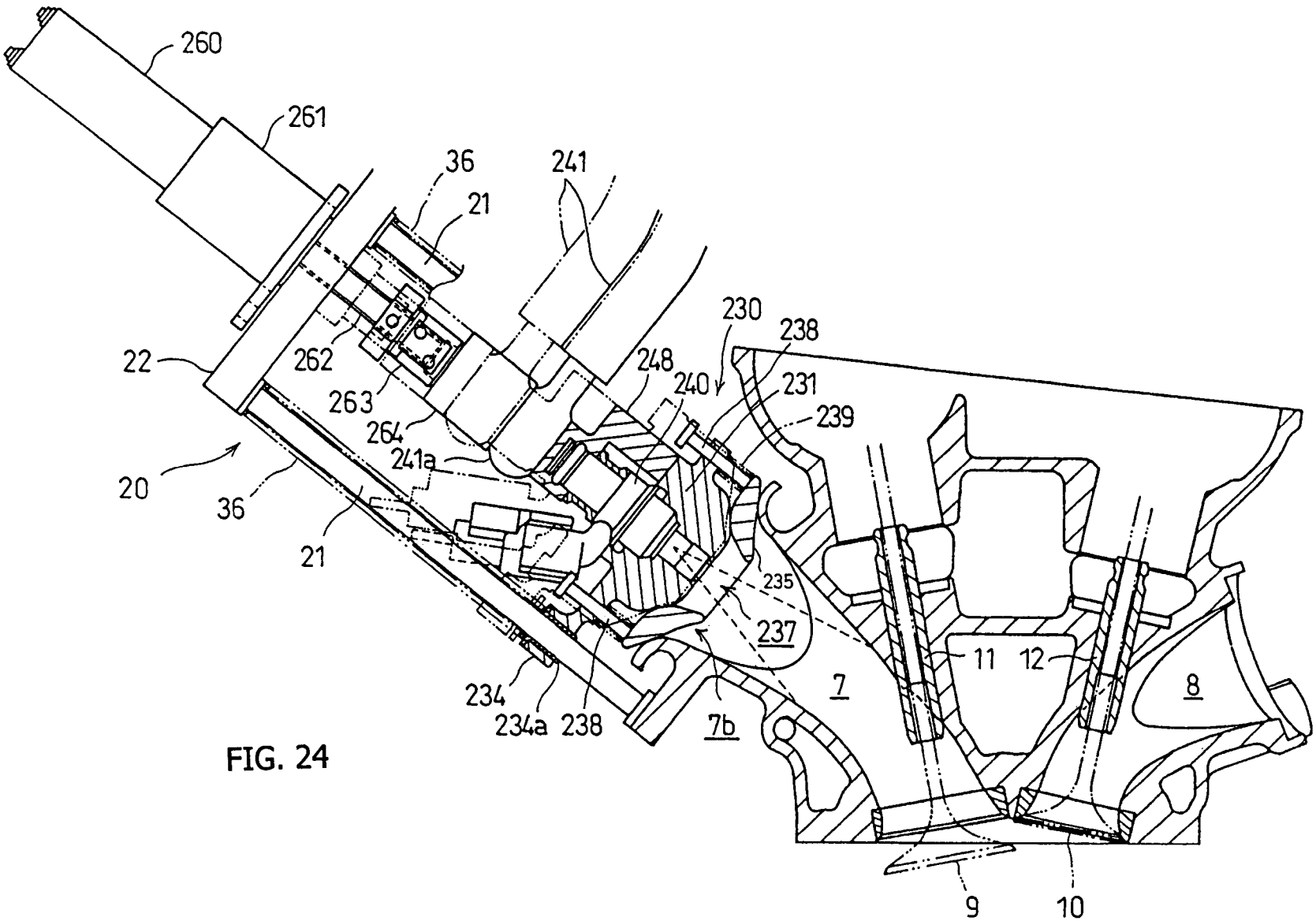
FIG. 24 is a sectional detail view of principal portions of an intake flow control apparatus and a cylinder head according to a twelfth embodiment of the present invention.

Next, with reference to FIG. 24, a description will be given below about a twelfth embodiment of the present invention in which a ball screw mechanism is used instead of the rack-pinion mechanism as the drive transfer mechanism in the eleventh embodiment.

The twelfth embodiment is the same, except the drive transfer mechanism used therein, as the previous eleventh embodiment and therefore the same members as in the eleventh embodiment are identified by the same reference numerals as in the eleventh embodiment.

A motor 260 is fixed through a gear box 261 to the upper plate 22 of the guide structure 20. A screw shaft 262, extended from an output shaft of the motor, projects in alignment with the air flow regulator 230. A retaining member fixes the connecting portion 241*a* of the fuel supply pipe 241 to the rear end portion of the fuel injector 240 and also serves as a screw receiving portion 264. The screw shaft 262 is threadably engaged through balls with a nut 263 which is fixed to the screw receiving portion 264.

According to this construction, the rotation of the screw shaft 262, which is driven by the motor 260, the output of which has been decelerated through the gear box 261, causes the nut 263, threadably engaged with the screw shaft, to move together with the air flow regulator 230, guided by the guide structure 20, to open the air passage 237 of the second control valve element 235 and then open the intake passage opening 7*b*.

Since the air flow regulator 230 is of the same structure as in the tenth embodiment, even if the vacuum is high, the valve opening operation is easy and the load imposed on the motor 250 is reduced. Consequently, the use of a high output motor is not needed, and it is possible to prevent an increase of motor size and weight. In addition, it is possible to decrease the loss of electric power and reduce cost.

Further, with the air flow regulator 230 provided with the coordinated motion mechanism, the valve opening characteristic is changed in accordance with the amount of a throttle operation without the need of any complicated control by the motor 260, whereby a required intake air quantity characteristic can be set easily.

Next, a thirteenth embodiment of the present invention will be described below with reference to FIGS. 25 to 27.

The thirteenth embodiment involves an intake flow control apparatus structure which is substantially the same as in the seventh embodiment, except the air flow regulator 270. The elements common to both the seventh and thirteenth embodiments are identified by the same reference numerals.

Therefore, in the guide structure 90, mounting bosses 5*a* are formed at three positions on the outer surface of the cylinder head 5 around the intake passage opening 7*b*, three bolts 91 are threadably engaged with the mounting bosses 5*a*, holders 93 and 94 are bridgewise supported by the three bolts 91 through the spacer 92, and the fuel injector 95 is held by the holders 93 and 94. The guide structure 90 is constituted by the bolts 91, spacer 92, holders 93, 94, and the casing of the fuel injector 95.

The holders 93 and 94, when seen in top view, are each in the shape of a deformed triangle with three arms extending radially. End portions of the three arms are fixed to the three bolts 91 respectively. The holder 93 holds the central portion 95*b* of the casing of the fuel injector 95, the holder 94 holds the rear end portion 95*c* of the casing of the fuel injector 95, and the casing portion ahead of the central portion 95*b* of the casing of the fuel injector 95 projects cylindrically to form the injection cylinder 95*a*.

The injection cylinder 95*a* is aligned with the intake axis of the intake passage 7 and a second control valve element 271 of an intake air flow regulator 270 according to this embodiment is fitted on the injection cylinder 95*a* so that the injection cylinder 95*a* extends through the second control valve element 271. The second control valve element 271 is guided and movably supported by the injection cylinder 95*a*.

Figure 27:
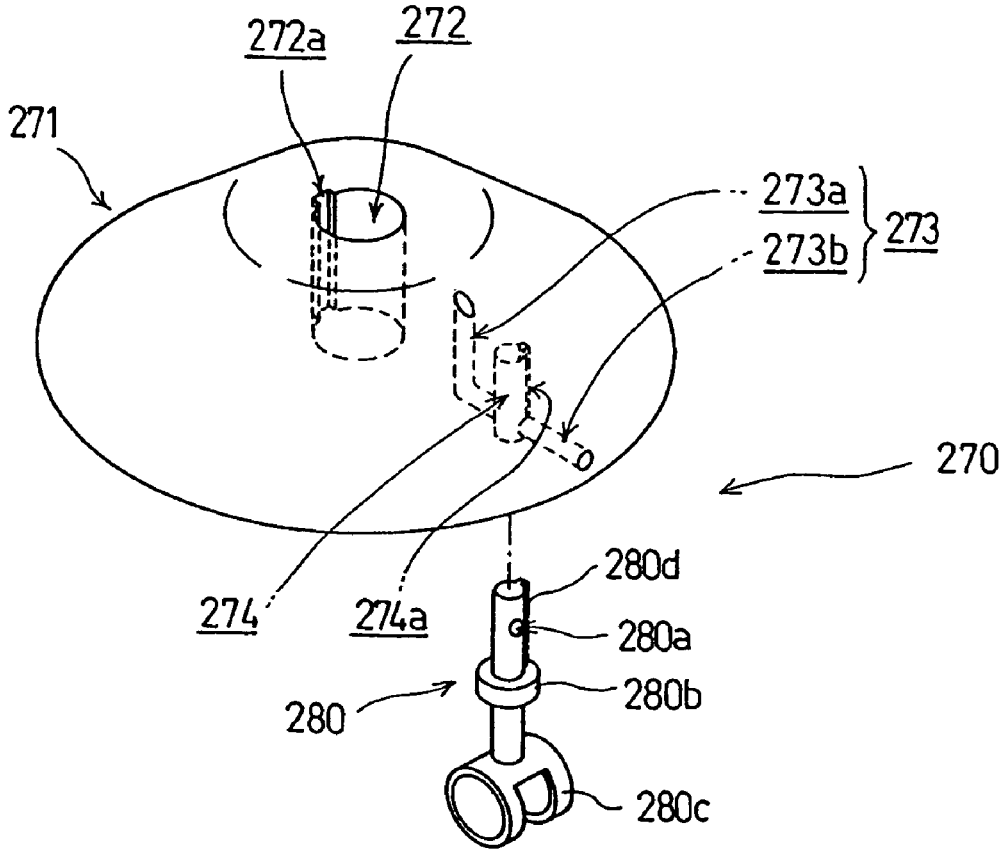
FIG. 27 is an exploded perspective view of the air flow regulator of the thirteenth embodiment.

As shown in FIG. 27, the second control valve element 271 is in the shape of a truncated cone having a top plane, with a circular hole 272 being centrally formed toward the back side. A key way 272*a* is formed axially in the circular hole 272.

The injection cylinder 95*a* of the fuel injector 95 is inserted through the circular hole 272 of the second control valve element 271 and a ridge portion 95*d* formed axially on the outer periphery surface of the injection cylinder 95*a* is fitted in the key way 272 of the circular hole 272, whereby the rotation of the second control valve element 271 centered on the injection cylinder 95*a* is prevented. Thus, the second control valve element 271 is supported axially movably without being guided and rotated by the injection cylinder 95*a*.

A return spring 275 wound round the injection cylinder 95*a* is interposed between the back side of the second control valve element 271 and the holder 93 to urge the second control valve element 271 in a direction to close the intake passage opening 7*b*.

Thus, since the second control valve element 271 of the air flow regulator 270 moves while being guided by the injection cylinder 95*a* as a highly rigid casing of the fuel injector 95 in the guide structure 90 attached directly to the cylinder head 5, a high movement position accuracy of the second control valve element 271 is ensured.

Thus, the control of the amount of intake air by the air flow regulator 270 can be performed with a high accuracy in accordance with a throttle operation. In addition, since the guide structure 90 also supports the fuel injector 95, it is possible to reduce the number of parts and weight and simplify the structure.

Since the second control valve element 271 of the intake air control valve element 270 is urged by the return spring 275 into abutment against the intake passage opening 7*b*, it is easy to minimize disturbance which occurs upon exertion of intake pulsation or the like on the second control valve element 271.

Referring to FIG. 27, a vertical hole 273*a* extends from the conical surface of the second control valve element 271 to its back side, and a lateral hole 273*b* is formed which intersects the vertical hole 273*a* at the bottom of the vertical hole 273*a* and extends radially along the back side of the second control valve element 271. The vertical hole 273*a* and the lateral hole 273*b* together form an L-shaped air bypass passage 273 having both-end openings formed in the conical surface and the outer periphery edge of the second control valve element 271 to provide communication between the conical surface and the outer periphery edge. In addition, a valve inserting hole 274 is formed from the lateral hole 273*b* in the air bypass passage 273 toward the back side. A key way 274*a* is formed in the valve inserting hole 274.

Figure 25:
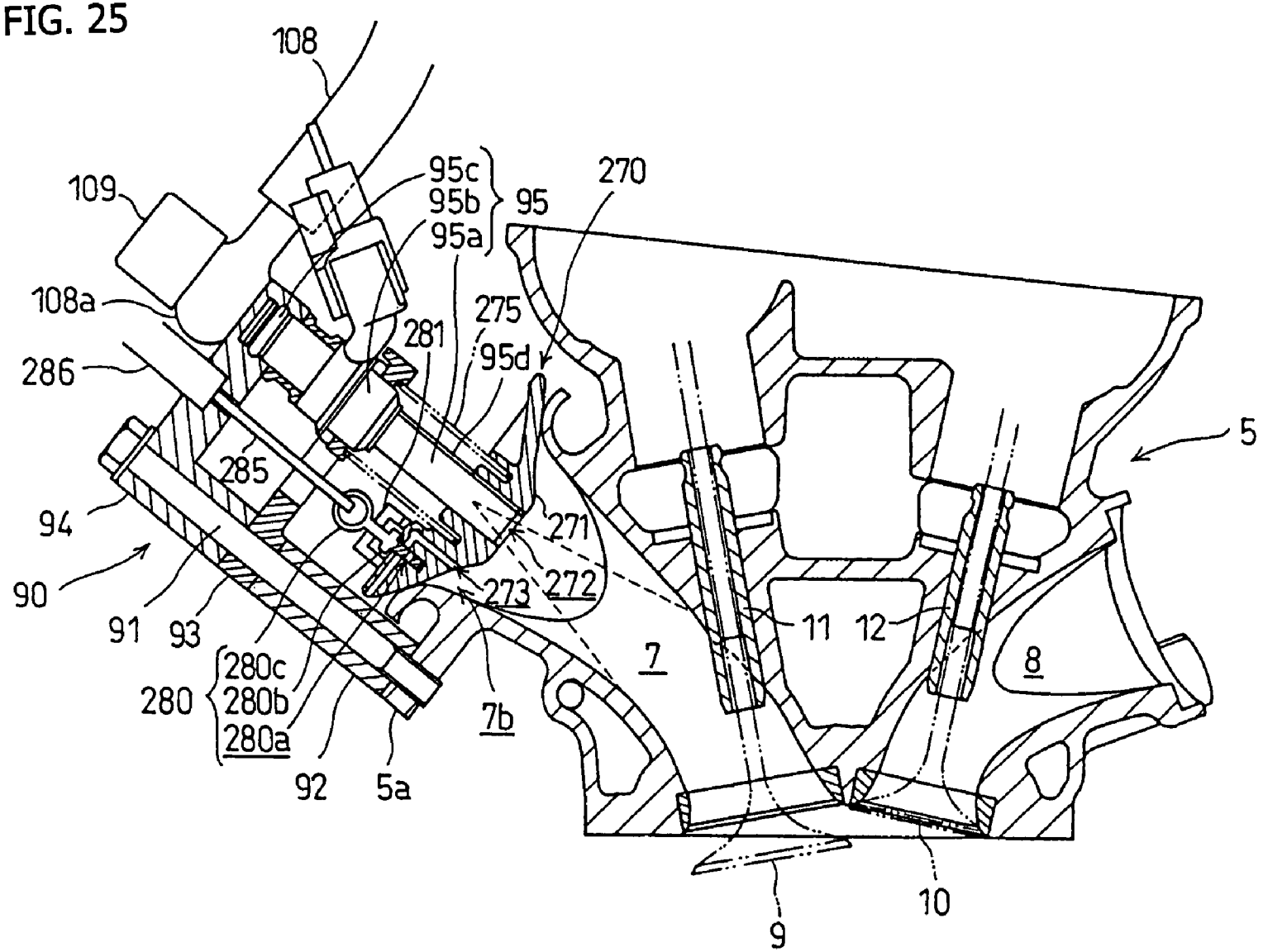
FIG. 25 is a sectional detail view of principal portions of an intake flow control apparatus and a cylinder head according to a thirteenth embodiment of the present invention, showing a state in which both a first control valve element and a second control valve element of an air flow regulator are closed.

As shown in FIG. 25, a first control valve element 280 which is like a rod is inserted into the valve inserting hole 274 of the second control valve element 271 slidably from the back side. In the rod-like first control valve element 280, a through hole 280*a* is formed near a front end of the valve element 280 perpendicularly to the axis of the valve element, a flange 280*b* is formed centrally, and a connection ring 280*c* is formed at a base end of the valve element 280. A ridge portion 280*d* is formed on the front end side of the flange 280*b* in conformity with the key way 274*a* formed in the valve inserting hole 274.

The first control valve element 280, on its front end side ahead of the flange 280*b*, is inserted into the valve inserting hole 274 of the second control valve element 271 so that the ridge portion 280*d* is fitted in the key way 274*a* to prevent rotation of the valve element. A bottomed cylindrical restriction member 281 is fixed to the back side of the second control valve element 271 so as to enclose the flange 280*b* exposed from the back side of the second control valve element 271.

The potion of the first control valve element 280 located between the flange 280*b* and the connection ring 280*c* extends through the bottom wall of the bottomed cylindrical restriction member 281 and the connection ring 280*c* is exposed to the exterior.

Consequently, a sliding motion of the first control valve element 280 relative to the second control valve element 271 is inhibited in a range in which the flange 28*b* can move between the bottom wall of the restriction member 281 and the back side of the second control valve element 271. When the flange 280*b* comes into abutment against the bottom wall of the restriction member 281, the through hole 280*a* formed near the front end of the first control valve element 280 is put in alignment with the lateral hole 273*b* of the air bypass passage 273 to open the valve. In conditions other than this condition the valve is closed.

A front end of a wire guide 286 for a throttle wire 285, adapted to be operated by the accelerator grip (not shown) which the rider operates, is fixed to the holder 94. The throttle wire 285, extended from the front end of the wire guide 286, passes through cutout portions of the holders 94 and 93 and is connected to the connection ring 280*c* of the first control valve element 280.

Since the intake flow control apparatus in the internal combustion engine according to this embodiment, which is constructed as above, has the air flow regulator 270 adapted to move in the intake axis direction in opposition to the upstream-side opening of the intake passage 7, the intake passage is shortened and hence it is possible to obtain a high output and diminish the air flow resistance.

FIG. 25 shows a fully closed state of the intake passage 7. In this state, the second control valve element 271 is urged by the return spring 275 into abutment against the intake passage opening 7*b* to close the intake passage 7, the vertical hole 273*a* formed in the air bypass passage 273 opens into the intake passage 7, and the lateral hole 273*b* opens to the exterior. On the other hand, the first control valve element 280 closes the air bypass passage 273 and the intake passage 7 is completely closed.

Figure 26:
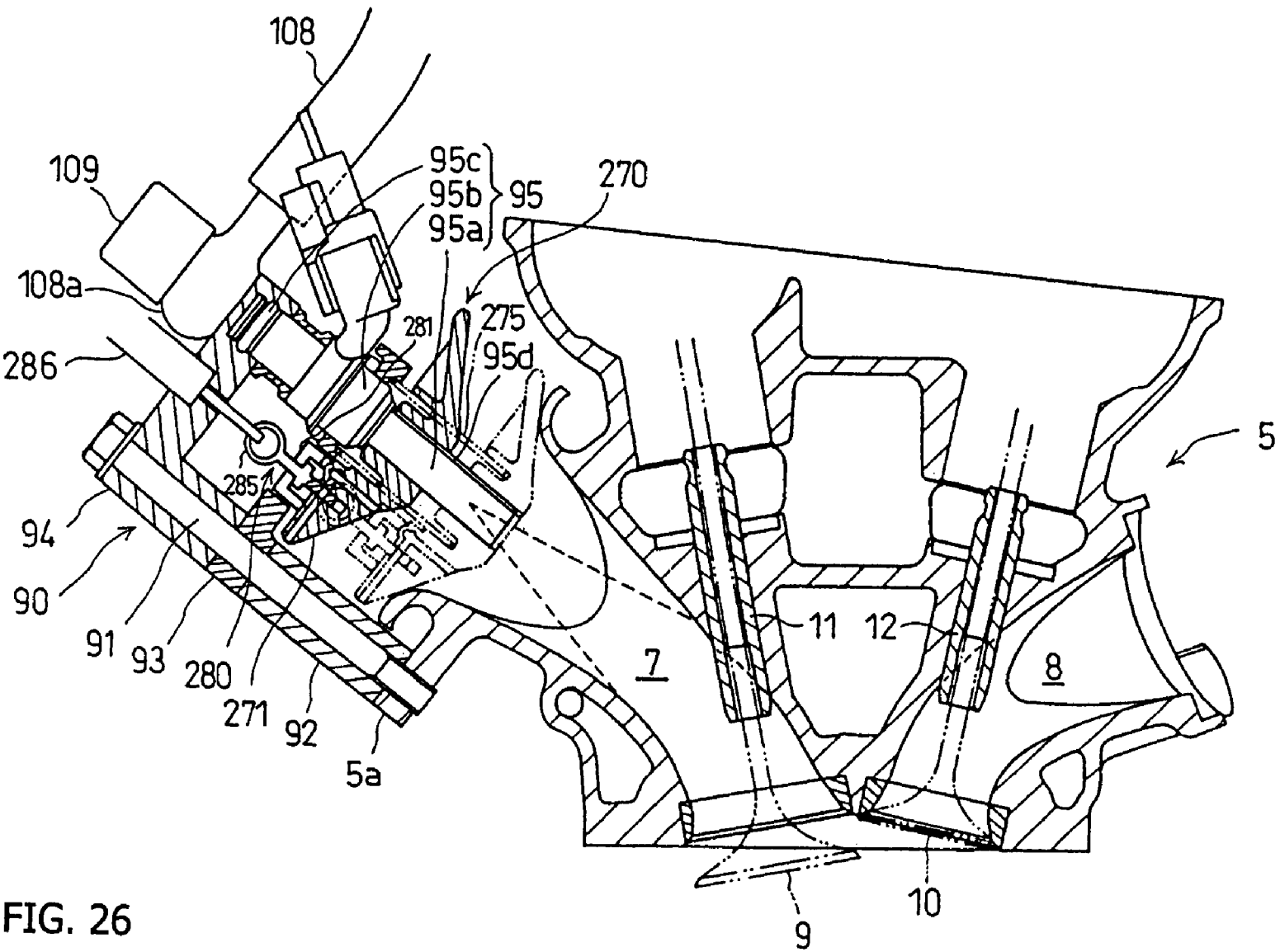
FIG. 26 is a sectional detail view of the principal portion of the intake flow control apparatus and the cylinder head of the thirteenth embodiment, showing a state in which both the first and the second control valve element of the air flow regulator are open.

When the accelerator grip is operated and the throttle wire 285 is pulled in this state, the first control valve element 280 moves while allowing the second control valve element 271 to remain with the biasing force of the return spring 275 and the through hole 280*a* is aligned with the air bypass passage 273 of the second control valve element 271 as indicated by a dash-double dot line in FIG. 26, causing the air bypass passage 273 to open.

Since the first control valve element 280 which opens first is small in its closing area, even if the vacuum is high, the valve opening operation is easy and the amount of force required for movement of the first control valve element is light. Once the first control valve element 280 opens, the vacuum is reduced and the force required for movement of the second control valve element 271 located in the next stage can also be reduced, thus permitting smooth control of the amount of intake air.

The closing area of the first control valve element 280, which opens in the initial stage of opening, is smaller than that of the second control valve element 271, and therefore in a low revolution state of the internal combustion engine, i.e., in a low valve angle state, for example at the time of start-up of the vehicle, the amount of intake air can be controlled precisely by the first control valve element 280 which is small in the intake passage opening area. Thus, it is possible to precisely control the output of the internal combustion engine relative to the amount of throttle operation at the time of start-up of the vehicle and fully meet a request for acceleration according to conditions.

Only the first control valve element 280 moves until its flange 280*b* of the first control value element 280 comes into contact with the restriction member 281 after the throttle wire 285 is pulled, and when the throttle wire 285 is further pulled beyond the low revolution region of the internal combustion engine and the flange 280*b* of the first control valve element 280 comes into contact with the restriction member 281, the second control valve element 271 moves together with the restriction member 281 and opens the intake passage opening 7*b* as indicated by a solid line in FIG. 26. A coordinated motion mechanism is thus constituted.

The movement of the second control valve element 271 has a valve opening characteristic different from that exhibited when only the first control valve element 280 moves. With the coordinated motion mechanism, the valve opening characteristic is changed successively in accordance with the amount of a throttle operation, whereby a required intake air quantity characteristic can be set easily.

Figure 28:
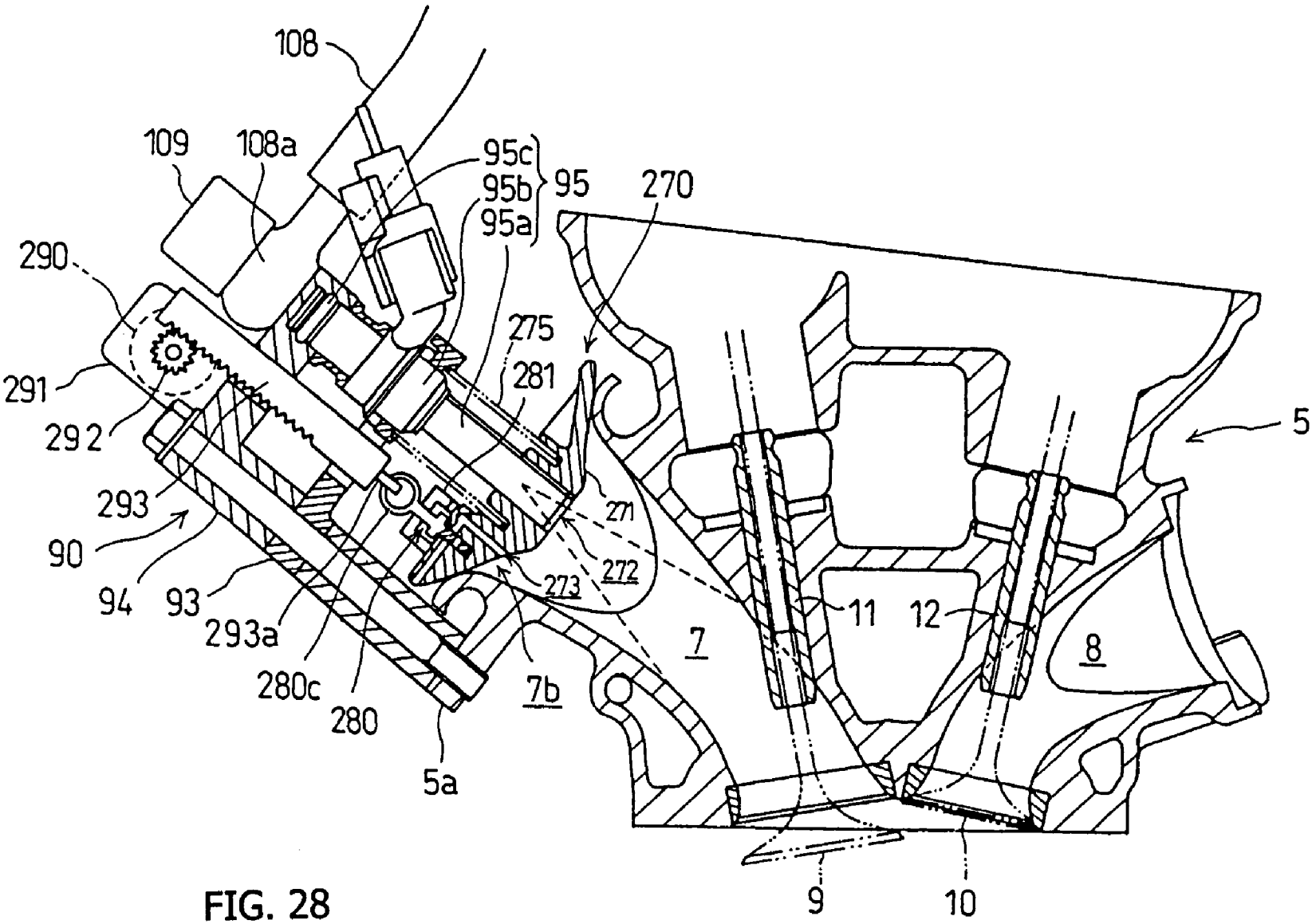
FIG. 28 is a sectional detail view of principal portions of an intake flow control apparatus and a cylinder head according to a fourteenth embodiment of the present invention, showing a state in which both a first control valve element and a second control valve element of an air flow regulator are closed.

Next, with reference to FIGS. 28 and 29, a description will be given about a fourteenth embodiment of the present invention corresponding to the previous thirteenth embodiment except that only the drive mechanism for moving the air flow regulator is changed. Except the drive mechanism, the fourteenth embodiment is of the same structure as the previous thirteenth embodiment, and elements common to both the thirteenth embodiment and fourteenth embodiment are identified by the same reference numerals as in the thirteenth embodiment.

In the fourteenth embodiment, a motor and a rack-pinion mechanism are used as the drive mechanism for guiding and moving the first and second control valve elements 280, 271 of the air flow regulator 270 through the guide structure 90. More specifically, a motor 290 is fixed together with a gear box 291 to the holder 94 of the guide structure 90, a rack 293 meshing with a pinion 292 fitted on a driving output shaft of the motor extends slidably through the holders 94 and 93, and a connection portion 293*a* of an end portion thereof is connected to the connection ring 280*c* of the first control valve element 280.

Figure 29:
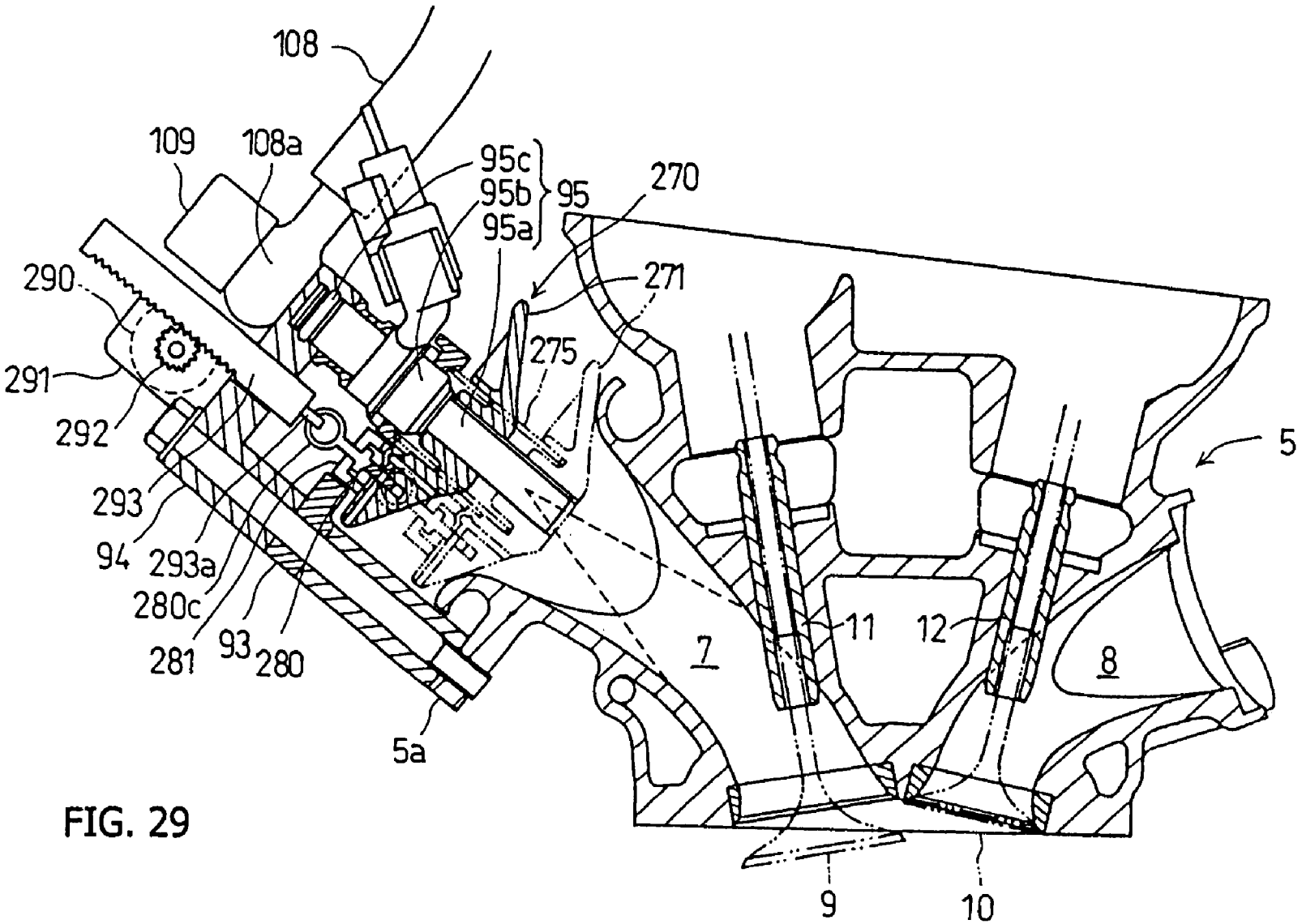
FIG. 29 is a sectional detail view of the principal portions of the intake flow control apparatus and the cylinder head of the fourteenth embodiment, showing a state in which both the first and the second control valve element of the air flow regulator are open.

According to this construction, the rotation of the pinion 292, which has been decelerated through the gear box 291 by operation of the motor 290, causes the rack 293, meshing with the pinion, to move together with the first control valve element 280 to open the air bypass passage 273 of the second control valve element 271 (see a dash-double dot line in FIG. 29), then causes movement of the second control valve element 271 itself to open the intake passage opening 7*b* (see a solid line in FIG. 29).

Since the first control valve element 280 which opens first is relatively small in its closing area, even if the vacuum is high, the valve can be opened easily and the load imposed on the motor 290 is lightened. Therefore, the use of a high output motor is not needed and it is possible to prevent an increase of motor size and weight. In addition, it is possible to decrease the loss of electric power and attain the reduction of cost.

According to the structure of the air flow regulator 270 provided with the coordinated motion mechanism, the valve opening characteristic can be changed successively in accordance with the amount of a throttle operation without any complicated control by the motor 290 and a required intake air quantity characteristic can be set easily.

Figure 30:
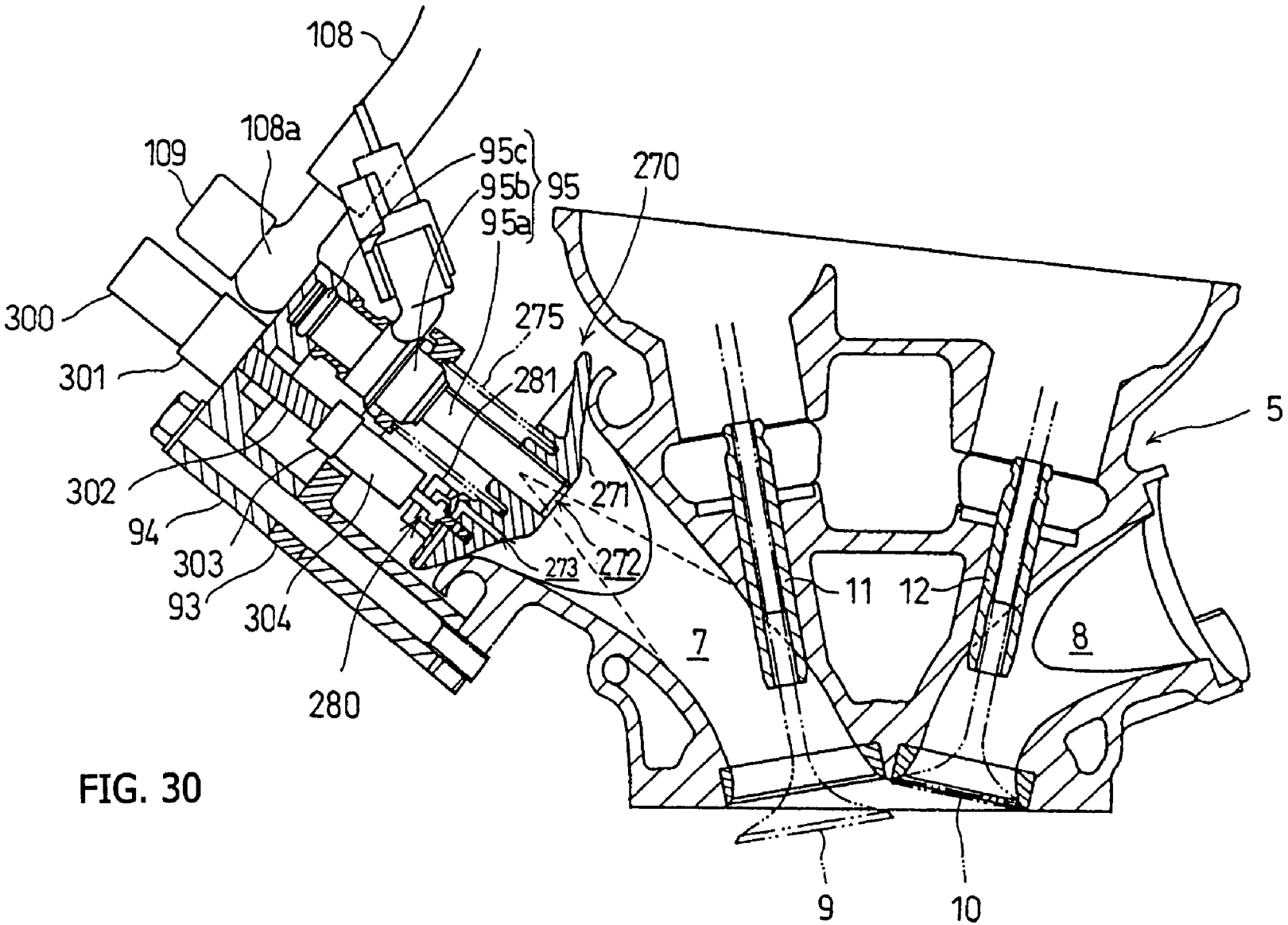
FIG. 30 is a sectional detail view of principal portions of an intake flow control apparatus and a cylinder head according to a fifteenth embodiment of the present invention, showing a state in which both a first control valve element and a second control valve element of an air flow regulator are closed.

Now, with reference to FIGS. 30 and 31, a description will be given of a fifteenth embodiment of the present invention which uses a ball screw mechanism instead of the rack-pinion mechanism used as the drive transfer mechanism in the previous fourteenth embodiment. The fifteenth embodiment is the same as the previous fourteenth embodiment except the drive transfer mechanism used therein. The elements common to both the fourteenth embodiment and the fifteenth embodiment are identified by the same reference numerals.

A motor 300 is fixed to the holder 93 through a gear box 301 and a screw shaft 302, extended from an output shaft of the motor, projects in alignment with the center shaft of the first control valve element 280. The connection ring of the first control valve element 280 serves as a screw receiving portion 304. The screw shaft 262 is threadably engaged through balls with a nut 303 fixed to the screw receiving portion 304.

Figure 31:
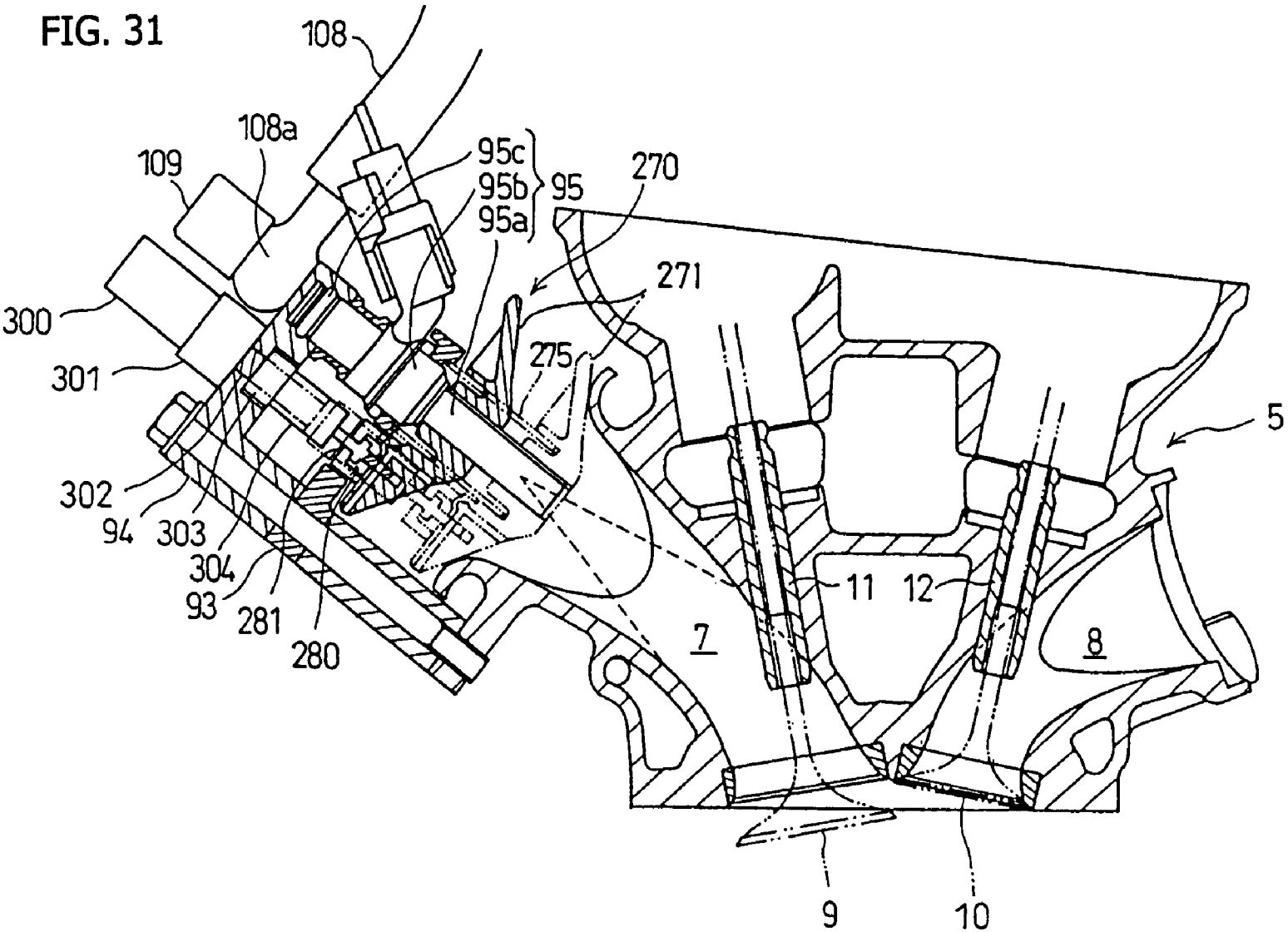
FIG. 31 is a sectional view of the principal portions of the intake flow control apparatus and the cylinder head of the fifteenth embodiment, showing a state in which both the first and the second valve elements of the air flow regulator are open.

According to this construction, the rotation of the screw shaft 302 which is driven by the motor 300, the output of which has been decelerated through the gear box 301, causes the nut 303, threadably engaged with the screw shaft, to move together with the screw receiving portion 304 and the first control valve element 280 to open the air bypass passage 273 of the second control valve element 271 (see a dash-double dot line in FIG. 31), then causes movement of the second control valve element 271 itself to open the intake passage opening 7*b* (see a solid line in FIG. 31).

Because of the same structure of the air flow regulator 270 as in the fourteenth embodiment, even if the vacuum is high, the valve opening operation is easy and the load imposed on the motor 300 is reduced. Therefore, the use of a high output motor is not needed and it is possible to prevent an increase of motor size and weight. In addition, it is possible to decrease the loss of electric power and attain the reduction of cost.

Further, according to the structure of the air flow regulator 270 provided with the coordinated motion mechanism, the valve opening characteristic can be changed successively in accordance with the amount of a throttle operation without any complicated control by the motor 300, whereby a required intake air quantity characteristic can be set easily.

Figure 32:
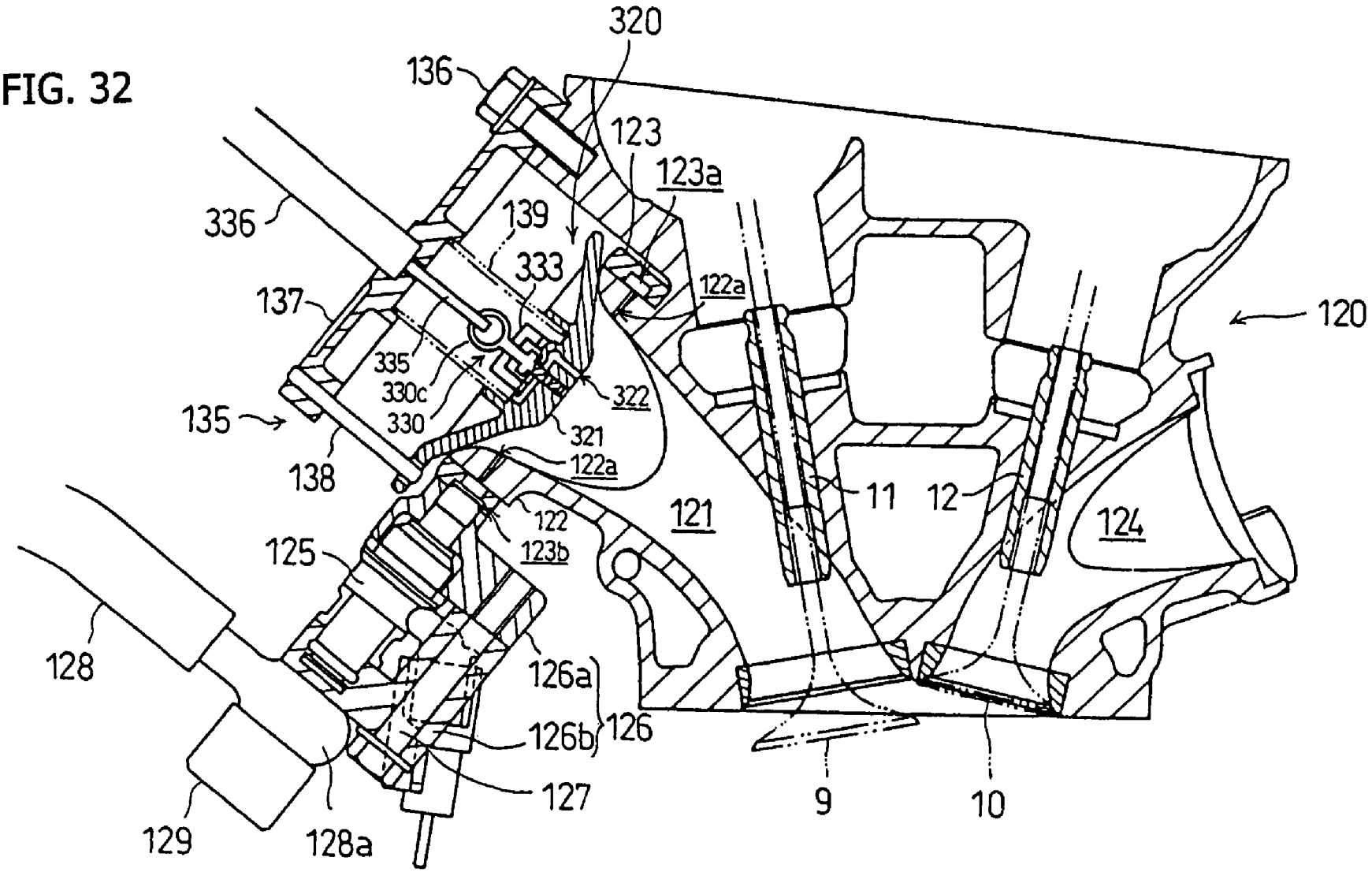
FIG. 32 is a sectional detail view of principal portions of an intake flow control apparatus and a cylinder head according to a sixteenth embodiment of the present invention, showing a state in which both a first control valve element and a second control valve element of an air flow regulator are closed.
Figure 33:
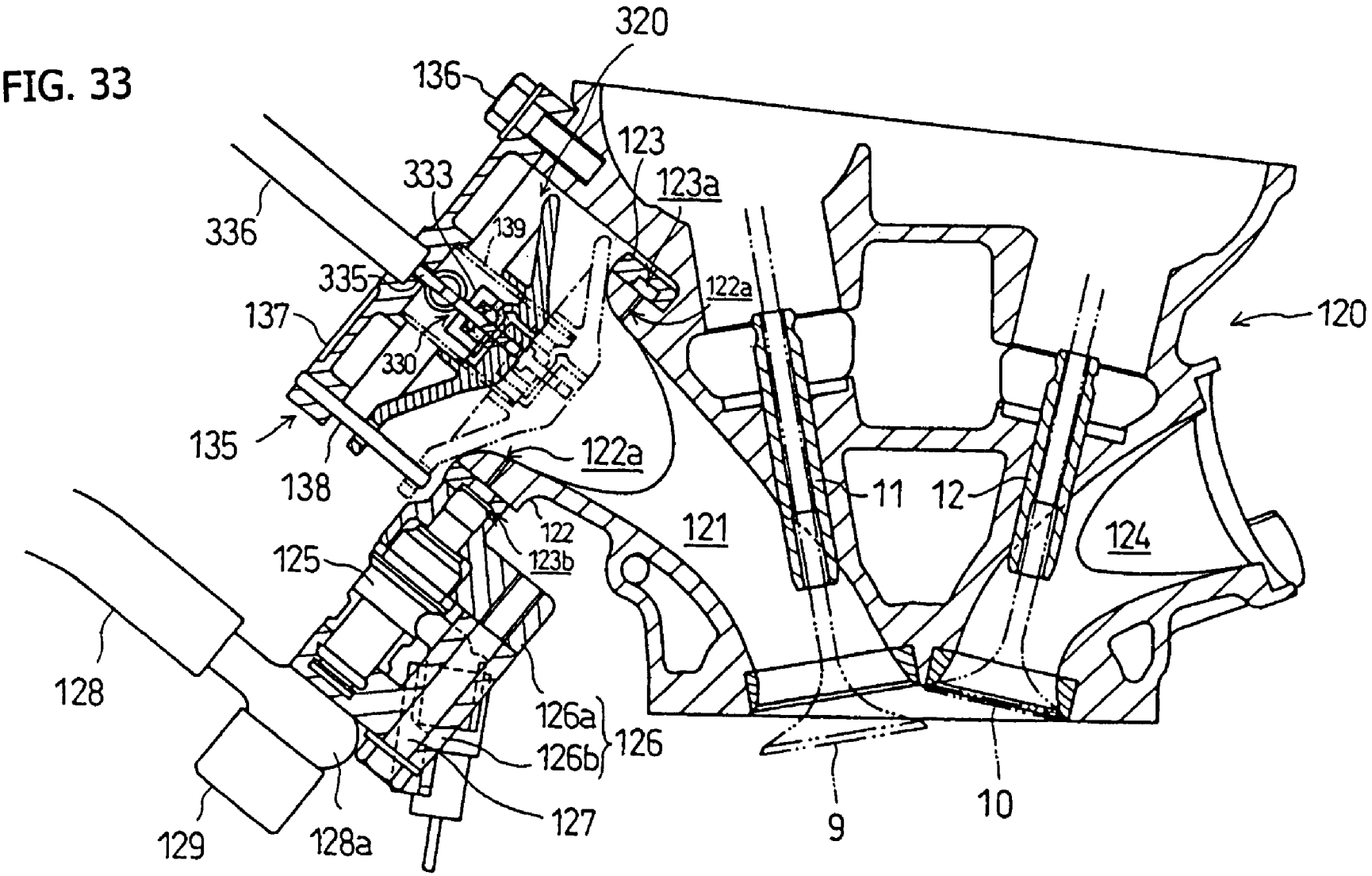
FIG. 33 is a sectional view of the principal portions of the intake flow control apparatus and the cylinder head of the sixteenth embodiment, showing a state in which both the first and the second control valve element of the air flow regulator are open.
Figure 34:
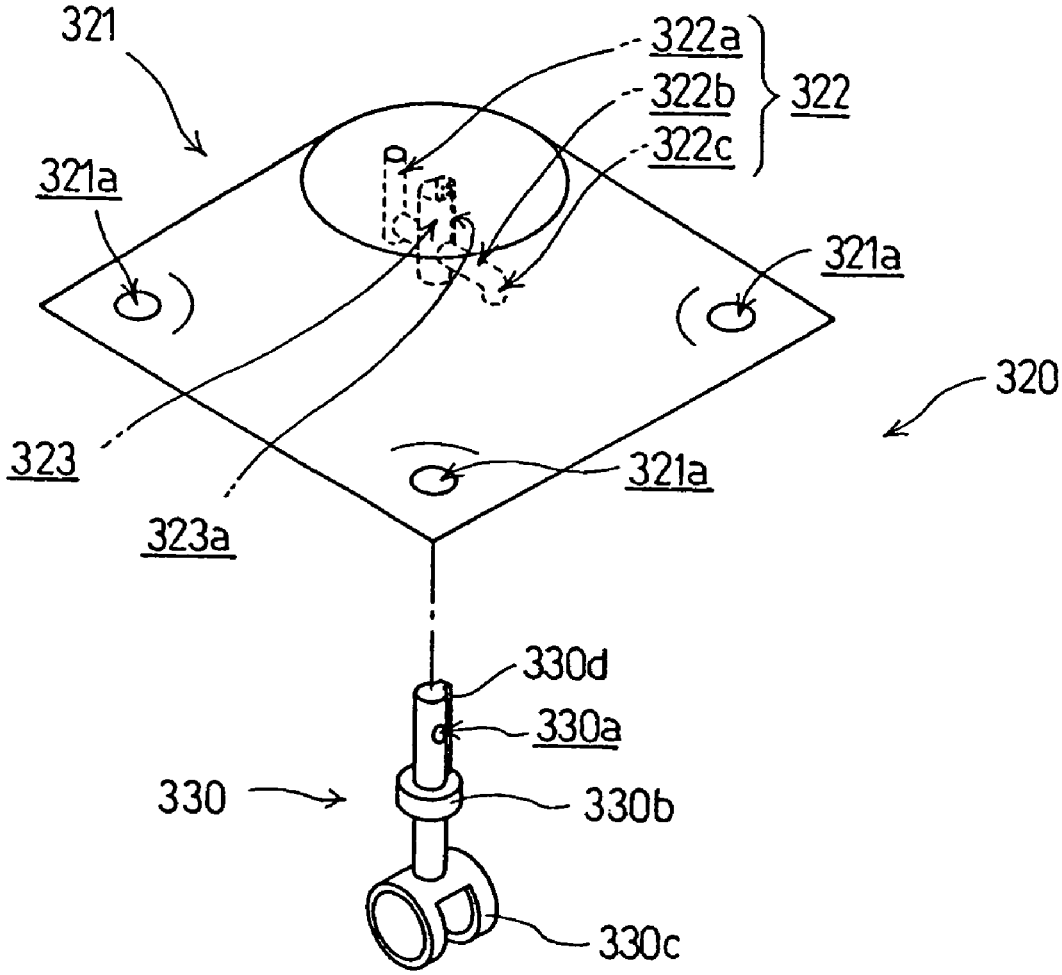
FIG. 34 is an exploded perspective view of the air flow regulator according to the sixteenth embodiment.

Next, with reference to FIGS. 32 to 34, the following description is provided about a sixteenth embodiment of the present invention in which the fuel injector is provided on the outer periphery of the intake passage. An internal combustion engine according to the sixteenth embodiment is provided with the same cylinder head 120 and fuel injection mechanism as in the eighth embodiment. The elements common to both the eighth embodiment and the sixteenth embodiment are identified by the same reference numerals as in the eighth embodiment.

Fuel which has been discharged to the communication port 123*b* by the fuel injector 125 passes through the annular passage 123*a*, and is injected into the intake passage 123 from the four injection holes 122*a*, then is fed by intake into the combustion chamber. With a simple structure, by using a single fuel injector 125 and without using plural fuel injectors, fuel can be injected into the intake passage 121 from the plural injection holes 122*a*, whereby the fuel atomizing characteristic can be greatly improved.

In an air flow regulator 320 used in the intake flow control apparatus of this embodiment, a second control valve element 321 moves while being guided by the same guide structure 135 as that in the eighth embodiment built on the intake passage opening end 122 to open or close the intake passage opening 121*a*.

In the guide structure 135, the upper plate 137 fixed with bolt 136 to the portion around the intake passage opening end 122 of the cylinder head 120 is provided in opposition to the intake passage opening 121*a* and four guide rods 138 are projected from the peripheral edge portion of the upper plate 137 perpendicularly to the opening plane of the intake passage.

As shown in FIG. 34, the second control valve element 321 of the air flow regulator 320 is in the shape of a quadrangular truncated one having a top plane, and four skirt portions extend toward the outer periphery to form a square back side, with circular holes 321*a* being formed in the four corners of the square.

Four guide rods 138 of the guide structure 135 are inserted respectively through the circular holes 321*a*, whereby the second control valve element 321 is supported movably in the intake axis direction. The return spring 139 is interposed between the second control valve element 321 and the upper plate 137.

In the second control valve element 321, as shown in FIG. 34, a vertical hole 322*a* is formed in a position spaced a little from the axis of the top plane toward the same plane. A lateral hole 322*b* intersects the vertical hole 322*a* at the bottom of the vertical hole 322*a*, and extends toward the axis along the back side of the second control valve element 321. Further, a vertical hole 322*c* is formed in an end portion of the lateral hole 322*b* and is open to the back side of the second control valve element 321. With the vertical hole 322*a*, lateral hole 322*b*, and vertical hole 322*c* there is formed an air bypass passage 322 having both-end openings in the front plane and the back side of the cone of the second control valve element 321 and communicating with the front plane and the back side.

A valve inserting hole 323 is formed along the axis from the back side of the second control valve element 321 so as to be perpendicular to the lateral hole 322*b* in the air bypass passage 322. A key way 323*a* is formed in the valve inserting hole 323.

As shown in FIG. 34, a first control valve element 330, which is like a rod, is slidably inserted into the valve inserting hole 323 of the second control valve element 321 from the back side. A through hole 330*a* is formed in the rod-like first control valve element 330 in a position near a front end of the valve element so as to perpendicularly intersect the axis of the valve element. A flange 330*b* is formed centrally of the valve element and a connection ring 330*c* is formed at a base end of the valve element. A ridge portion 330*d* is formed on the front end side of the flange 330*b* so as to match the key way 323*a* formed in the valve inserting hole 323.

The front end side of the first control valve element 330 located ahead of the flange 330*b* is inserted into the valve inserting hole 323 of the second control valve element 321 so that the ridge portion 330*d* is fitted in the key way 323*a* to prevent rotation of the valve element. A bottomed cylindrical restriction member 333 is fixed to the back side of the second control valve element 321 so as to enclose the flange 300*b* exposed from the back side of the second control valve element 321. The portion between the flange 330*b* and the connection ring 330*c* in the first control valve element 330 extends through the bottom wall of the restriction member 333 and the connection ring 330*c* is exposed to the exterior.

Therefore, a slide motion of the first control valve element 330 is inhibited with respect to the second control valve element 321 in a range in which the flange 330*b* is movable between the bottom wall of the restriction member 333 and the back side of the second control valve element 321. When the flange 330*b* comes into abutment against the bottom wall of the restriction member 333, the through hole 330*a* formed near the front end of the first control valve element 330 becomes aligned with the lateral hole 322*b* formed in the air bypass passage 322 and the valve is opened. In other conditions the valve is closed.

A front end of a wire guide 336 for a throttle wire 335, adapted to be operated by the accelerator grip (not shown) which the rider operates, is fixed to the upper plate 137. The throttle wire 335, extended from the front end of the wire guide 336, passes through the upper plate 137 and is connected to the connecting ring 330*c* of the first control valve element 330.

FIG. 32 shows a fully closed state of the intake passage 121. In this state, the second control valve element 321 is urged by the return spring 139 into abutment against the intake passage opening 121 to close the intake passage 7. At this time, the vertical hole 322*a* formed in the air bypass passage 322 is open into the intake passage 7, and the vertical hole 322*c* is open to the exterior, but the first control valve element 330 closes the air bypass passage 322, whereby the intake passage 7 is completely closed.

When the accelerator grip is operated and the throttle wire 335 is pulled thereby in this state, the first control valve element 330 moves while allowing the second control valve 321 to remain with the biasing force of the return spring 139, whereby the through hole 330*a* is brought into alignment with the air bypass passage 332 of the second control valve element 321 to open the same passage, as indicated by a dash-double dot line in FIG. 33.

Since the first control valve 330, which opens first, is small in its closing area, even if the vacuum is high, the first control valve element 330 can be opened easily and the movement thereof is accomplished with a light force. Once the first control valve element 330 opens, the vacuum is reduced and the movement of the second control valve element 321 located in the next stage can also be accomplished with a lightened force, thus permitting smooth control of the amount of intake air.

The closing area of the first control valve element 330, which opens in the initial opening stage, is smaller than that of the second control valve element 321. Therefore, in a low revolution state of the internal combustion engine, i.e., in a low valve angle state, for example at the time of start-up of the vehicle, the amount of intake air can be controlled precisely by the first control valve element 330 which is the smaller in the intake passage opening area, and the output of the internal combustion engine relative to the amount of throttle operation at the time of start-up of the vehicle can be controlled precisely, whereby it is possible to fully meet a request for acceleration according to conditions.

Only the first control valve element 330 moves until the flange 330*b* of the first control valve element 330 comes into contact with the restriction member 333 after the throttle wire 335 is pulled. When the throttle wire 335 is further pulled beyond the low revolution state of the internal combustion engine and the flange 330*b* of the first control valve element 330 comes into contact with the restriction member 333, the second control valve element 321 moves together with the restriction member 333 to open the intake passage opening 7*b* as indicated by a solid line in FIG. 33. A coordinated motion mechanism is thus constituted.

The movement of the second control valve element 321 has a valve opening characteristic different from that exhibited when only the first control valve element 330 moves. With the coordinated motion mechanism, the valve opening characteristic is changed successively in accordance with the amount of a throttle operation, whereby an intake air quantity characteristic can be set easily.

Although in this sixteenth embodiment the air flow regulator 320 is actuated manually, it may be actuated by a motor through a pinion-rack mechanism or a ball screw mechanism.

Figure 35:
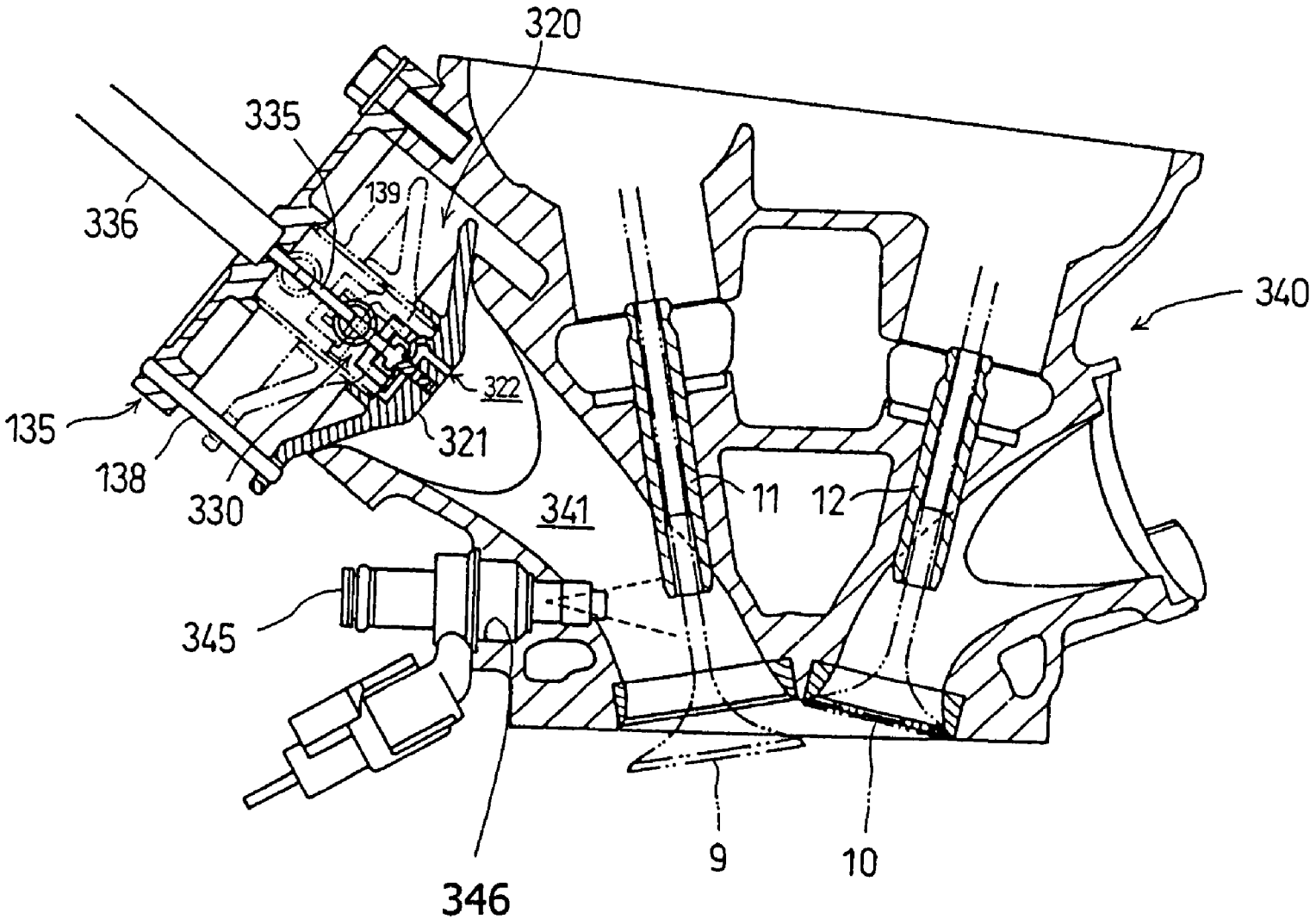
FIG. 35 is a sectional detail view of principal portions of an intake flow control apparatus and a cylinder head according to a seventeenth embodiment of the present invention.

Now, with reference to FIG. 35, the following description is provided about a seventeenth embodiment of the present invention in which a fuel injector is provided on the outer periphery of the intake passage.

A fuel injector 345 according this embodiment is disposed at a position close to a combustion chamber-side opening of an intake passage 341 formed in a cylinder head 340. Other structural points are the same as in the sixteenth embodiment. The elements common to both the sixteenth embodiment and the seventeenth embodiment are identified by the same reference numerals as in the sixteenth embodiment.

An insertion hole 346 is formed in the outer periphery of the intake passage 341 at a position close to the combustion chamber-side opening, and the fuel injector 345 is inserted into the insertion hole 346 and is fixed thereby. The fuel injector 345 is fixed so as to inject fuel into the intake passage 341 toward the downstream side at an acute angle relative to the intake axis.

Since the fuel injector 345 is thus provided on the outer periphery of the intake passage 341 of the cylinder head 340, the structure of the air flow regulator 130 itself can be simplified as in the sixteenth embodiment.

Figure 36:
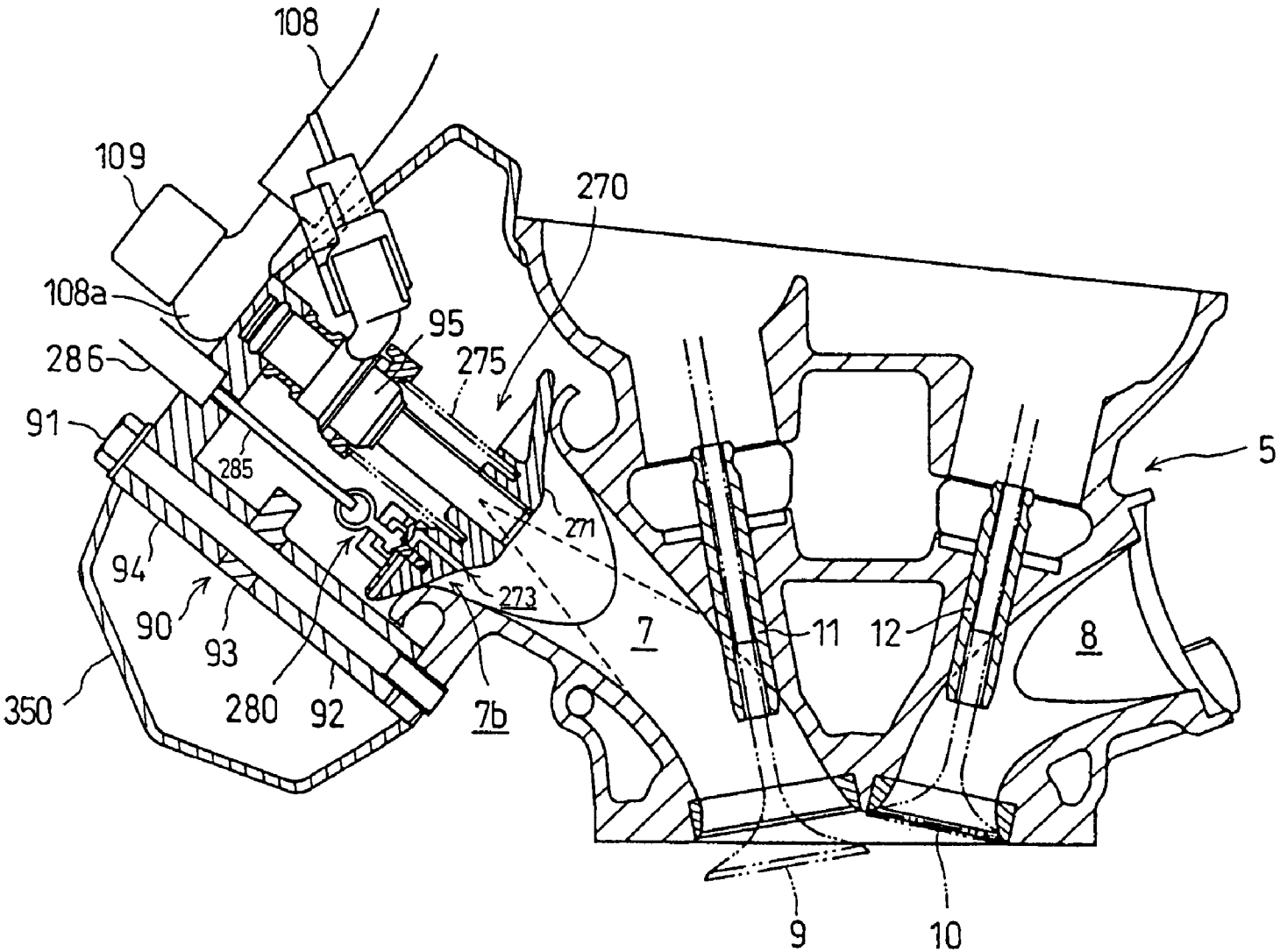
FIG. 36 is a sectional detail view of principal portions of an intake flow control apparatus and a cylinder head according to an eighteenth embodiment of the present invention.

Now, with reference to FIG. 36, the following description is provided about an eighteenth embodiment of the present invention in which an air flow regulator having plural valve elements is included within an air cleaner 350. In the eighteenth embodiment all the other members than the air cleaner 350 are the same as in the thirteenth embodiment, and therefore elements common to both the thirteenth embodiment and the eighteenth embodiment are identified by the same reference numerals as in the thirteenth embodiment.

A casing of the air cleaner 350 utilizes as part thereof the holder 94 of the guide structure 90 to cover the intake passage opening 7*b* throughout the whole circumference, and the guide structure 20 and the intake air flow regulator 30 are included in a clean side of the air cleaner. The connector 95*d* of the fuel injector 95 held by the holders 93 and 94 are partially exposed through the casing of the air cleaner 350.

With the air cleaner 350, it is possible to positively prevent the entry of dust, etc. into the intake passage 7.

While a number of specific working examples of the present invention have been described above, the present invention is not limited to the working examples described above, but various design alterations may be carried out without departing from the present invention as set forth in the claims. The foregoing description is intended to illustrate, rather than to limit the invention. Those skilled in the art will realize that many modifications of the preferred embodiment could be made which would be operable. All such modifications, which are within the scope of the claims, are intended to be within the scope and spirit of the present invention.

What is claimed is:

1. An intake flow control apparatus for an internal combustion engine, said apparatus comprising:

an air routing member having a hollow intake passage formed therein for routing intake air toward a combustion chamber of the internal combustion engine, said intake passage having an opening;

an air flow regulator operatively attached to the air routing member for regulating air flow through said intake passage;

a guide structure on which the air flow regulator is movably mounted, the guide structure capable of guiding substantially axial movement of the air flow regulator toward or away from the air routing structure;

a control mechanism for selectively moving said air flow regulator on said guide structure according to an amount of operation of a throttle; and a vacuum moderating structure for moderating an intake vacuum applied to said air flow regulator in a closed configuration thereof.

2. The intake flow control apparatus according to claim 1, wherein said vacuum moderating structure comprises an air bypass passage formed in said air flow regulator or in another component of the internal combustion engine, the air bypass passage capable of providing fluid communication between the interior and the exterior of said intake passage when said air flow regulator comes into close proximity to the opening of said intake passage.

3. The intake flow control apparatus according to claim 1, wherein said vacuum moderating structure comprises a restriction member for restricting movement of said air flow regulator in an intake axis direction towards the opening of said intake passage.

4. The intake flow control apparatus according to claim 1, wherein said air flow regulator comprises a plurality of valve elements which open sequentially in accordance with the amount of throttle operation, and said vacuum moderating structure comprises a valve opening mechanism in which one of said valve elements having the smallest closing area opens prior to the remaining valve elements.

5. The intake flow control apparatus according to claim 1, wherein a fuel injector is attached to and adapted to move integrally with said air flow regulator.

6. The intake flow control apparatus according to claim 1, wherein a fuel injector is attached to a body of the internal combustion engine, and wherein said guide structure comprises a casing of said fuel injector.

7. The intake flow control apparatus according to claim 1, wherein a fuel injector is provided on an outer periphery of said intake passage in a body of the internal combustion engine.

8. The intake flow control apparatus according to claim 7, wherein:

an annular passage is formed in an outer periphery of said intake passage, injection holes are formed in plural positions throughout the whole circumference of said annular passage so as to extend to said intake passage, and a fuel injection orifice of said fuel injector is open to said annular passage.

9. The intake flow control apparatus according to claim 1, wherein an intake pressure sensor passage is provided in said air flow regulator for detecting an internal pressure of said intake.

10. An intake flow control apparatus for an internal combustion engine comprising a combustion chamber, the intake flow control apparatus comprising:

an air routing member having a hollow intake passage formed therein for routing intake air toward a combustion chamber of the internal combustion engine, said intake passage having an upstream-side opening;

an air flow regulator operatively attached to the air routing member for regulating air flow through said intake passage;

a guide structure adapted to permit movement of the air intake air flow regulator in an intake axis direction to control air flow through said intake passage; and a control mechanism for selectively moving said air flow regulator on said guide structure according to an amount of operation of a throttle; wherein said guide structure is affixed to a cylinder head of the internal combustion engine.

11. The intake flow control apparatus according to claim 10, wherein the guide structure comprises a return spring, and wherein the return spring urges said air flow regulator toward the opening of said intake passage.

12. The intake flow control apparatus according to claim 10, wherein said internal combustion engine comprises a cylinder head disposed above the combustion chamber;

said intake flow control apparatus comprises a fuel injector, the fuel injector comprising a casing having a cylindrical portion directed in said intake axis direction so as to face the upstream-side opening of said intake passage;

the guide structure comprises a holder, the holder projecting from both said cylinder head and an injection cylinder of a casing of a fuel injector; and wherein said cylindrical portion of said fuel injector casing extends through said air flow regulator and guides movement the air flow regulator in the intake axis direction.

13. An intake flow control apparatus for an internal combustion engine having a combustion chamber, the intake flow control apparatus comprising:

an air routing member having a hollow intake passage formed therein for routing intake air toward a combustion chamber of the internal combustion engine, said intake passage having an upstream-side opening;

an air flow regulator for regulating air flow into the upstream-side opening of said intake passage, the air flow regulator adapted to move in an intake axis direction to control the amount of intake air fed into the combustion chamber; and a control mechanism comprising a valve actuating device for selectively moving said air flow regulator according to an amount of operation of a throttle;

wherein said air flow regulator comprises a plurality of valve elements, each of the plurality of valve elements operable according to a different operation timing, and wherein said valve actuating device successively actuates said plural valve elements in accordance with the amount of throttle operation to control the amount of intake air required in an operation state of the internal combustion engine.

14. The intake flow control apparatus according to claim 13, wherein said air flow regulator comprises a first control valve element adapted to open in an initial opening stage and a second control valve element adapted to open after the initial opening stage, and the area of an intake passage opening upon opening of said first control valve element is smaller than that upon opening of said second control valve element.

15. The intake flow control apparatus according to claim 14, the intake flow control apparatus further comprising a coordinated motion mechanism, wherein the operation of said valve actuating device acts on said first control valve element to move said first control valve element in its opening direction, and when the movement of said first control valve element exceeds a predetermined distance, the valve actuating device acts on said second control valve element and causes said second control valve element to move in its opening direction.

16. The intake flow control apparatus according to claim 14, wherein said first control valve element is disposed so that it can open and close an air passage formed in said second control valve element.

17. The intake flow control apparatus according to claim 13, wherein a fuel injector is attached to a body side of said internal combustion engine, and a casing of said fuel injector guides movement of said air flow regulator in an intake axis direction.

18. The intake flow control apparatus for an internal combustion engine according to claim 13, wherein a fuel injector is attached to a body of said internal combustion engine, and wherein said fuel injector is provided in an outer periphery of said intake passage in the body of said internal combustion engine.

* * * * *